US009975230B2

(12) United States Patent
Aoki et al.

(10) Patent No.: US 9,975,230 B2
(45) Date of Patent: May 22, 2018

(54) SHEET PROCESSING APPARATUS

(71) Applicant: MAX CO., LTD., Tokyo (JP)

(72) Inventors: Akira Aoki, Tokyo (JP); Takuya Kubota, Tokyo (JP)

(73) Assignee: MAX CO., LTD., Tokyo (JP)

( * ) Notice: Subject to any disclaimer, the term of this patent is extended or adjusted under 35 U.S.C. 154(b) by 1034 days.

(21) Appl. No.: 13/850,601

(22) Filed: Mar. 26, 2013

(65) Prior Publication Data

US 2013/0284787 A1 Oct. 31, 2013

(30) Foreign Application Priority Data

Apr. 27, 2012 (JP) ..... 2012-103272

(51) Int. Cl.
*B25C 5/00* (2006.01)
*B25C 5/11* (2006.01)
*B25C 5/02* (2006.01)

(52) U.S. Cl.
CPC ..... *B25C 5/11* (2013.01); *B25C 5/025* (2013.01)

(58) Field of Classification Search
CPC ..... B25C 5/0242; B25C 5/025; B25C 5/11; B25C 5/0207
USPC ..... 227/81, 107, 129, 132, 155, 131, 134
See application file for complete search history.

(56) References Cited

U.S. PATENT DOCUMENTS 2,225,054 A * 12/1940 Houwen ..... B25C 5/08 226/147
5,758,813 A * 6/1998 Kikuchi ..... B25C 5/0242 227/134
7,621,432 B2 * 11/2009 Chiang ..... B25C 5/1603 227/109
8,038,043 B2 * 10/2011 Wang ..... B25C 5/0242 227/120
2002/0005427 A1 1/2002 Aoki
2006/0138192 A1 * 6/2006 Matsukawa ..... B25C 5/0242 227/134
2006/0231583 A1 * 10/2006 Kumayama ..... B25C 5/1603 227/134
2007/0145093 A1 * 6/2007 Matsukawa ..... B25C 5/0242 227/120
2007/0175946 A1 * 8/2007 Marks ..... B25C 5/11 227/132

(Continued)

FOREIGN PATENT DOCUMENTS

CN 1890060 A 1/2007
DE 20 2010 000 145 U1 9/2010

(Continued)

*Primary Examiner* — Hemant M Desai
*Assistant Examiner* — Eyamindae Jallow
(74) *Attorney, Agent, or Firm* — Drinker Biddle & Reath LLP

(57) ABSTRACT

A sheet processing apparatus is provided with an operation member and an motion member that rotates with a force of the operation member through the connection part and applies force to an acting member. A fulcrum of a rotating operation of the operation member moves depending on an operation of the operation member. A first length between the fulcrum and a part at which the operation member is applied with the force and a second length between the fulcrum and a part at which the force is applied from the operation member to the motion member are changed.

7 Claims, 56 Drawing Sheets

(56) References Cited

U.S. PATENT DOCUMENTS

2007/0221699 A1* 9/2007 Hsu ..... B25C 5/0242 227/134
2008/0302850 A1* 12/2008 Kumayama ..... B25C 5/0242 227/120
2009/0152318 A1 6/2009 Matsukawa
2009/0159637 A1* 6/2009 Maemori ..... B25C 5/0242 227/120
2009/0184150 A1* 7/2009 Tsai ..... B25C 5/11 227/134
2009/0272781 A1* 11/2009 Maemori ..... B25C 5/162 227/120
2010/0012701 A1* 1/2010 Huang ..... B25C 5/0242 227/132
2010/0059568 A1* 3/2010 Leung ..... B25C 5/025 227/64
2010/0243701 A1* 9/2010 Yu ..... B25C 5/11 227/129
2010/0264190 A1 10/2010 Tsai et al.
2010/0288815 A1* 11/2010 Maemori ..... B25C 5/11 227/127
2011/0030525 A1 2/2011 Huang
2012/0097728 A1* 4/2012 Huang ..... B25C 5/025 227/107
2012/0175397 A1* 7/2012 Co ..... B25C 5/11 227/155
2013/0001269 A1* 1/2013 Aoki ..... B25C 5/0207 227/155
2013/0221057 A1* 8/2013 Zhao ..... B25C 5/025 227/129

FOREIGN PATENT DOCUMENTS

JP S62-122930 A 6/1987
JP 2002-028877 A 1/2002
JP 2002337065 A 11/2002
JP 2009142937 A 7/2009

* cited by examiner

EXAMPLE OF REDUCTION RATE OF LOAD

SHEET PROCESSING APPARATUS

BACKGROUND OF THE INVENTION

Field of the Invention

The present invention relates a sheet processing apparatus that processes a sheet by a user operation.

Related Art

JP-A-2002-028877 discloses a stapler having a so-called boosting mechanism for reducing a load that is required for an operation.

In the conventional boosting mechanism, a rear end of a clincher arm having a clincher for bending a staple is provided with a rotating fulcrum of a driver arm having a driver for driving the staple. A rotating fulcrum of a handle that is operated is provided at the front of the rotating fulcrum of the driver arm. The handle and the driver arm are connected by a shaft and a hole at the front of the rotating fulcrum of the handle.

The hole into which the shaft connecting the handle and the driver arm is inserted has an elongated shape and a difference between rotating trajectories of the handle and the driver arm is absorbed. The rotating fulcrums of the handle and the driver arm are not displaced and a positional relation of the respective fulcrums is fixed. Therefore, a leverage is not changed from an early driving stage to a driving completion of the staple and a reduction rate (boosting rate) of the load is constant through an entire stroke of the handle while.

In the boosting mechanism of the conventional sheet processing apparatus such as stapler, the reduction rate of the load is constant from the starting of the processing to the completion thereof. When the load necessary for the operation is constant, it is possible to obtain a desired load over an entire area of a movable range within which an operation member such as handle to be operated can be displaced, even though the reduction rate of the load is made to be constant.

However, when the load necessary for the operation is changed, if the reduction rate of the load is constant, the load is lowered with the constant reduction rate even in an area in which the load reduction is not required. As a result, an operation amount of the operation member is increased. Thereby, a size of the apparatus in a height direction is increased.

When the operation amount of the operation member is increased by increasing the size of the apparatus in the height direction, it is difficult for a woman having a small hand, for example, to use a stapler that is used with being gripped by a hand, because the stapler does not fit into the hand. Also, a user cannot actually perform the driving operation with a desktop type stapler at a sitting natural posture. Hence, the user should perform the operation with standing, so that the convenience of the operator is deteriorated.

SUMMARY OF THE INVENTION

One or more embodiments provide a sheet processing apparatus in which a reduction ratio of a load is changed depending on the load necessary for an operation.

According to embodiments, it is possible to change a reduction ratio of a load depending on the load necessary for an operation. Therefore, in an area where the load necessary for the operation is low, the reduction ratio of the load may be made to be small, thereby increasing a moving amount of the operation member. In an area where the load necessary for the operation is high, the reduction ratio of the load may be made to be large.

Thereby, it is possible to reduce the load necessary for the operation with a desired reduction rate over an entire area of a movable range of the operation member without increasing an operation amount of the operation member beyond necessity. Since it is possible to suppress the operation amount of the operation member, it is possible to prevent the apparatus from being enlarged and to improve the operational feeling.

DETAILED DESCRIPTION OF THE EMBODIMENTS

Figure 1:
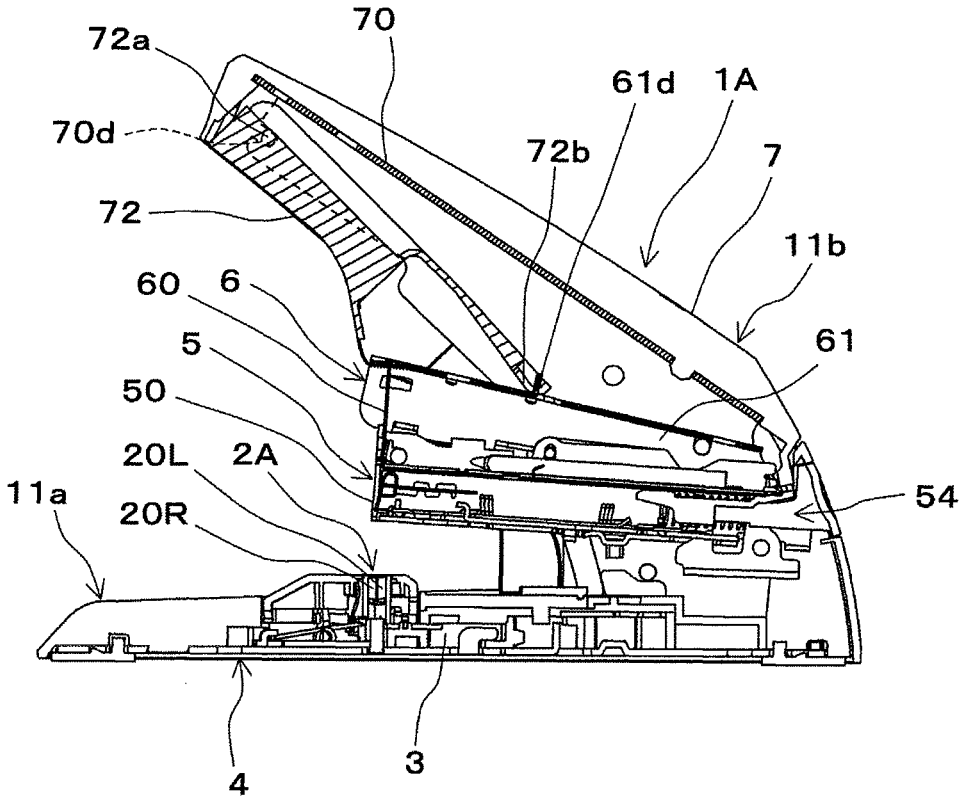
FIG. 1 is a side sectional view showing a detailed internal configuration of a stapler according to an exemplary embodiment.
Figure 2:
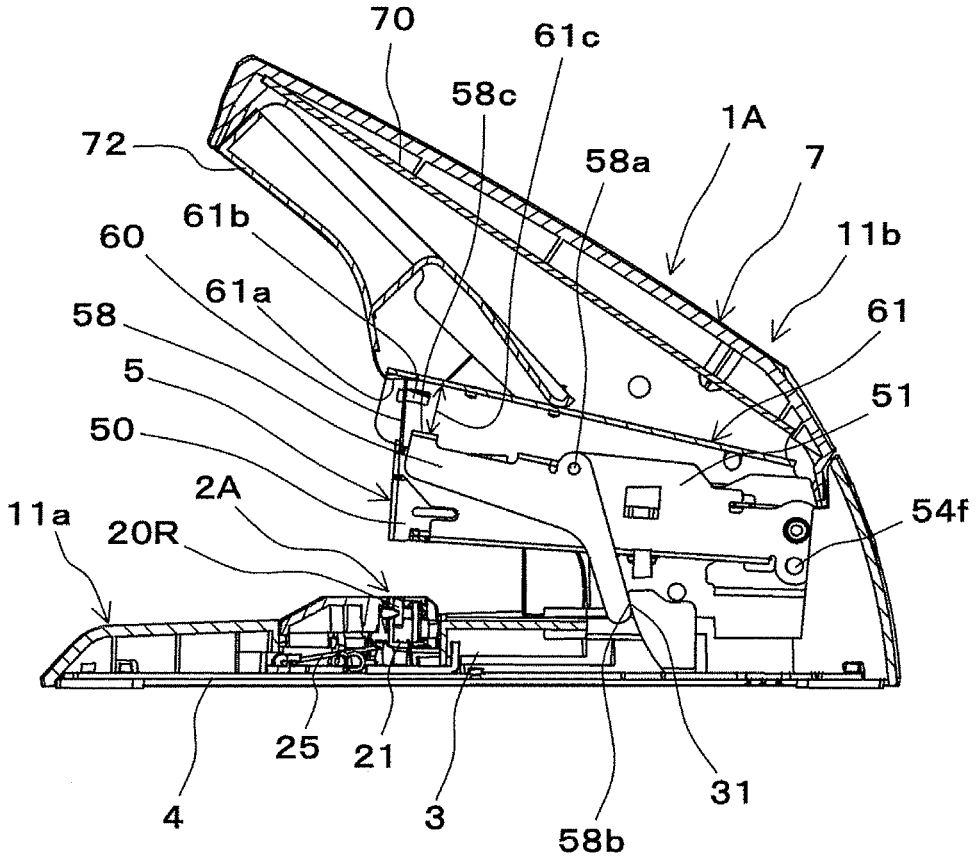
FIG. 2 is a side sectional view showing an internal configuration of the stapler of the exemplary embodiment.
Figure 3:
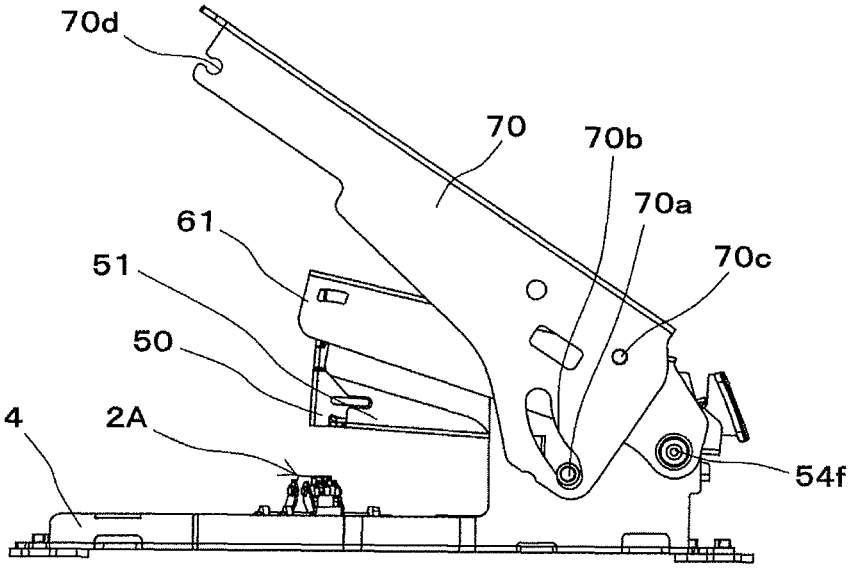
FIG. 3 is a side view of the stapler of the exemplary embodiment with a cover being removed.
Figure 4:
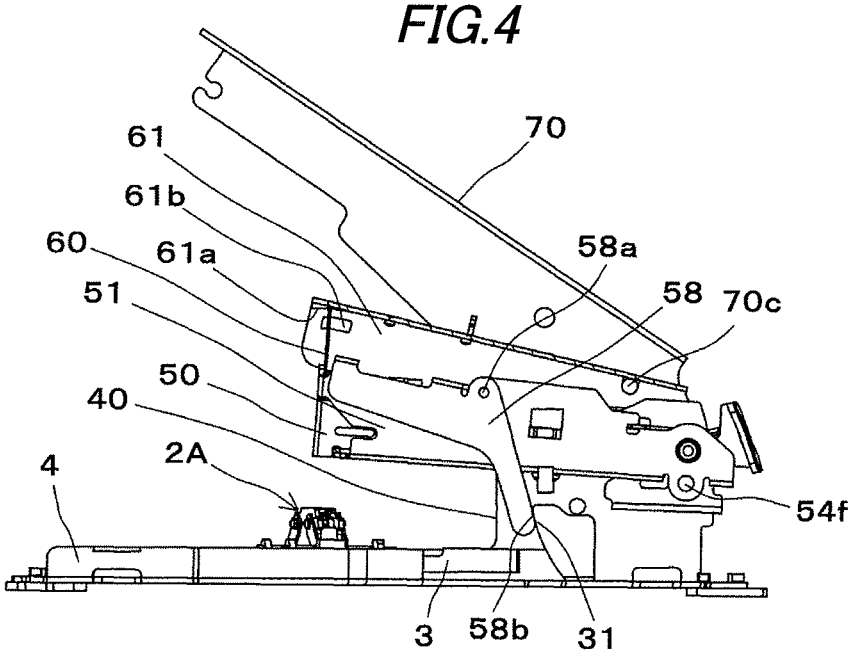
FIG. 4 is a side sectional view showing an internal configuration of the stapler of the exemplary embodiment with the cover being removed.

A stapler of binding sheets will be described with reference to the drawings, as an exemplary embodiment of the sheet processing apparatus of the invention. FIG. 1 is a side sectional view showing a detailed internal configuration of a stapler according to an exemplary embodiment, FIG. 2 is a side sectional view showing an internal configuration of the stapler of the exemplary embodiment, FIG. 3 is a side view of the stapler of the exemplary embodiment with a cover being removed and FIG. 4 is a side sectional view showing an internal configuration of the stapler of the exemplary embodiment with the cover being removed.

Figure 5:
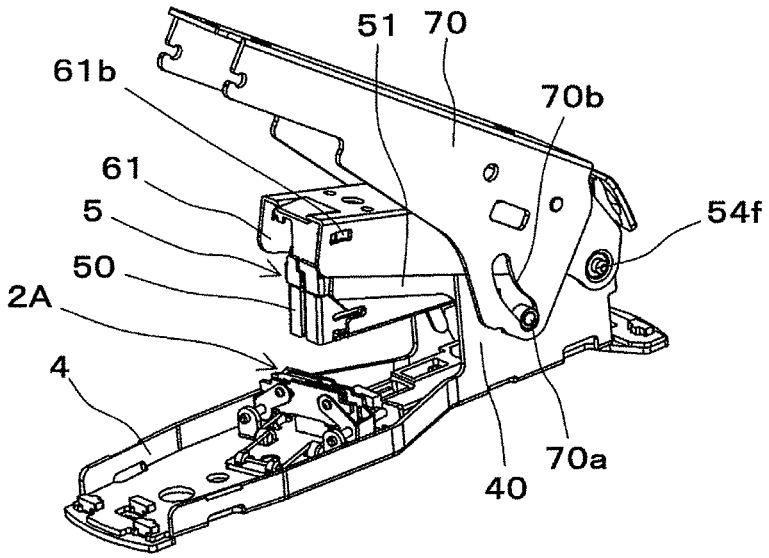
FIG. 5 is a perspective view showing an internal configuration of the stapler according to the exemplary embodiment.
Figure 6:
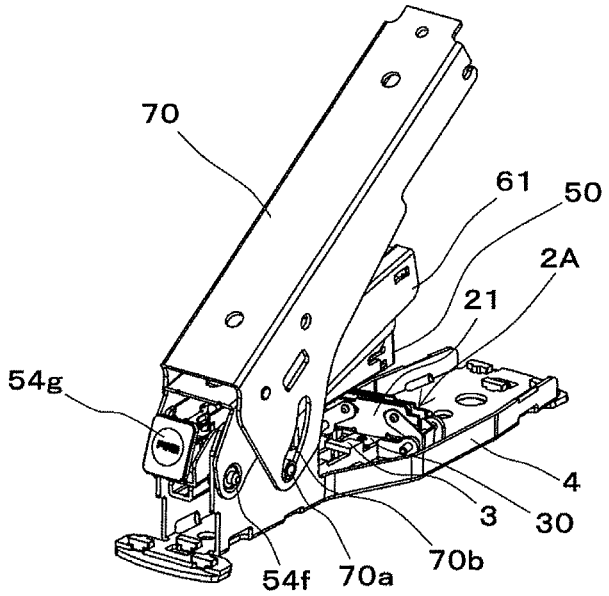
FIG. 6 is a perspective view showing an internal configuration of the stapler according to the exemplary embodiment.
Figure 7:
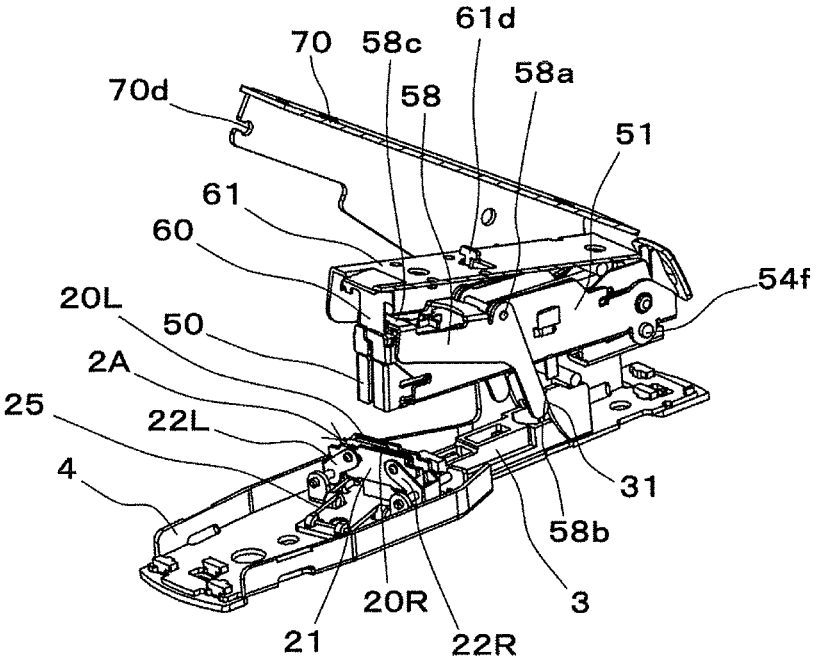
FIG. 7 is a partially broken perspective view showing an internal configuration of the stapler according to the exemplary embodiment.
Figure 8:
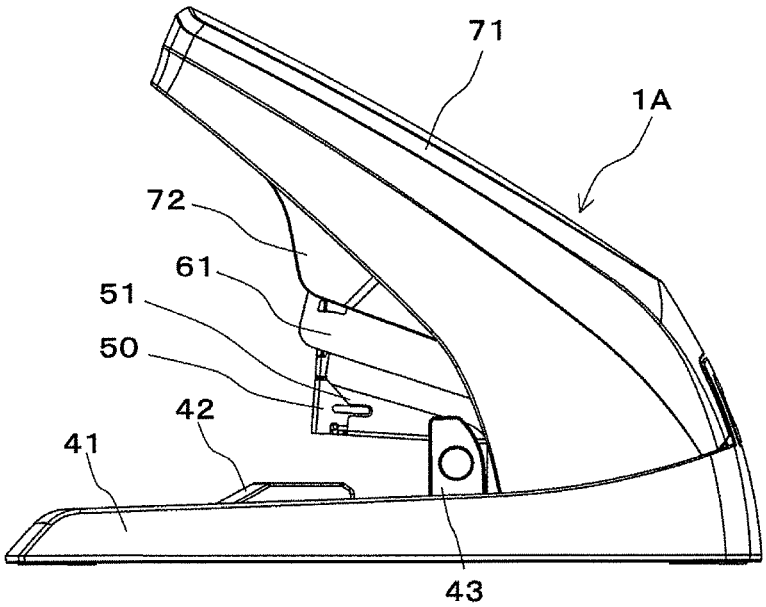
FIG. 8 is a side view showing an outward appearance of the stapler according to the exemplary embodiment.
Figure 9:
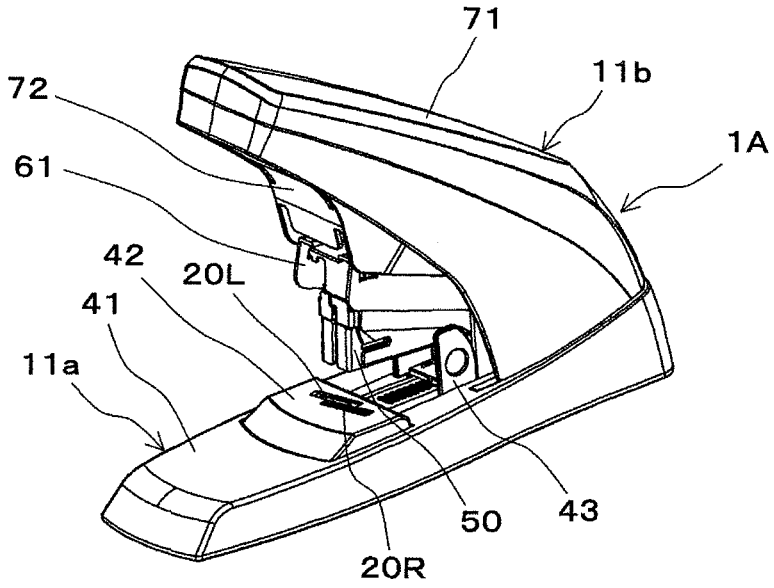
FIG. 9 is a perspective view showing the outward appearance of the stapler according to the exemplary embodiment.
Figure 10:
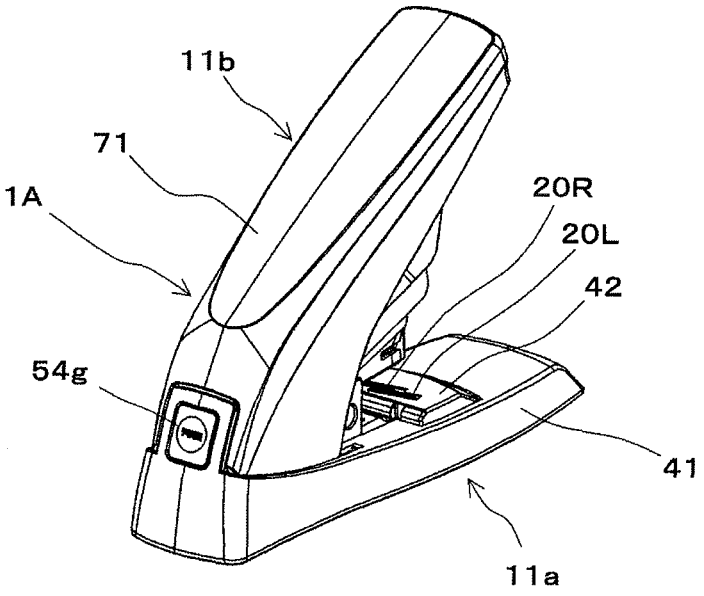
FIG. 10 is a perspective view showing the outward appearance of the stapler according to the exemplary embodiment.
Figure 11A:
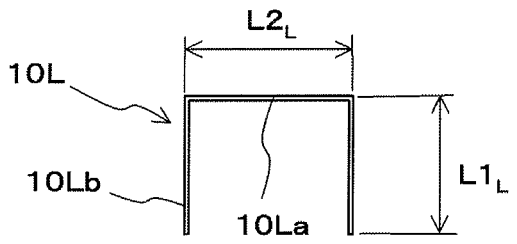
FIGS. 11(*a*) to 11(*d*) illustrate an example of a staple that is used in the stapler of the exemplary embodiment.
Figure 11B:
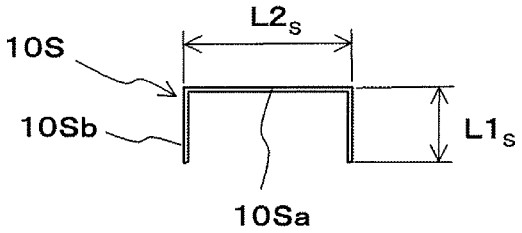
Figure 11C:
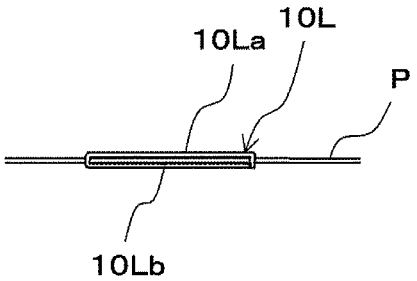
Figure 11D:
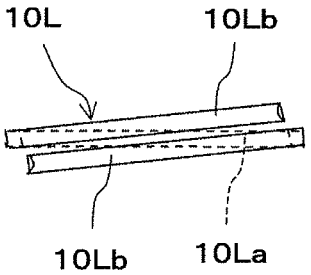

FIGS. 5 and 6 are perspective views showing an internal configuration of the stapler according to the exemplary embodiment, and FIG. 7 is a partially broken perspective view showing an internal configuration of the stapler according to the exemplary embodiment. Also, FIG. 8 is a side view showing an outward appearance of the stapler according to the exemplary embodiment and FIGS. 9 and 10 are perspective views showing an outward appearance of the stapler according to the exemplary embodiment. Also, FIG. 11 illustrates an example of a staple that is used in the stapler of the exemplary embodiment.

A stapler 1A of an exemplary embodiment has a boosting mechanism reducing a load that is necessary for an operation of binding sheets and is configured to stepwise switch a reduction rate of the load in each process of the sheet binding operation so that the load is fitted for the operation.

First, a staple that can be used in the stapler 1A of the exemplary embodiment is described with reference to FIG. 11. A staple 10L having long legs shown in FIG. 11(*a*) is an example of the first staple, and it is assumed that it can bind about 80 sheets, as the maximum number of sheets to be bound. Also, a staple 10S having short legs shown in FIG. 11(*b*) is an example of the second staple, and it is assumed that it can bind about 40 sheets, as the maximum number of sheets to be bound.

The staple 10L has a staple crown 10La and two legs 10Lb that are bent to be substantially parallel from both ends of the staple crown 10La in one direction. A plurality of the staples 10L is integrated by bonding, thereby configuring a bundle of staples. The staple 10S also has a staple crown 10Sa and two legs 10Sb that are bent to be substantially parallel from both ends of the staple crown 10Sa in one direction. A plurality of the staples 10S is integrated by bonding, thereby configuring a bundle of staples.

When a thickness of one standard sheet is 0.09 mm, the 80 sheets have a thickness of about 7.2 mm. Hence, the staple 10L is configured so that a length L1L of the legs 10Lb is 10.0 mm so as to enable the legs 10Lb to penetrate and clinch about 80 sheets.

For a stable having a leg length smaller than a half of a staple crown width, when binding two sheets that are the smallest number of sheets to be bound, leading ends of both legs do not overlap with each other. However, when the leg is lengthened, the width of the staple crown is also widened, so that an outward appearance is poor.

Therefore, for a staple having a leg length equal to or larger than a half of a staple crown width, two legs are bent so that they are slightly offset in a front-rear direction orthogonal to the staple crown. Thereby, even when binding two sheets P that are the smallest number of sheets to be bound, the two legs do not overlap each other.

In the meantime, if a leg length is equal to or larger than a staple crown width, when binding two sheets P that are the smallest number of sheets to be bound, leading ends of the legs more protrude outward in a width direction than the staple crown on a surface of the sheet, so that the outward appearance is poor.

Therefore, the staple 10L is configured so that a length of the leg 10Lb is equal to or smaller than a width of the staple crown 10La. In the exemplary embodiment, an outer size L2L of the staple crown 10La is about 11.4 mm. The length of the leg 10Lb is configured to be substantially equal to or smaller than the outer size of the staple crown 10La. Thus, even when binding two sheets P that are the smallest number of sheets to be bound, the leading ends of the legs 10Lb do not more protrude outward in the width direction than the staple crown 10La on the surface of the sheet P.

The staple 10S is configured so that a length L1S of the legs 10Sb is 6.0 mm so as to enable the legs 10Sb to penetrate and clinch about 40 sheets. Also, an outer size L2S of the staple crown 10Sa is about 11.4 mm, considering the compatibility with the staple 10L. Here, the sizes of the respective staples are exemplary. That is, the other sizes may be also adopted insomuch as the lengths of the legs are different and the staple has the compatibility between the different legs.

<Example of Overall Configuration of Stapler of Exemplary Embodiment>

Subsequently, an example of the stapler 1A of the exemplary embodiment is described with reference to the respective drawings. The stapler 1A of the exemplary embodiment has a lower handle unit 11*a* and an upper handle unit 11*b*. In this example, the stapler is used in a form of pressing the upper handle unit 11*b* with the lower handle unit 11*a* being put on an operation place such as desk.

Figure 12:
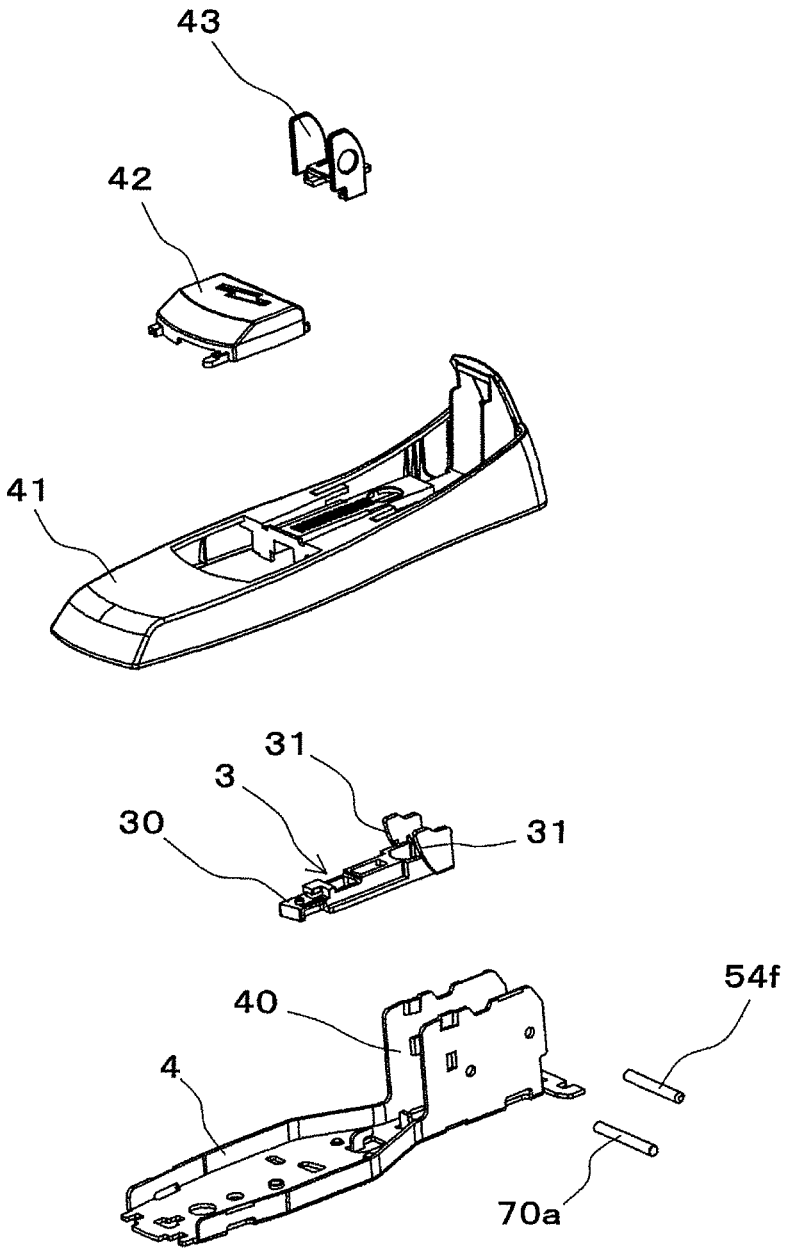
FIG. 12 is an exploded perspective view showing an example of a lower handle unit of the exemplary embodiment.
Figure 13:
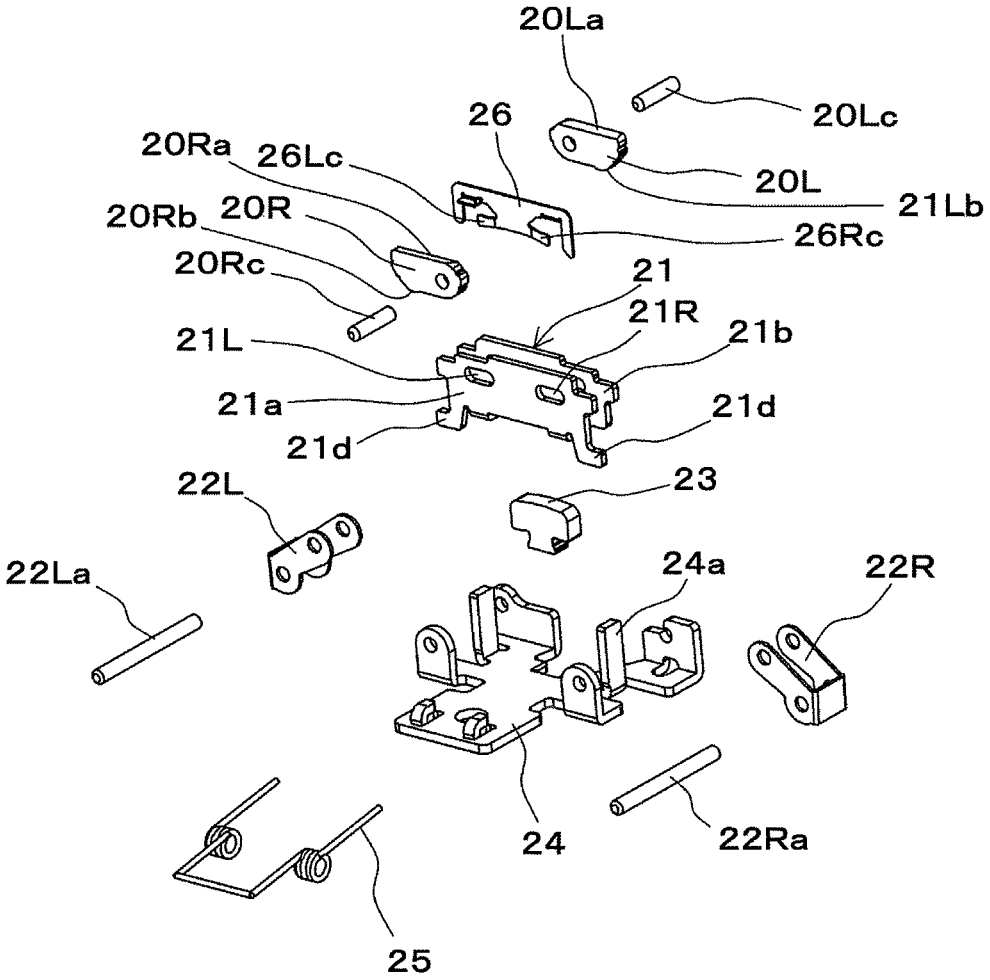
FIG. 13 is an exploded perspective view showing an example of a clincher unit of the exemplary embodiment.

FIG. 12 is an exploded perspective view showing an example of the lower handle unit of the exemplary embodiment and FIG. 13 is an exploded perspective view showing an example of a clincher unit of the exemplary embodiment. The lower handle unit 11*a* has a clincher unit 2A that bends the legs 10Lb of the staple 10L or the legs 10Sb of the staple 10S having penetrated the sheets and a slider 3 that performs lock and lock release at a standby position of the clincher unit 2A. Also, the lower handle unit 11*a* has a lower handle frame 4 to which the clincher unit 2A and the slider 3 are attached.

Figure 14:
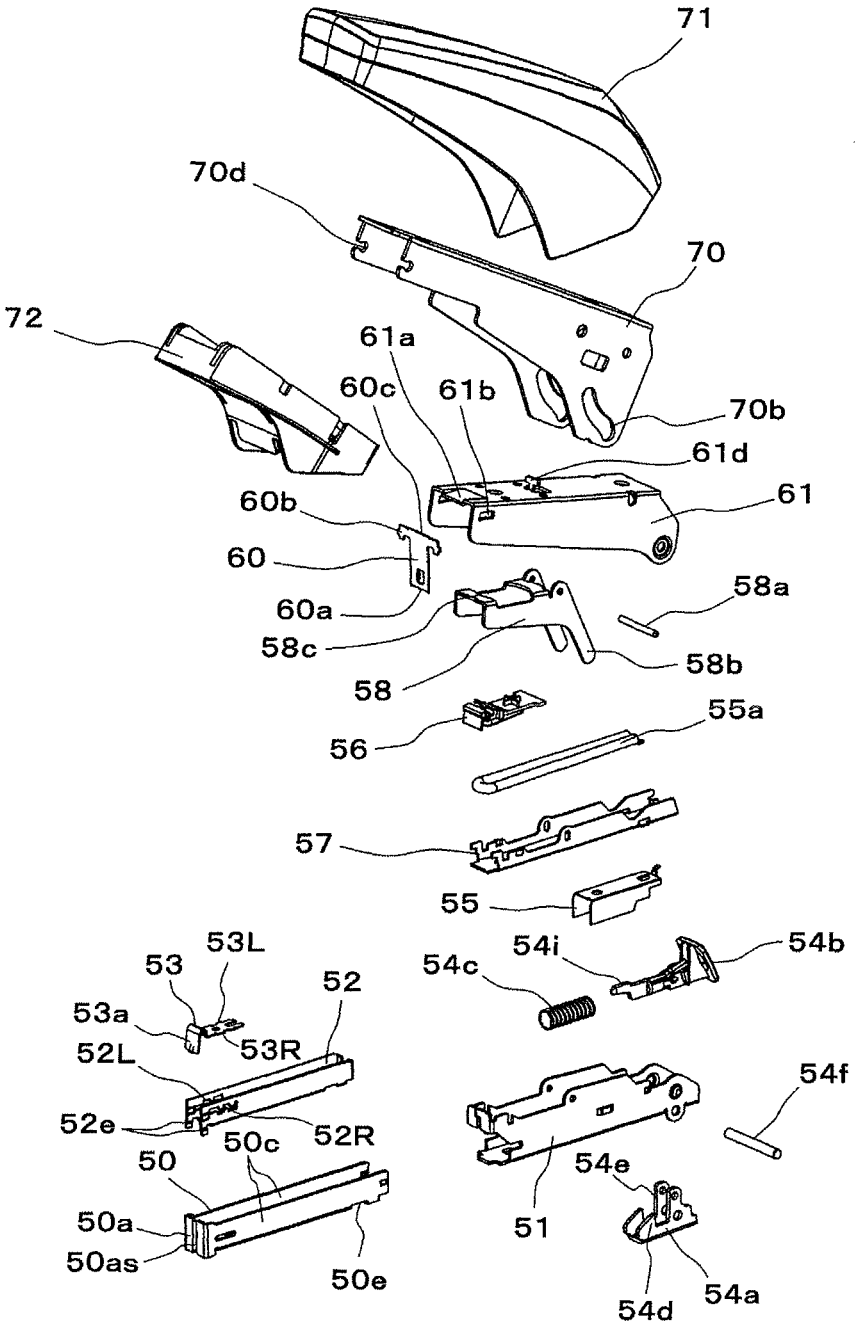
FIG. 14 is an exploded perspective view showing an example of an upper handle unit of the exemplary embodiment.

FIG. 14 is an exploded perspective view showing an example of the upper handle unit of the exemplary embodiment. The upper handle unit 11*b* has a magazine unit 5 in which both the staples 10L having long legs and the staples 10S having short legs can be loaded and any one type of the staples 10L and the staples 10S is selectively loaded.

Also, the upper handle unit 11*b* has a driver unit 6 that drives the staples 10L or staples 10S accommodated in the magazine unit 5. Also, the upper handle unit 11*b* has a handle unit 7 that applies a force of driving the staples 10L or staples 10S accommodated in the magazine unit 5 to the driver unit 6.

<Example of Configuration of Clincher Unit>

Figure 15:
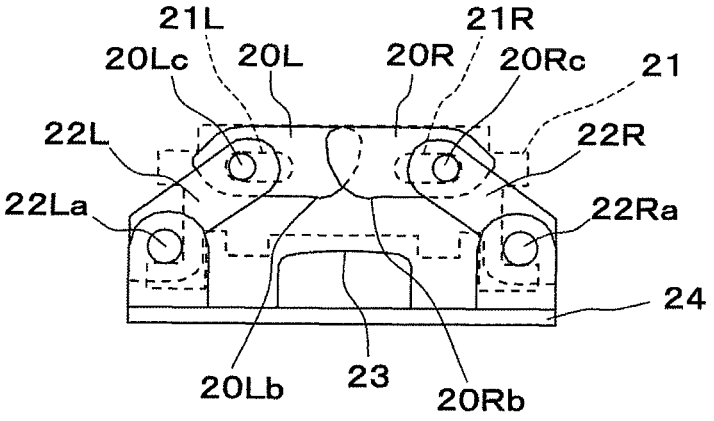
FIG. 15 is a front view showing an example of a clincher unit.
Figure 16:
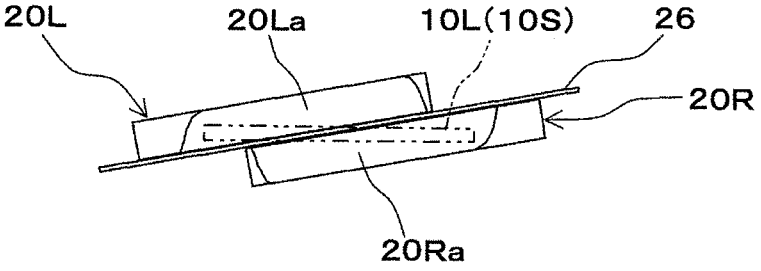
FIG. 16 is a plan view of main parts showing an example of the clincher unit.
Figure 17:
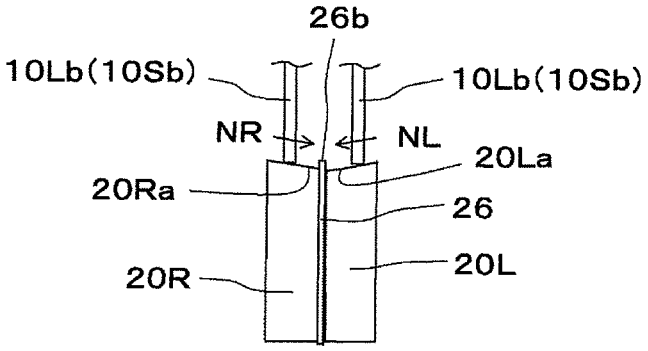
FIG. 17 is a side view of main parts showing an example of the clincher unit.
Figure 18:
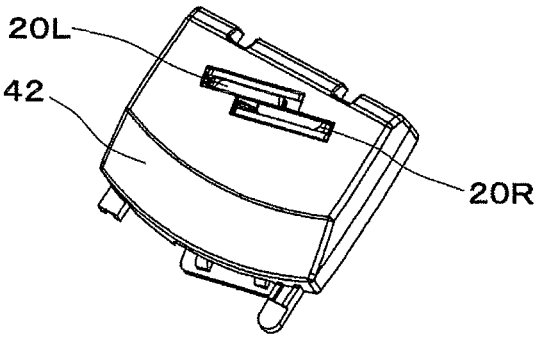
FIG. 18 is an outward perspective view showing an example of the clincher unit.

FIG. 15 is a front view showing an example of the clincher unit, FIG. 16 is a plan view of main parts showing an example of the clincher unit, FIG. 17 is a side view of main parts showing an example of the clincher unit and FIG. 18 is an outward perspective view showing an example of the clincher unit.

Figure 19:
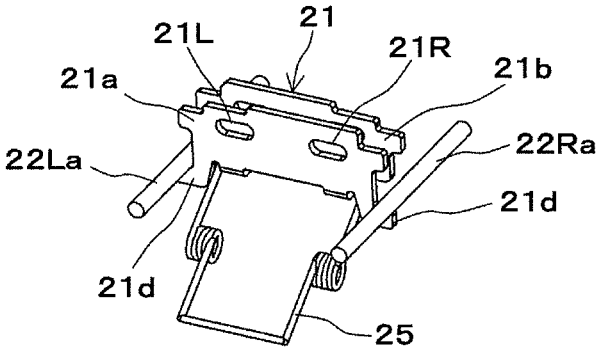
FIG. 19 is a perspective view of main parts showing a configuration of holding the clincher unit at a standby position.
Figure 20:
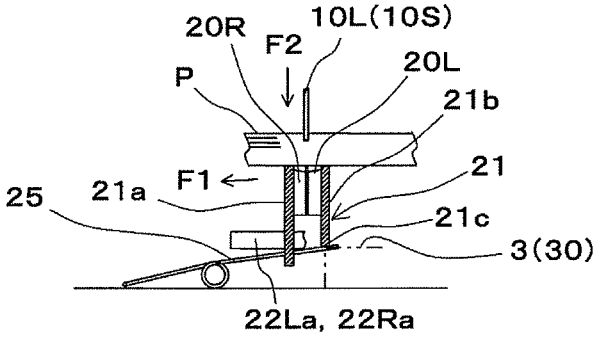
FIG. 20 is a side view of main parts showing a configuration of holding the clincher unit at the standby position.
Figure 21A:
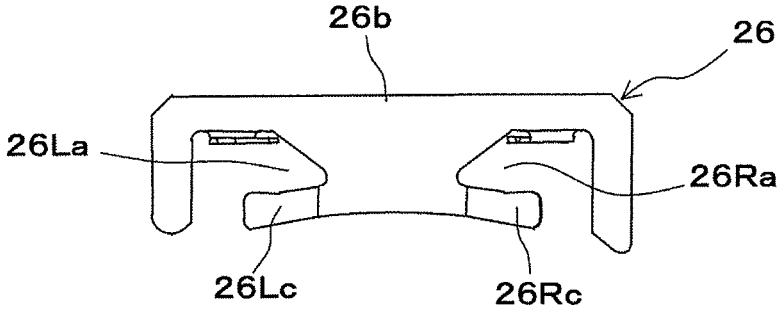
FIGS. 21(*a*) to 21(*c*) are configuration views showing an example of a partition plate for holding clinchers.
Figure 21B:
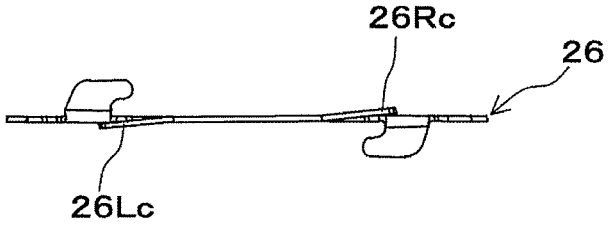
Figure 21C:
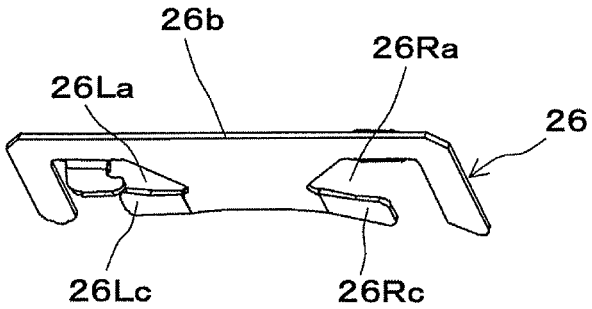

Also, FIG. 19 is a perspective view of main parts showing a configuration of holding the clincher unit at a standby position, and FIG. 20 is a side view of main parts showing a configuration of holding the clincher unit at the standby position. Also, FIG. 21 is a configuration view showing an example of a partition plate for holding a clincher.

In the below, a configuration of the clincher unit 2A is described with reference to the respective drawings. The clincher unit 2A is an example of the leg bending means and has a pair of clinchers 20L, 20R that bends the legs 10Lb of the staple 10L or the legs 10Sb of the staple 10S having penetrated the sheets and a clincher holder 21 that supports the clincher 20L and the clincher 20R.

The clincher unit 2A has a configuration of bending the legs 10*b* of the staple 10 or the legs 10Sb of the staple 10S by rotating operations of the clincher 20L and the clincher 20R. The clincher unit 2A moves the clincher 20L and the clincher 20R in an approaching direction thereof, as movement of starting to bend the legs 10Lb or legs 10Sb, thereby applying a force of bending the legs 10Lb or legs 10Sb inward.

To this end, the clincher unit 2A has a pair of clincher links 22L, 22R serving as a clincher driving mechanism that guides a movement of the clincher holder 21 in an ascent and descent direction and guides a rotation and a movement of the clinchers 20L, 20R in separating/contacting directions. Also, the clincher unit 2A has a clincher support part 23 that pushes up the clinchers 20L, 20R by an ascent and descent operation of the clincher holder 21.

Also, the clincher unit 2A has a clincher frame 24 that rotatably supports the clincher links 22L, 22R and guides the movement of the clincher holder 21 having the clinchers 20L, 20R attached thereto in the ascent and descent direction. Also, the clincher unit 2A has a return spring 25 that pushes up the clincher holder 21 and a partition plate 26 that partitions the clincher 20L and the clincher 20R therebetween and holds directions of the clinchers 20L, 20R.

As shown in FIG. 16, the clincher unit 2A is arranged so that positions of the clincher 20L and the clincher 20R are offset in a left-right direction along the staple crown 10La of the staple 10L and the staple crown 10Sa of the staple 10S and in a front-rear direction orthogonal to the staple crowns 10La, 10Sa.

The clincher 20L is disposed to face one leg 10Lb of the staple 10L and one leg 10Sb of the staple 10S. The clincher 20L is formed on an upper surface facing the legs 10Lb, 10Sb with a clincher surface 20La that is inclined in a downward direction toward the clincher 20R arranged to be offset in the front-rear direction, as shown in FIG. 17. Also, the clincher 20L is formed with a pressing surface 20Lb, which is pressed by the clincher support part 23, on a lower surface of one end portion facing the clincher support part 23.

The clincher 20L is configured so that the other end portion thereof is rotatably supported to an upper end side of the clincher link 22L by a shaft 20Lc and is movably supported to the clincher holder 21 in rotating and horizontal directions.

The clincher 20R is disposed to face the other leg 10Lb of the staple 10L and the other leg 10Sb of the staple 10S. The clincher 20R is formed on an upper surface facing the legs 10Lb, 10Sb with a clincher surface 20Ra that is inclined in a downward direction toward the clincher 20L arranged to be offset in the front-rear direction, as shown in FIG. 17. Also, the clincher 20R is formed with a pressing surface 20Rb, which is pressed by the clincher support part 23, on a lower surface of one end portion facing the clincher support part 23.

The clincher 20R is configured so that the other end portion thereof is rotatably supported to an upper end side of the clincher link 22R by a shaft 20Rc and is movably supported to the clincher holder 21 in rotating and horizontal directions.

The clincher holder 21 has a front holder 21*a* and a rear holder 21*b* along the front-rear direction orthogonal to the staple crown 10La of the staple 10L and the staple crown 10Sa of the staple 10S. In the clincher holder 21, the front holder 21*a* and the rear holder 21*b* face each other so that a space into which the clincher 20L and the clincher 20R overlapping each other with the partition plate 26 being interposed therebetween are inserted is formed. In this example, the clincher holder 21 has the front holder 21*a* and the rear holder 21*b* that are formed by bending a plate material.

In the clincher holder 21, the front holder 21*a* and the rear holder 21*b* are formed with a guide hole 21L into which the shaft 20Lc of the clincher 20L is inserted and a guide hole 21R into which the shaft 20Rc of the clincher 20R is inserted. The guide hole 21L and the guide hole 21R are long holes that extend in the horizontal direction along the separating/contacting directions of the clincher 20L and the clincher 20R.

The clincher holder 21 rotatably supports the clincher 20L and movably supports the same in the separating/contacting directions with respect to the clincher 20R by inserting the shaft 20Lc of the clincher 20L into the guide hole 21L. Also, the clincher holder 21 rotatably supports the clincher 20R and movably supports the same in the separating/contacting directions with respect to the clincher 20L by inserting the shaft 20Rc of the clincher 20R into the guide hole 21R.

In the clincher holder 21, the rear holder 21*b* that is positioned at the rear of the clinchers 20L, 20R and on which the slider 3 abuts is formed with bearing parts 21*c* to which the pushing up force of the return spring 25 is applied. The bearing parts 21*c* are formed on lower surfaces of left and right sides of the rear holder 21*b* and are pushed up from the lower by the abutting return spring 25.

Also, in the clincher holder 21, the front holder 21*a* that is positioned at the front of the clinchers 20L, 20R is formed with height restraint parts 21*d* restraining the movement by the pushing up of the return spring 25. The height restraint parts 21*d* are formed to protrude laterally from left and right sides of the front holder 21*a*.

The clincher link 22L is rotatably supported, at a lower end side thereof, to the clincher frame 24 by the shaft 22La, and the clincher 20L is rotatably supported to an upper end side thereof by the shaft 20Lc. The clincher 20L and the clincher link 22L are configured so that the shaft 20Lc is movably inserted into the guide hole 21L of the clincher holder 21 along the long hole shape of the guide hole 21L.

The clincher link 22R is rotatably supported, at a lower end side thereof, to the clincher frame 24 by the shaft 22Ra, and the clincher 20R is rotatably supported to an upper end side thereof by the shaft 20Rc. The clincher 20R and the clincher link 22R are configured so that the shaft 20Rc is movably inserted into the guide hole 21R of the clincher holder 21 along the long hole shape of the guide hole 21R.

Thereby, the clincher link 22L rotatably supports the clincher 20L and moves the clincher 20L in the separating/contacting directions with respect to the clincher 20R by the ascent and descent operation of the clincher holder 21. The clincher link 22R rotatably supports the clincher 20R and moves the clincher 20R in the separating/contacting directions with respect to the clincher 20L by the ascent and descent operation of the clincher holder 21.

The clincher support part 23 is introduced between the front holder 21*a* and the rear holder 21*b* by the descent operation of the clincher holder 21 and is then attached to the clincher frame 24 at a position of pressing the clincher 20L and the clincher 20R.

The clincher frame 24 is configured so that the clincher link 22L is rotatably supported at one side thereof in the left-right direction by the shaft 22La and the clincher link 22R is rotatably supported at the other side thereof in the left-right direction by the shaft 22Ra.

The clincher frame 24 has a clincher guide 24*a* that guides the ascent and descent operation of the clincher holder 21. The clincher guide 24*a* has a width corresponding to the space between the front holder 21*a* and the rear holder 21*b* of the clincher holder 21 and is provided between the front holder 21*a* and the rear holder 21*b*. Thereby, while the forward and rearward inclination of the clincher holder 21 is suppressed, the ascent and descent operation of the clincher holder 21 is guided.

The clincher link 22L and the clincher link 22R are supported at the upper end sides thereof to the clincher holder 21 at an interval narrower than the lower end sides thereof supported to the clincher frame 24. The clincher link 22L is rotated about the shaft 22La serving as a fulcrum by the ascent and descent operation of the clincher holder 21 and the clincher link 22R is rotated about the shaft 22Ra serving as a fulcrum by the ascent and descent operation of the clincher holder 21.

By the ascent and descent operation of the clincher holder 21, the clincher link 22L and the clincher link 22R are kept constant while the interval at the lower end sides between the shaft 22La and the shaft 22Ra is not changed. Compared to this, the interval at the upper end sides between the shaft 22Lc and the shaft 22Rc is changed.

That is, the clincher link 22L and the clincher link 22R are configured so that the interval at the upper end sides is narrower than that at the lower end sides. Thereby, the clincher link 22L is rotated about the shaft 22La serving as a fulcrum by the descent operation of the clincher holder 21 so that the upper end side thereof comes close to the clincher link 22R. Also, the clincher link 22R is rotated about the shaft 22Ra serving as a fulcrum by the descent operation of the clincher holder 21 so that the upper end side thereof comes close to the clincher link 22L.

Also, the clincher link 22L is rotated about the shaft 22La serving as a fulcrum by the ascent operation of the clincher holder 21 so that the upper end side becomes more distant from the clincher link 22R. Also, the clincher link 22R is rotated about the shaft 22Ra serving as a fulcrum by the ascent operation of the clincher holder 21 so that the upper end side becomes more distant from the clincher link 22L.

By the descent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is narrowed. Hence, by the descent operation of the clincher holder 21, the clincher 20L and the clincher 20R are moved in the approaching direction each other.

Also, by the ascent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is widened. Hence, by the ascent operation of the clincher holder 21, the clincher 20L and the clincher 20R are moved in the getting away direction each other.

In the below, a configuration of holding the clincher unit at the standby position is described with reference to the respective drawings. The return spring 25 consists of a torsion coil spring, in this example, and a front end side that is one end portion is fixed to the clincher frame 24. Also, as shown in FIG. 20, the return spring 25 is configured so that one end portion at the rear end side abuts on one bearing 21*c* of the rear holder 21*b* of the clincher holder 21 and the other end portion at the rear end side thereof abuts on the other bearing 21*c* of the rear holder 21*b*.

As shown in FIG. 19, the clincher holder 21 is configured so that the one height restraint part 21*d* of the front holder 21*a* abuts on the shaft 22La supporting the clincher link 22L to the clincher frame 24. Also, the clincher holder 21 is configured so that the other height restraint part 21*d* of the front holder 21*a* abuts on the shaft 22Ra supporting the clincher link 22R to the clincher frame 24.

Thereby, in the clincher holder 21, the substantially uniform force is applied to the bearing parts 21*c* at the left and right sides by the return spring 25, so that the rear holder 21*b* is pushed up. Also, the height restraint parts 21*d* at the left and right sides restrain the front holder 21*a* from being pushed up and moved due to the return spring 25.

In the clincher holder 21, the rear holder 21*b* positioned at the rear of the clinchers 20L, 20R is pushed up by the return spring 25 and the front holder 21*a* positioned at the front of the clinchers 20L, 20R is restrained from moving upward by the shafts 22La, 22Ra.

Thereby, the clincher holder 21 having the clinchers 20L, 20R attached thereto keeps a state thereof where it is inclined forward at the standby state where the clincher holder is pushed up by the return spring 25. Meanwhile, in the exemplary embodiment, the return spring 25 is disposed at the front of the clincher unit 2A. However, a configuration is also possible in which the return spring is disposed at the rear of the clincher unit 2A and the force is applied to the rear holder 21*b*.

In the below, a configuration of holding the clinchers 20L, 20R at the standby state is described with reference to the respective drawings. The partition plate 26 has a shaft bearing part 26La into which the shaft 20Lc of the clincher 20L is inserted and a shaft bearing part 26Ra into which the shaft 20Rc of the clincher 20R is inserted.

The partition plate 26 is inserted between the clincher 20L and the clincher 20R and is supported to the shaft 20Lc and the shaft 20Rc. The shaft bearing parts 26La, 26Ra are configured by long hole shapes corresponding to the movement of the shafts 20Lc, 2012*c* accompanied by the movement of the clinchers 20L, 20R in the separating/contacting direction.

The partition plate 26 has a partition part 26*b* protruding upward from the clincher surface 20La of the clincher 20L and the clincher surface 20Ra of the clincher 20R at the standby state. Also, the partition plate 26 has a spring part 26Lc bent toward the clincher 20L and a spring part 26Rc bent toward the clincher 20R.

A side surface of the clincher 20L is pressed by the spring part 26Lc of the partition plate 26 and a side surface of the clincher 20R is pressed by the spring part 26Rc of the partition plate 26, so that the clincher 20L and the clincher 20R are held with respect to the directions at the standby state.

<Example of Configuration of Lower Handle Unit>

Subsequently, a configuration of the lower handle unit 11*a* is described with reference to the respective drawings. In the lower handle unit 11*a*, the lower handle fame 4 consists of a plate and the like. In the lower handle frame 4, the clincher frame 24 configuring the clincher unit 2A is attached to the front. Also, in the lower handle frame 4, the slider 3 is attached to the rear of the clincher unit 2A. Also, the lower handle frame 4 is formed with an upper handle attachment part 40 to which the upper handle unit 11*b* is attached.

The slider 3 is formed with an engaging part 30 at the front side facing the clincher unit 2A and with a link bearing part 31 at the rear side. The slider 3 is configured to slide in the front-rear direction, is attached to the lower handle frame 4 and is pressed by a spring (not shown), so that it is moved forward up to a position at which the rear holder 21*b* of the clincher holder 21 configuring the clincher unit 2A is put on the engaging part 30. Also, as the slider 3 is moved rearward, the engaging part 30 is separated from the rear holder 21*b* of the clincher holder 21.

In the lower handle unit 11*a*, a lower handle cover 41 having a shape covering the lower handle frame 4 is attached to the lower handle frame 4 to which the clincher unit 2A and the slider 3 are attached.

Also, in the lower handle unit 11*a*, a clincher cover 42 covering the clincher unit 2A is attached to the lower handle cover 41. The clincher cover 42 has an opening through which the clincher 20L and the clincher 20R configuring the clincher unit 2A, the partition plate 26 interposed between the clinchers 20L, 20R and the clincher holder 21 having the clinchers 20L, 20R attached thereto are exposed. The clincher cover 42 is configured to ascend and descend as the clincher holder 21 ascends and descends and is attached to the lower handle cover 41.

Also, in the lower handle unit 11*a*, a sheet guide 43 that restrains a position of a sheet is attached to the lower handle cover 41. The sheet guide 43 is configured to slide in the front-rear direction and is attached to the lower handle cover 41. The sheet collides with the sheet guide 43, so that a position to be bound by the staples 10L, 10S is adjusted.

<Example of Configuration of Magazine Unit>

In the below, a configuration of the magazine unit 5 is described with reference to the respective drawings. The magazine unit 5 is an example of the accommodation means and has a magazine 50 in which both the staples 10L having long legs and the staples 10S having short legs can be loaded and any one type of the staples 10L and the staples 10S is selectively loaded.

Also, the magazine unit 5 has a magazine guide 51 that accommodates the magazine to be withdrawn so as to load the staples 10L or staples 10S. The magazine guide 51 has opened front, upper and rear surfaces, so that a space in which the magazine 50 is accommodated to be withdrawn from the front surface is formed.

The magazine unit 5 has a staple guide 52 that guides the loading of the staples 10L or staples 10S and the moving of the loaded staples 10L or staples 10S and applies a shear force for separating the staples 10L or staples 10S one by one. Also, the magazine unit 5 has a staple holder 53 that holds a shape of the one separated staple 10L or staple 10S to be driven by the driver unit 6.

Also, the magazine unit 5 has a lock mechanism 54 that locks and unlocks the magazine 50 that is accommodated to be withdrawn with regard to the magazine guide 51. Also, the magazine unit 5 has a pusher 55 that presses forward the staples 10L or staples 10S loaded in the magazine 50, a pusher spring 55*a* that presses the pusher 55 and a spring guide 56 that guides the pusher spring 55*a*.

Also, the magazine unit 5 has a guide cover 57 that guides the movement of the magazine 50 in the accommodation and withdrawal directions and also guides the staple 10L or staple 10S pushed by the pusher 55 together with the staple guide 52.

The pusher 55 and the pusher spring 55*a* are examples of the staple pressing means. The pusher 55 is attached so that it can be moved in the front-rear direction along the staple guide 52 at the inside of the magazine 50 accommodated in the magazine guide 51. The guide cover 57 is attached on an upper surface of the magazine guide 51 and guides the movement of the magazine 50 in the accommodation and withdrawal directions together with the magazine guide 51. Also, the guide cover guides the staples 10L or staples 10S pushed by the pusher 55 together with the staple guide 52.

The pusher spring 55*a* presses the pusher 55 toward a magazine front wall 50*a* of the magazine 50. The pusher spring 55*a* is accommodated in the guide cover 57 and is connected to the pusher 55 in a U-shaped arrangement by a spring guide 56 that is attached to a front end side of the magazine guide 51, in this example.

<Example of Configuration of Magazine>

Figure 22:
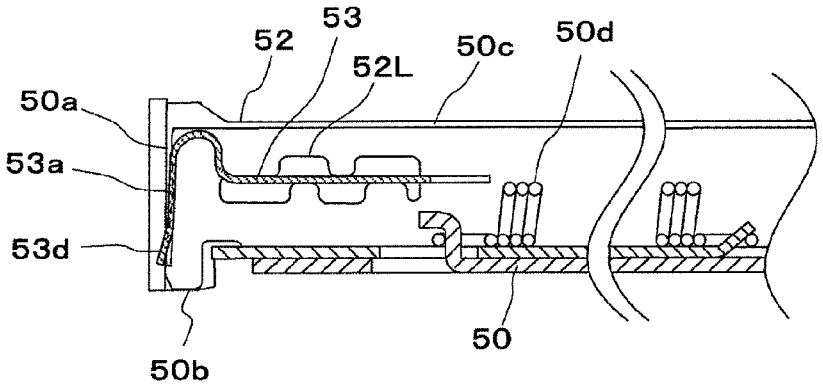
FIG. 22 is a side sectional view of main parts showing an example of a magazine.
Figure 23:
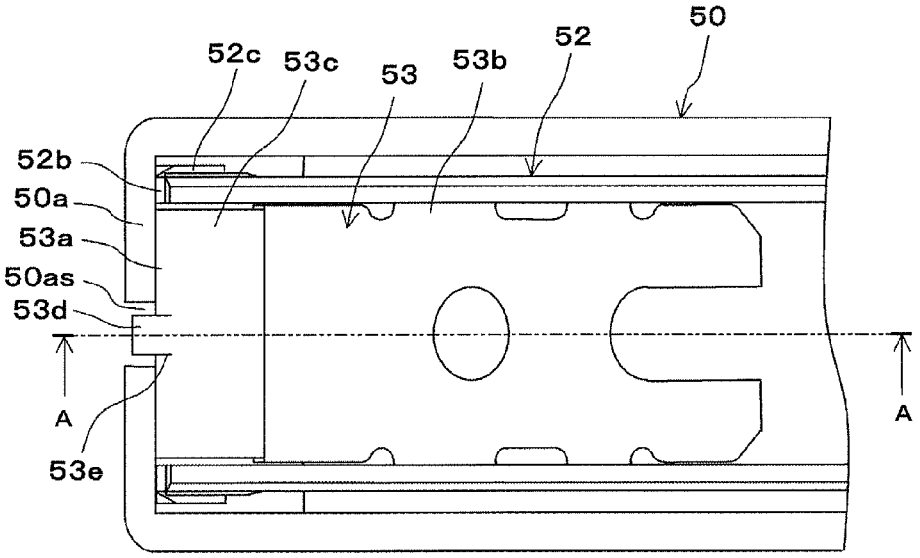
FIG. 23 is a plan view of main parts showing an example of the magazine.

FIG. 22 is a side sectional view of main parts showing an example of the magazine configuring the magazine unit of the exemplary embodiment and FIG. 23 is a plan view of main parts showing an example of the magazine configuring the magazine unit of the exemplary embodiment. In the below, a configuration of the magazine 50 is described with reference to the respective drawings. Here, FIG. 22 is a sectional view taken along a line A-A of FIG. 23.

In this example, the magazine 50 has a predetermined shape by die-cutting and bending a plate-shaped metal material with a press and the like, can load therein any type of the staples 10L and the staples 10S and has a space having an opened upper surface.

The magazine 50 is formed with an opening 50*b* through which one separated staple 10L or staple 10S passes at a lower part of the magazine front wall 50*a* to which the loaded staples 10L or staples 10S are pressed by the pusher 55 and the staple guide 52. Also, the magazine 50 is configured so that an inner size of the opposing magazine sidewalls 50*c* is slightly larger than outer sizes of the staple crown 10La of the staple 10L and the staple crown 10Sa of the staple 10S.

In the magazine 50, the magazine front walls 50*a* of the magazine 50 are configured by bending inward leading end sides of side plates configuring the magazine sidewalls 50*c*. The magazine front wall 50*a* is divided in the vicinity of the central portion in a width direction, so that the magazine front wall 50*a* is formed with a recess portion 50*a* s extending along the driving direction of the staple 10L and the staple 10S.

<Example of Configuration of Staple Guide>

Figure 24A:
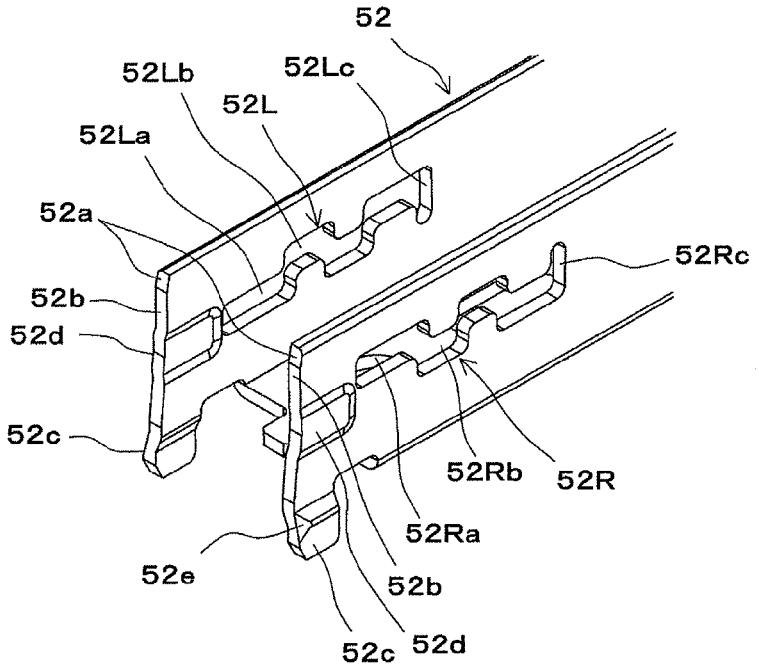
FIGS. 24(*a*) and 24(*b*) are perspective views of main parts showing an example of a staple guide.
Figure 24B:
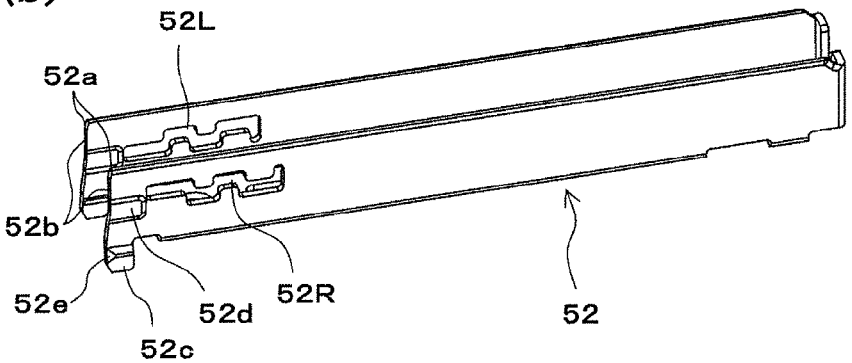
Figure 25:
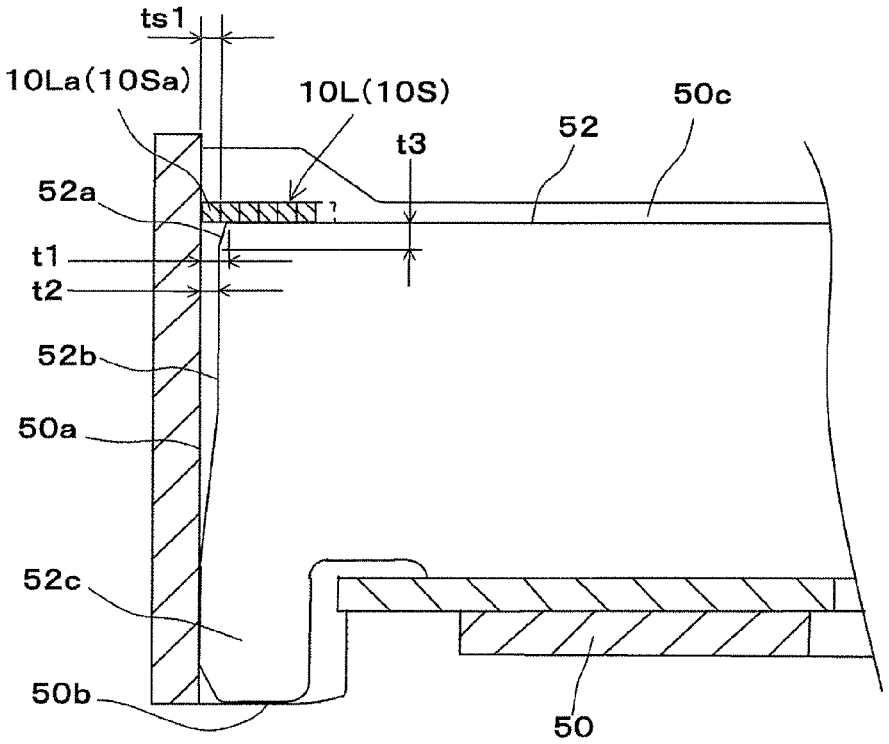
FIG. 25 is a side sectional view of main parts showing a state where the staple guide is attached to the magazine.

FIG. 24 is a perspective view of main parts showing an example of the staple guide and FIG. 25 is a side sectional view of main parts showing a state where the staple guide is attached to the magazine. In the below, a configuration of the staple guide 52 is described with reference to the respective drawings.

The staple guide 52 is an example of the staple guide means and is attached to the inner space of the magazine 50. A coil spring 50*d* is attached between the magazine 50 and the staple guide 52, so that the staple guide 52 is pressed toward the magazine front wall 50*a*.

The staple guide 52 is configured to be slightly narrower than the inner sizes of the staple crown 10La of the staple 10L and the staple crown 10Sa of the staple 10S. A space into which the legs 10Lb of the staple 10L and the legs 10Sb of the staple 10S can be inserted is formed between the magazine sidewalls 50*c* and the staple guide 52.

As shown in FIG. 23, the staple guide 52 has shear guide parts 52*a* that apply a shear force for separating the staples 10L having long legs or the staples 10S having short legs one by one, and pressing guide parts 52*b* that press the one separated staple 10L or staple 10S to the magazine front wall 50*a*.

Also, the staple guide 52 has first width guide parts 52*c* that guide the legs 10Lb of the staple 10L having long legs and the legs 10Sb of the staple 10S having short legs in the width direction and second width guide parts 52*d* that mainly guide the legs 10Sb of the staple 10S having short legs.

The shear guide part 52*a* is an example of the separation guide means and is formed by providing an inclined surface an interval t1 wider than a line width ts1 of one staple 10L and staple 10S and narrower than a line width of two staples 10L, 10S between a front end upper surface of the staple guide 52 and the magazine front wall 50*a*.

When the staples 10L or staples 10S are loaded into the magazine 50, the staple 10L or staple 10S of the front end is applied with the pressing force by the pusher 55 and is thus pressed to the magazine front wall 50*a*.

When the staples 10L or staples 10S are loaded into the magazine 50, the staple crown 10La or staple crown 10Sa of the staple 10L or staple 10S, which follows the staple 10L or staple 10S of the front end that is driven by the driver unit 6, is put on the upper surface of the staple guide 52.

Thereby, a position of the one staple 10L or staple 10S, which is just next to the staple 10L or staple 10S of the front end that is driven by the driver unit 6, is restrained in the driving direction.

When any one type of the staples 10L having long legs 10Lb and the staples 10S having short legs 10S is loaded in the magazine 50, the staple crowns 10La or staple crowns 10Sa are put on the upper surface of the staple guide 52. Therefore, the shear force for separating the staples 10L or staples 10S one by one is applied.

The pressing guide part 52*b* is configured by a front end surface of the staple guide 52 that is connected to a lower end of the shear guide part 52*a*, and a predetermined interval t2 is formed between the pressing guide part 52*b* and the magazine front wall 50*a* at a state where a front end of the first width guide part 52*c* abuts on the magazine front wall 50*a*.

The interval t2 between the pressing guide part 52*b* and the magazine front wall 50*a* is configured to be slightly narrower than the line width of one staple 10L or staple 10S. By retreating the staple guide 62, the one separated staple 10L or staple 10S passes between the pressing guide part 52*b* and the magazine front wall 50*a*.

The one separated staple 10L or staple 10S passing between the pressing guide part 52*b* and the magazine front wall 50*a* is pressed to the magazine front wall 50*a* by the pressing guide part 52*b* as the staple guide 52 is urged toward the magazine front wall 50*a* by the coil spring 50*d*.

Here, regarding a case where the staple 10L having the long legs 10*a* as shown in FIG. 11(*a*) is used, a height t3 of the shear guide part 52*a* is set so that the staple crown 10La is guided by the pressing guide part 52*b* before the leading ends of the legs 10*b* reach the sheet.

The first width guide parts 52*c* are provided at lower ends of both left and right sides of the front end side of the staple guide 52. The first width guide part 52*c* has a size that is slightly smaller than the line width of the one staple 10L or staple 10S, and protrudes forward from a lower end of the pressing guide part 52*b*, so that the pressing guide part 52*b* facing the magazine front wall 50*a* at the predetermined interval t2 therebetween is formed above the first width guide part 52*c*.

The first width guide parts 52*c* protrude leftward and rightward from the staple guide 52 and are configured so that the outer size of the pair of first width guide parts 52*c* is the substantially same as or slightly wider than the inner size of the staple crown 10La, 10Sa of the staple 10LS, 10S.

Thereby, when the staples 10L or staples 10S are loaded into the magazine 50 and are separated and driven one by one, the inner sides of the legs 10Lb of the staple 10L or legs 10Sb of the staple 10S abut on the second width guide parts 52*d*.

The second width guide parts 52*d* are provided at central portions of both left and right sides of the front end side of the staple guide 52 above the first width guide parts 52*c* in correspondence to the legs 10Sb of the staple 10S having short legs.

The second width guide parts 52*d* protrude leftward and rightward from the staple guide 52 and are configured so that the outer size of the pair of second width guide parts 52*d* is the substantially same as the inner size of the staple crown 10La, 10Sa of the staple 10L, 10S.

Thereby, when the staples 10L or staples 10S are loaded into the magazine 50, the inner sides of the legs 10Lb or legs 10Sb abut on the second width guide parts 52*d* at a state where the staple guide 52 is advanced up to a position at which the first width guide parts 52*c* abut on the magazine front wall 50*a*.

The magazine unit 5 has leg guide parts 52*e* that guide mainly the legs 10Sb of the one separated staple 10S having short legs toward the magazine front wall 50*a* as the staple 10S is driven by the driver unit 6.

The leg guide part 52 is an example of the leg guide means and is provided in the vicinity of the first width guide part 52*c* of the staple 52, in this example. The leg guide part 52*e* has an inclined surface that is provided on the inclined surface, which is formed between the first width guide part 52*c* protruding leftward and rightward from the staple guide 52 and the staple guide 52, and is inclined in the direction along which the outer sizes of the pair of left and right first width guide parts 52*c* are gradually narrowed toward the front end side.

Thereby, when the staples 10S having short legs are loaded in the magazine 50, even though the leading ends of the legs 10Sb before landing on the sheet flow rearward as the one separated staple 10S is driven, the legs 10Sb are guided toward the magazine front wall 50*a* by the inclined surfaces of the leg guide parts 52*e*.

<Example of Configuration of Staple Holder>

Figure 26:
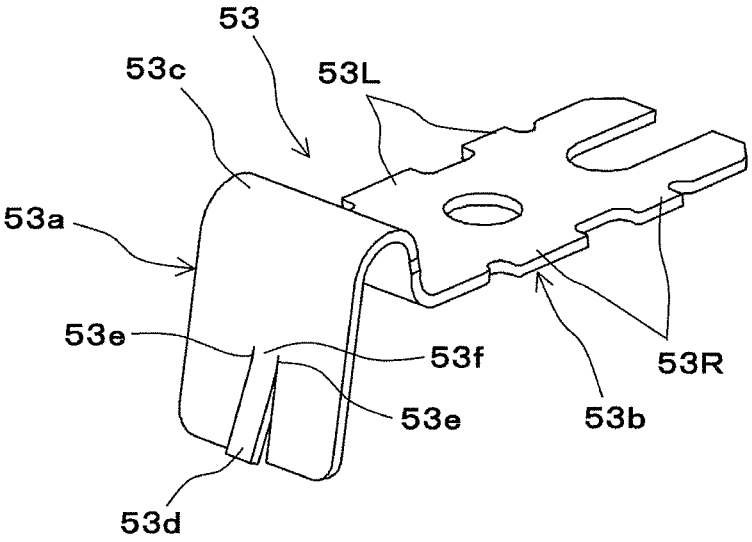
FIG. 26 is a perspective view showing an example of a staple holder.
Figure 27:
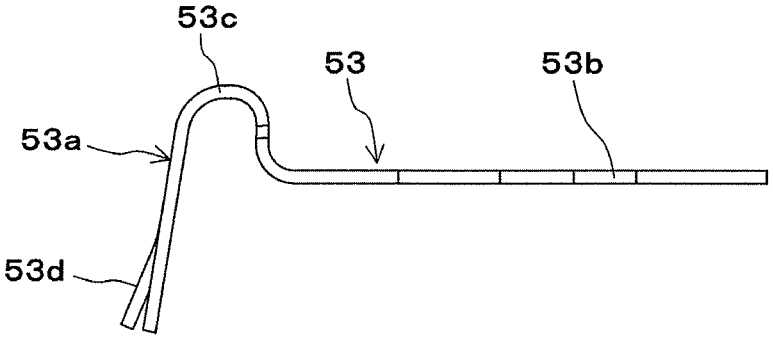
FIG. 27 is a side view showing an example of the staple holder.
Figure 28:
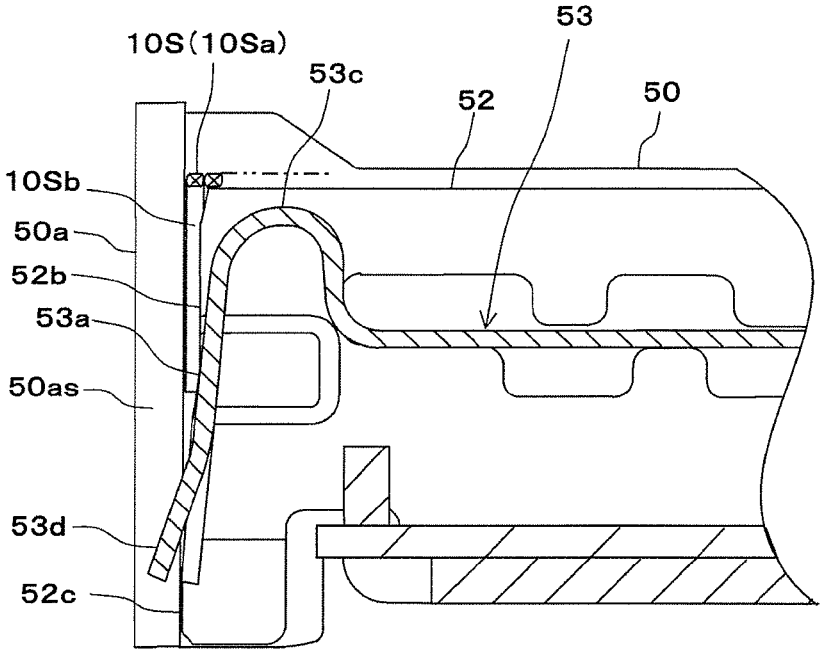
FIG. 28 is a side sectional view of main parts showing a state where the staple holder is attached to the magazine.

FIG. 26 is a perspective view showing an example of the staple holder, FIG. 27 is a side view showing an example of the staple holder and FIG. 28 is a side sectional view of main parts showing a state where the staple holder is attached to the magazine. In the below, a configuration of the staple holder 53 is described with reference to the respective drawings.

The staple holder 53 is an example of the staple shape holding means and has a staple crown guide part 53*a* that keeps a shape of the staple crown 10La or staple crown 10Sa of the one separated staple 10L or staple 10S, depending on the type of the staples loaded in the magazine 50. Also, the staple holder 53 has an attachment part 53*b* that is attached to a predetermined constitutional element of the magazine 50, for example, the staple guide 52, in this example.

The staple holder 53 is configured so that as the attachment part 53*b* is attached to a front end portion of the staple guide 52, the staple crown guide part 53*a* is arranged between the pair of left and right pressing guide parts 52*b* and the staple crown guide part 53*a* faces the magazine front wall 50*a* of the magazine 50.

The staple holder 53 is made of an elastic material, in this example, a metal plate material having elasticity and has a spring part 53*c* that displaces the staple crown guide part 53*a* mainly in the front-rear direction. In the staple holder 53, an upper end side of the staple crown guide part 53*a*, which becomes an upper side when the stapler 1A is configured as a desktop type, is bent into a reverse U shape, so that the spring part 53*c* is configured.

In the staple holder 53, the staple crown guide part 53*a* extends from the spring part 53*c* in the driving direction of the staple 10L and the staple 10S and the staple crown guide part 53*a* is displaced in the front-rear direction, which is the separating/contacting direction with respect to the magazine front wall 50*a*, by the elastic deformation of the spring part 53*c*.

The staple holder 53 has a protrusion 53*d* that supports the vicinity of the central portion of the staple crown 10La of the staple 10L in the longitudinal direction thereof or the vicinity of the central portion of the staple crown 10Sa of the staple 10S in the longitudinal direction thereof, from a lower side thereof, as the one separated staple 10L or staple 10S is driven.

The staple holder 53 is provided with the protrusion 53*d* in the vicinity of the central portion of the staple crown guide part 53*a* in the width direction, in correspondence to the recess portion 50*a* s of the magazine front wall 50*a*. The protrusion 53*d* protrudes from the vicinity of the central portion of the staple crown guide part 53*a* along the driving direction of the staple 10L and staple 10S to the front, which is the direction facing the magazine front wall 50*a*, toward a lower end side of the staple crown guide part 53*a*.

In the exemplary embodiment, the protrusion 53*d* is configured by cutting the vicinity of the central portion of the staple crown guide part 53*a* in the width direction from the lower end side of the staple crown guide part 53*a* to thus form a predetermined tongue piece part having a predetermined width narrower than the recess portion 50*a* s of the magazine front wall 50*a*.

The staple holder 53 has connection parts 53*e* that transmit a load, which is applied to the protrusion 53*d*, to the staple crown guide part 53*a*. The connection part 53*e* is configured so that side surfaces of a base end side of the protrusion 53*d* abut on the staple crown guide part 53*a*, and transmits the load that is applied to the protrusion 53*d* to the staple crown guide part 53*a* by a frictional force and the like occurring between the base end side of the protrusion 53*d* and the staple crown guide part 53*a*.

Thereby, in the staple holder 53, the load that is applied to the protrusion 53*d* is transmitted to the staple crown guide part 53*a* by the connection parts 53*e* and the protrusion 53*d* is retreated mainly by the displacement of the staple crown guide part 53*a* due to the elastic deformation of the spring part 53*c*.

As shown in FIG. 28, the staple holder 53 is configured so that the staple crown guide part 53*a* is inclined relative to the magazine front wall 50*a* in the direction along which the lower end side of the staple crown guide part 53*a* protrudes forward relative to the upper end side of the staple crown guide part 53*a*.

The staple holder 53 is configured so that the gap between the staple crown guide part 53*a* and the magazine front wall 50*a* is narrowed along the driving direction of the staple 10L and staple 10S. In this example, at a standby state before and after the staple 10L or staple 10S is driven, the lower end side of the staple crown guide part 53*a* abuts on the magazine front wall 50*a*.

Also, the staple holder 53 is configured so that the protrusion 53*d* is inclined relative to the magazine front wall 50*a* and the staple crown guide part 53*a* in the direction along which the lower end side of the protrusion 53*d* protrudes forward relative to the upper end side of the protrusion 53*d* and the protrusion 53*d* enters the recess portion 50*a* s of the magazine front wall 50*a* at the above standby state.

The staple guide 52 having the staple holder 53 attached thereto is retreated relative to the magazine front wall 50*a* as the staple 10L or staple 10S passes between the pressing guide parts 52*b* and first width guide parts 52*c* and the magazine front wall 50*a*. Thereby, the staple holder 53 that is attached to the staple guide 52 by the attachment part 53*b* is also retreated relative to the magazine front wall 50*a* as the staple guide 52 is retreated.

In the staple holder 53, the inclinations and the like of the staple crown guide part 53*a* and the protrusion 53*d* are set, taking into consideration the moving amount of the staple guide 52 that is retreated as the one separated staple 10L or staple 10S is driven.

That is, regarding the displacement of the staple guide 52, the inclinations and the like of the staple crown guide part 53*a* and the protrusion 53*d* are set so that a gap equal to or larger than the line width of the one staple 10L or staple 10S is not formed between the protrusion 53*d* and the magazine front wall 50*a*.

Thereby, in the magazine 50 having the staple guide 52 and the staple holder 53 attached thereto, the protrusion 53*d* can protrude into the moving path of the staple 10L or staple 10S that is separated and driven one by one.

When the staples 10L having long legs are loaded in the magazine 50, the protrusion 53*d* of the staple holder 53 is mainly pressed by the staple crown 10La of the staple 10L as the one separated staple 10L is driven. Likewise, when the staples 10S having short legs are loaded in the magazine 50, the protrusion 53*d* of the staple holder 53 is mainly pressed by the staple crown 10Sa of the staple 10S as the one separated staple 10S is driven.

In the staple holder 53, when the load is applied to the protrusion 53*d*, the staple crown guide part 53*a* is displaced in the retreating direction mainly by the elastic deformation of the spring part 53*c* and the protrusion 53*d* is retreated by the displacement of the staple crown guide part 53*a*.

Thereby, a gap through which the staple crown 10La of the one separated staple 10L or staple crown 10Sa of the one separated staple 10S passes depending on the type of the staples loaded in the magazine 50 is formed between the protrusion 53*d* and the magazine front wall 50*a*.

Also, as the one separated staple 10L is driven, the vicinity of the central portion of the staple crown 10La of the staple 10L in the longitudinal direction thereof is supported from the lower side thereof, which is an opposite direction to the driving direction of the staple 10L, by the protrusion 53*d* that is displaced in the pushing-up direction by the restoring force of the spring part 53*c*.

Likewise, as the one separated staple 10S is driven, the vicinity of the central portion of the staple crown 10Sa of the staple 10S in the longitudinal direction thereof is supported from the lower side thereof, which is an opposite direction to the driving direction of the staple 10S, by the protrusion 53*d* that is displaced in the pushing-up direction by the restoring force of the spring part 53*c*.

Thereby, when the one separated staple 10L or staple 10S passes between the magazine front wall 50*a* and the staple guide 52, the force of pushing-up the vicinity of the central portion of the staple crown 10La or staple crown 10Sa in the longitudinal direction thereof is applied by the protrusion 53*d*, so that the deformation of the staple crown 10La or staple crown 10Sa is suppressed.

In the staple holder 53, the load that is applied to the protrusion 53*d* is transmitted to the staple crown guide part 53*a* by the connection parts 53*e* and the protrusion 53*d* is retreated by the displacement of the staple crown guide part 53*a* mainly due to the elastic deformation of the spring part 53*c*. Therefore, the displacement of the protrusion 53*d* due to the elastic deformation is suppressed, so that the load to be applied to the protrusion 53*d* is reduced.

Figure 29A:
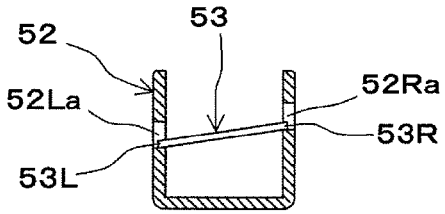
FIGS. 29(*a*) and 29(*b*) are front sectional views showing an attachment example of the staple holder.
Figure 29B:
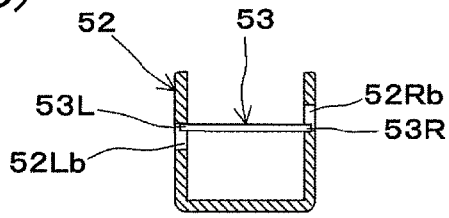
Figure 30A:
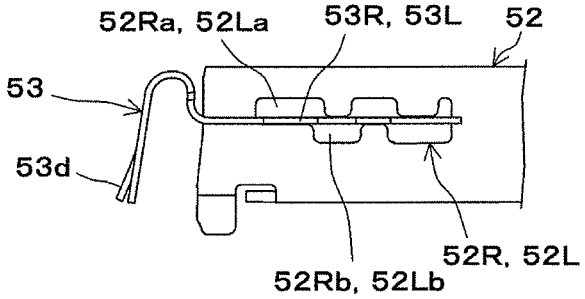
FIGS. 30(*a*) and 30(*b*) are side sectional views showing an attachment example of the staple holder.
Figure 30B:
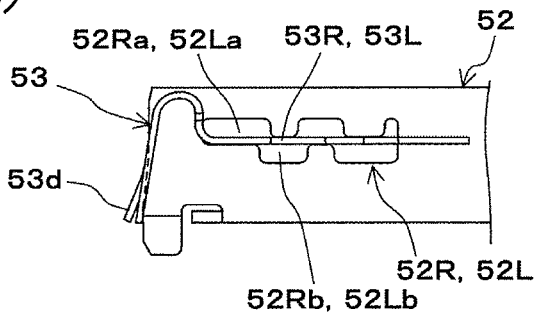

FIG. 29 is front sectional views showing an attachment example of the staple holder and FIG. 30 is side sectional views showing the attachment example of the staple holder. In the below, a configuration of attaching the staple holder 53 to the staple guide 52 is described with reference to the respective drawings. The staple holder 53 has an attachment protrusion part 53L that is formed at one side of the attachment part 53*b* in the width direction and an attachment protrusion part 53R that is formed at the other side.

The staple holder 53 is preferably configured so that two or more are provided regarding the one of the attaching convex part 53L and the attaching convex part 53R and one or more are provided regarding the other. In this example, the attaching convex parts 53L and the attaching convex parts 53R are symmetrically arranged at two locations of the respective left and right sides of the staple holder 53 so that they protrude laterally.

The staple guide 52 is formed with an attaching opening 52L, into which the attaching convex parts 53L of the staple holder 53 are inserted, at one side in the width direction and with an attaching opening 52R, into which the attaching convex parts 53R of the staple holder 53 are inserted, at the other side.

The staple guide 52 and the staple holder 53 are configured so that the attaching convex parts 53L, 53R of the staple holder 53 are inserted into the attaching openings 52L, 52R of the staple guide 52 at predetermined insertion positions and the staple holder 53 is moved to a fixing position to thus fix the staple holder 53 to the staple guide 52.

To this end, the attaching opening 52L has insertion openings 52La into which the attaching convex parts 53L of the staple holder 53 at the insertion position are inserted by an operation of attaching the staple holder 53 to the staple guide 52.

Also, the attaching opening 52L has support convex parts 52Lb that support the attaching convex parts 53L of the staple holder 53 at the fixing position by an operation of moving the staple holder rearward with respect to the staple guide 52. Further, the attaching opening 52L has a position restraint part 52Lc that restrains a position of the staple holder 53 at the fixing position between the magazine front wall 50*a* of the magazine 50 and the staple holder 53.

The attaching opening 52R has insertion openings 52Ra into which the attaching convex parts 53R of the staple holder 53 at the insertion position are inserted by the operation of attaching the staple holder 53 to the staple guide 52.

Also, the attaching opening 52R has support convex parts 52Rb that support the attaching convex parts 53R of the staple holder 53 at the fixing position by the operation of moving the staple holder rearward with respect to the staple guide 52. Further, the attaching opening 52R has a position restraint part 52Rc that restrains a position of the staple holder 53 at the fixing position between the magazine front wall 50*a* of the magazine 50 and the staple guide.

The attaching opening 52L has the insertion openings 52La that are formed at two locations and the support convex parts 52Lb that are formed at three locations, in correspondence to the arrangement of the two attaching convex parts 53L of the staple holder 53. The insertion openings 52La and the support convex parts 52Lb are alternately arranged and connected in the front-rear direction of the staple guide 52 and the position restraint part 52Lc is formed at a rear end of the attaching opening 52L.

Likewise, the attaching opening 52R has the insertion openings 52Ra that are formed at two locations and the support convex parts 52Rb that are formed at three locations, in correspondence to the arrangement of the two attaching convex parts 53R of the staple holder 53. The insertion openings 52Ra and the support convex parts 52Rb are alternately arranged and connected in the front-rear direction of the staple guide 52 and the position restraint part 52Rc is formed at a rear end of the attaching opening 52R.

The attaching opening 52L and the attaching opening 52R are formed so that the insertion openings 52La and the insertion openings 52Ra and the support convex parts 52Lb and the support convex parts 52Rb are symmetrically arranged in the upper-lower direction.

A method of attaching the staple holder 53 is described. As shown in FIG. 29(*a*), the staple holder 53 is inclined in the left-right direction at the insertion position so that the attaching convex parts 53L, 53R are introduced between the left and right sidewalls of the staple guide 52. Thereby, the attaching convex parts 53L are inserted into the insertion openings 52La of the attaching opening 52L and the attaching convex parts 53R are inserted into the insertion openings 52Ra of the attaching opening 52R.

The staple holder 53 having the attaching convex parts 53L inserted into the insertion openings 52La and the attaching convex parts 53R inserted into the insertion openings 52Ra is made to be substantially horizontal, as shown in FIG. 29(*b*), so that it can horizontally move rearward.

When the staple holder 53 at the insertion position as shown in FIG. 30(*a*) is moved to the fixing position as shown in FIG. 30(*b*), the attaching convex parts 53L, 53R are fitted into the support convex parts 52Lb, 52Rb between the left and right attaching openings 52L, 52R, so that the staple holder 53 is restrained from rotating in an inclining direction.

When the staple guide 52 having the staple holder 53 attached thereto is attached to the magazine 50 and the coil spring 50*d* is attached between the magazine 50 and the staple guide 52, the staple guide 52 is pressed toward the magazine front wall 50*a*.

When the staple guide 52 is pressed toward the magazine front wall 50*a*, the staple crown guide part 53*a* of the staple holder 53 is pressed by the magazine front wall 50*a* and the rear end of the staple holder 53 is pressed by the position restraint parts 52Lc, 52Rc of the attaching openings 52L, 52R.

Thereby, at the state where the staple crown guide part 53*a* is pressed by the magazine front wall 50*a* and the protrusion 53*d* is enabled to enter the recess portion 50*a* s of the magazine front wall 50*a*, the staple holder 53 is restrained from rotating in the inclining direction and moving in the front-rear direction and is fixed to the magazine 50 via the staple guide 52.

Regarding the configuration of attaching the staple holder to the staple guide, according to the prior art, a convex part is formed at a side of the staple holder, an opening into which the convex part of the staple holder is fitted is formed at a sidewall facing the staple guide and the staple guide is bent to attach the staple holder.

However, the staple guide is deformed due to the attachment of the staple holder, so that it may not be possible to secure size precision of a part required in the driving of the staple, in the clinch and the like.

In the exemplary embodiment, when attaching the staple holder 53 to the staple guide 52, the force of deforming the part is not applied. Thereby, the staple guide 52 and the like are not deformed by the attachment of the staple holder 53, so that it is possible to secure the size precision of a part required in the driving of the staple 10L, 10S, in the clinch and the like <Example of Configuration of Link Mechanism>

In the stapler 1A, the magazine unit 5 is provided with a link mechanism that transmits the movement of the upper handle unit 11*b* to the slider 3 of the lower handle unit 11*a*. In the below, a configuration of transmitting the movement of the upper handle unit 11*b* to the slider 3 of the lower handle unit 11*a* is described with reference to the respective drawings. The magazine unit 5 has a link 58 that transmits the movement of the upper handle unit 11*b* to the slider 3 of the lower handle unit 11*a* and thus performs the lock and lock release at the standby position of the clincher unit 2A.

In the exemplary embodiment, the link 58 is rotatably attached to the magazine guide 51 about a shaft 58*a* serving as a fulcrum and has a slider pressing part 58*b* that is formed at one end portion of a substantial L shape and abuts on the link bearing part 31 of the slider 3 and a driver pressing part 58*c* that is formed at the other end portion and is pressed by the driver unit 6.

The link 58 is configured in a weight distribution manner that the slider pressing part 58*b* is rotated by its own weight in a direction of abutting on the link bearing part 31 of the slider 3, and the slider pressing part 58*b* and the link bearing part 31 are kept with being always contacted each other. Thereby, as shown in FIG. 4, the link 58 is configured so that the slider pressing part 58*b* is positioned at the rear of the front end of the upper handle attachment part 40 of the lower handle frame 4.

A binding position of the staple 10L or staple 10S for the sheets is determined by a distance between the clinchers 20L, 20R of the clincher unit 2A and the sheet guide 43. To this end, the slider pressing part 58*b* is configured so that it is positioned at the rear of the front end of the upper handle attachment part 40 of the lower handle frame 4. Thereby, it is possible to set the movement position of the sheet guide 43 up to the front end of the upper handle attachment part 40. Hence, it is possible to lengthen a distance from an end portion of the sheet to a bonding position of the staple 10L or staple 10S.

<Example of Configuration of Lock Mechanism>

Figure 31A:
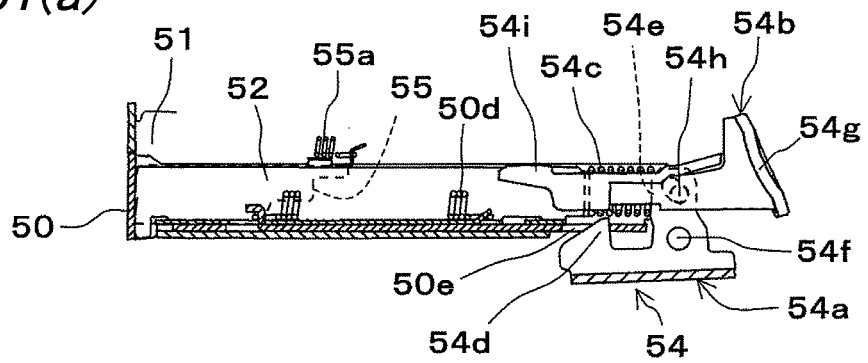
FIGS. 31(*a*) and 31(*b*) are side sectional views showing an example of a lock mechanism.
Figure 31B:
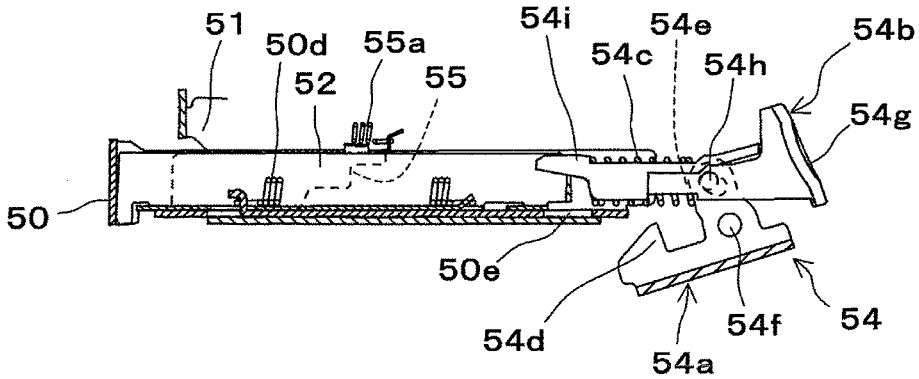
Figure 32:
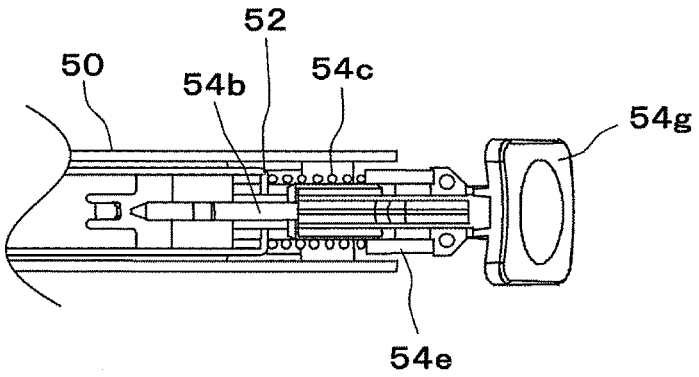
FIG. 32 is a plan sectional view of main parts showing an example of the lock mechanism.

FIG. 31 is a side sectional view showing an example of the lock mechanism and FIG. 32 is a plan sectional view of main parts showing an example of the lock mechanism. In the below, a configuration of the lock mechanism 54 is described with reference to the respective drawings.

The lock mechanism 54 has a magazine stopper 54*a* that locks the magazine 50 at an accommodation position and a pusher switch 54*b* that moves the magazine stopper 54*a*. Also, the lock mechanism 54 has a magazine lock spring 54*c* that applies a force of pressing the magazine 50 in a driving direction and applies a force of rotating the magazine stopper 54*a* in a lock direction.

The magazine stopper 54*a* has a lock claw 54*d*, which is fitted in a lock opening 50*e* formed on a rear end bottom surface of the magazine 50, at one end portion of a substantial L shape, and has a spring pressing part 54*e*, which is pressed by the magazine lock spring 54*c*, at the other end portion of the substantial L shape. The magazine stopper 54*a* is supported to the magazine guide 51 so that it can be rotated about a shaft 54*f* provided between the lock claw 54*d* and the spring pressing part 54*e*.

The pusher switch 54*b* has a switch part 54*g* at a rear end side thereof, which is pressed by a finger, and is rotatably connected to the other end portion of the substantial L shape to which the spring pressing part 54*e* of the magazine stopper 54*a* is formed, via a shaft 54*h*. The magazine lock spring 54*c* is attached to a front end side of the pusher switch 54*b* with the shaft 54*h* being interposed therebetween.

When the magazine 50 is accommodated in the magazine guide 51, the front end side of the magazine lock spring 54*c* abuts on the staple guide 52 of the magazine 50 and the rear end side thereof abuts on the spring pressing part 54*e* of the magazine stopper 54*a*. At the state where the magazine 50 is withdrawn, the magazine lock spring 54*c* is prevented from being deviated from the pusher switch 54*b* by a deviation preventing convex part 54*i* formed at the front end portion of the pusher switch 54*b*.

At the state where the magazine 50 is accommodated in the magazine guide 51, as shown in FIG. 31(*a*), the magazine lock spring 54 is compressed between the rear end side of the staple guide 52 attached to the magazine 50 and the spring pressing part 54*e* of the magazine stopper 54*a*.

In the magazine stopper 54*a*, the spring pressing part 54*e* is pressed, so that the lock claw 54*d* is rotated about the shaft 54*f* serving as a fulcrum in a direction along which the lock claw 54*d* is fitted into the lock opening 50*e* of the magazine 50 and is thus fitted in the lock opening 50*e*.

Thereby, the magazine 50 is kept with being accommodated in the magazine guide 51. Also, in the magazine 50, the staple guide 52 is pressed by the magazine lock spring 54*c*, so that the staple guide 52 is pressed toward the magazine front wall 50*a* by the magazine lock spring 54*c* together with the coil spring 50*d* attached between the magazine 50 and the staple guide 52.

When the switch part 54*g* is pushed, the pusher switch 54*b* rotates the magazine stopper 54*a* connected via the shaft 54*h* about the shaft 54*f* serving as a fulcrum, thereby separating the lock claw 54*d* of the magazine stopper 54*a* from the lock opening 50*e* of the magazine 50, as shown in FIG. 28(*b*).

When the lock claw 54*d* of the magazine stopper 54*a* is separated from the lock opening 50*e* of the magazine 50, the pusher 55 is pushed by a restoring force of the compressed magazine lock spring 54*c* and a restoring force of the tensioned pusher spring 55*a*, so that the magazine 50 is pressed forward and the magazine 50 is thus withdrawn from the magazine guide 51.

<Example of Configuration of Driver Unit>

Figure 33A:
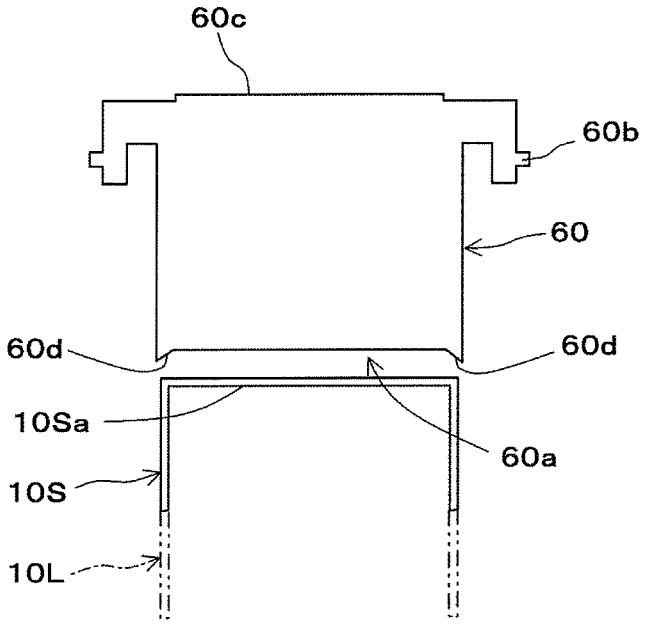
FIGS. 33(*a*) and 33(*b*) are configuration views showing an example of a driver.
Figure 33B:
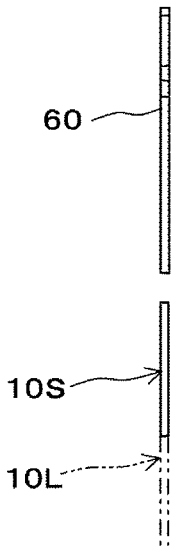

FIG. 33 is a configuration view showing an example of the driver. In the below, a configuration of the driver unit 6 is described with reference to the respective drawings. The drive unit 6 is an example of the driving unit and configures the motion member together with the magazine unit 5. The driver unit 6 has a driver 60 that presses the one head staple of the staples 10L or staples 10S loaded in the magazine 50 to thus enable the staple to penetrate the sheets and a driver arm 61 that presses the driver 60 and the link 58.

The driver 60 is an example of the acting member and is configured by a plate-shaped member that is provided at a lower end side with a staple pressing 60*a* having a width corresponding to the outer size of the staple crown 10La of the staple 10L or staple crown 10Sa of the staple 10S, as shown in the front view of FIG. 33(*a*), and a plate thickness corresponding to the line width of one staple 10L or staple 10S, as shown in the side view of FIG. 33(*b*). Also, the driver 60 is provided at an upper end side with a shaft part 60*b* that is supported by the driver arm 61 and a driver pressing part 60*c* that is pressed by the driver arm 61.

Also, the driver 60 has a pressing part 60*d* that presses both end portions of the staple crown 10La corresponding to the pair of legs 10Lb of the staple 10L and both end portions of the staple crown 10Sa corresponding to the pair of legs 10Sb of the staple 10S.

In the driver 60, the pressing part 60*d* is configured by providing both left and right sides of the staple pressing part 60*a* in the width direction with protrusions that protrude downward in a predetermined shape. The staple crown 10La of the staple 10L and the staple crown 10Sa of the staple 10S have the substantially same outer size. Thus, for the staple 10L, the just above parts of the pair of legs 10Lb are pressed by the pressing part 60*d*. Likewise, for the staple 10S, the just above parts of the pair of legs 10Sb are pressed by the pressing part 60*d*.

As shown in FIG. 2 and the like, the driver arm 61 has a pressing surface 61*a* that presses the driver pressing part 60*c* of the driver 60 and a driver guide recess 61*b* that supports the shaft part 60*b* of the driver 60 and guides rotatably and slideably the driver 60.

In the driver arm 61, the pressing surface 61*a* is configured by a curved surface that is curved in a concave shape and the driver guide recess 61*b* is configured by a long hole that extends in the front-rear direction while conforming to the pressing surface 61*a* and is curved into a concave shape. The driver arm 61 is provided with the pressing surface 61*a* on a lower surface of an upper plate at the one end side that is the front end side of the driver unit 6 and is provided with the guide recess 61*b* at both side plates. In the driver unit 6, the shaft part 60*b* of the driver 60 is inserted and supported in the driver guide recess 61*b* of the driver arm 61, so that the driver 60 is attached to the one end side of the driver arm 61.

The magazine unit 5 and the driver unit 6 are attached to the upper handle attachment part 40 of the lower handle frame 4 at a state where the end portion side of the other side of the magazine guide 51 and the driver arm 61, which is the rear end side of the driver unit 6, is rotatable about the shaft 54*f* serving as a fulcrum. In this example, the magazine guide 51 and the driver arm 61 are rotated coaxially with the magazine stopper 54*a*.

In the driver unit 6, the driver 60 attached to the driver arm 61 is guided along the magazine front wall 50*a* of the magazine 50 by the spring guide 56 attached to the magazine guide 51.

While the magazine 50 does not contact the sheet and the driver arm 61 and the magazine guide 51 are integrally rotated about the shaft 54*f* serving as a fulcrum, a relative positional relation between the driver 60 and the magazine 50 is not changed.

When the sheets are held between the clincher unit 2A and the magazine 50 and the driver arm 61 is rotated relative to the magazine guide 51, the driver 60 is pressed by the driver arm 61 by the rotation operation of the driver arm 61 relative to the magazine guide 51.

Since the shaft part 60*b* of the driver 60 can move along the driver guide recess 61*b*, as the driver arm 61 is rotated, a position at which the pressing surface 61*a* of the driver arm 61 and the driver pressing part 60*c* of the driver 60 abut each other is changed. Thereby, an angle of the driver 60 pressing the staple 10L, 10S is kept at a predetermined angle.

At the standby state, an empty space 61*c* is formed between the driver arm 61 and the driver pressing part 58*c* of the link 58, so that the driver arm 61 does not contact the link 58. While the magazine 50 does not contact the sheet and the driver arm 61 and the magazine guide 51 are integrally rotated about the shaft 54*f* serving as a fulcrum, the empty space 61*c* between the driver arm 61 and the driver pressing part 58*c* of the link 58 is kept.

Then, when the sheets are held between the clincher unit 2A and the magazine 50 and the driver arm 61 is rotated relative to the magazine guide 51, the link 58 is pressed by the rotating operation of the driver arm 61 and the link 58 is rotated about the shaft 58*a* serving as a fulcrum, so that the slider 3 is operated.

<Example of Configuration of Handle Unit>

Figure 34:
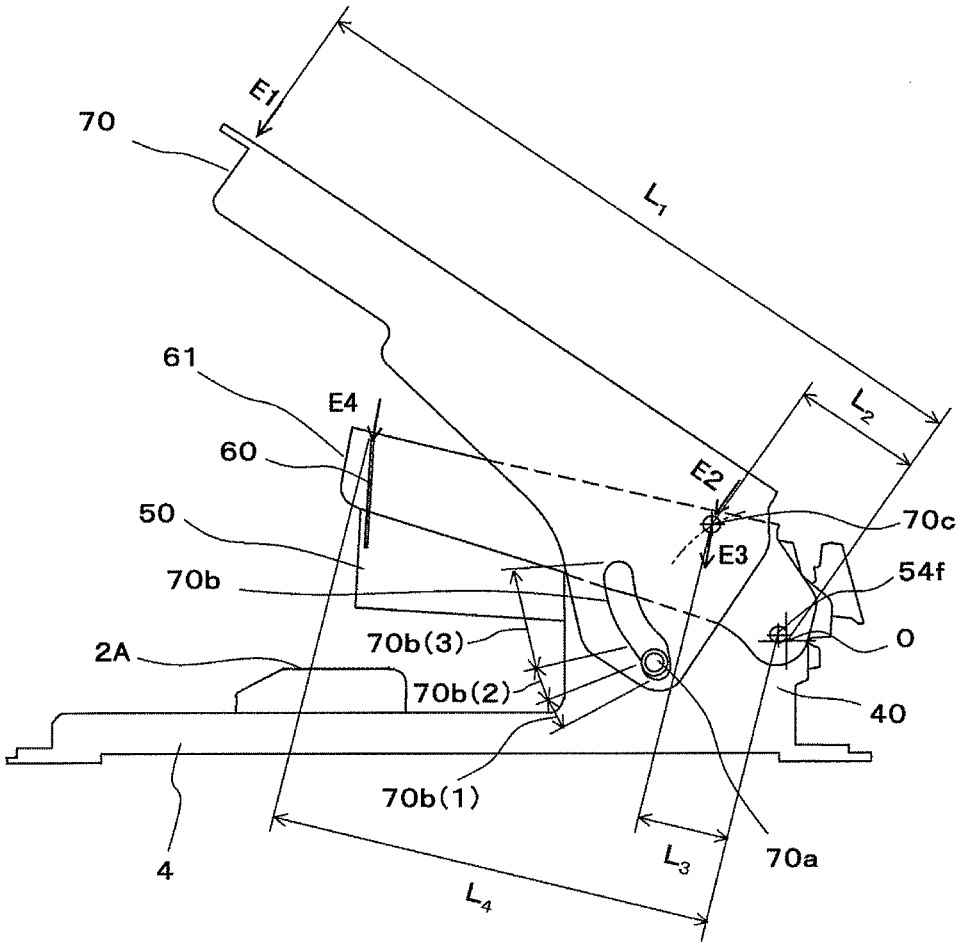
FIG. 34 is a side view showing an example of a boosting mechanism that reduces an operation load in a handle unit.

FIG. 34 is a side view showing an example of a boosting mechanism that reduces an operation load in the handle unit. In the below, a configuration of the handle unit is described with reference to the respective drawings. The handle unit 7 is an example of the operation member and has a handle arm 70 that presses the driver arm 61, an upper handle cover 71 that covers the handle arm 70 and a front cover 72 that covers a gap formed between the upper handle cover 71 and the driver arm 61.

The handle arm 70 has a shaft hole 70*b* into which a shaft 70*a* attached to the upper handle attachment part 40 of the lower handle frame 4 is inserted, and is attached to the lower handle frame 4 via the shaft 70*a* and the shaft hole 70*b*. Also, the handle arm 70 is connected to the driver arm 61, which is supported to the upper handle attachment part 40 of the lower handle frame 4 by the shaft 54*f*, by a shaft 70*c*.

In the handle arm 70, the force is applied to one end portion side thereof that is a front end side of the handle unit 7, so that the handle arm 70 is slightly moved by the shape of the shaft hole 70*b*, which is the guide part that is guided by the shaft 70*a*, and the trajectory along which the shaft 70*c* can be moved. At this time, the corresponding movement can be regarded as the rotating operation. A fulcrum O that becomes a virtual rotating fulcrum when the displacement of the handle arm 70 is regarded as the rotating operation is formed at the other end portion side of the handle arm 70. The handle arm 70 is displaced by the rotating operation about the fulcrum O serving as a fulcrum, thereby pressing the driver arm 61 via the shaft 70*c*.

In the handle arm 70, a contact angle of the shaft hole 70*b* and the shaft 70*a* is changed as the handle arm 70 is rotated. Thereby, a direction along which the shaft hole 70*b* is guided by the shaft 70*a* is changed and the fulcrum O of the rotating operation of the handle arm 70 is moved.

To this end, the shaft hole 70*b* is provided with zones in which the contact angle with the shaft 70*a* is respectively different, depending on parts that the shaft 70*a* contacts, and changed by the rotating operation of the handle arm 70. In this example, the shaft hole 70*b* is configured by a predetermined long hole shape having combined three zones of a first zone 70*b*(1), a second zone 70*b*(2) and a third zone 70*b*(3).

In the direction of the handle arm 70 at the standby state as shown in FIG. 34, the shaft hole 70*b* is provided at a lower end side with the first zone 70*b*(1) in which the contact angle with the shaft 70*a* is largely inclined in an erecting direction relative to the horizontal direction.

Also, the shaft hole 70*b* is provided with the second zone 70*b*(2) in which the contact angle with the shaft 70*a* is small inclined relative to the first zone 70*b*(1) and is reduced as the handle arm 70 is rotated and which continues from the first zone 70*b*(1).

Also, the shaft hole 70*b* is provided with the third zone 70*b*(3) having an arc shape that continues from the second zone 70*b*(2).

The handle arm 70 and the driver arm 61 are connected so that the other end portion side of the handle arm 70 and the other end portion side of the driver arm 61 can be displaced in the rotating direction by the shaft 70*c*.

The shaft 70*c* that is the connection part of the handle arm 70 and the driver arm 61 is provided at the front of the shaft 54*f* that supports the other end portion side of the driver arm 61 to the lower handle frame 4. A trajectory along which the shaft 70*c* can be moved is an arc having the shaft 54*f* serving as a center thereof.

Thereby, in the handle arm 70, the one end portion side thereof that is the front end side of the handle unit 7 becomes a force point E1 to which a force is applied by a user, the shaft 70*c* that is the connection part with the driver arm 61 is an operating point E2 of a force to be applied to the driver arm 61 and the fulcrum O is a fulcrum of the rotating operation.

Also, in the driver arm 61, the shaft 70*c* that is the connection part with the handle arm 70 is a force point E3 to which a force is applied by the handle arm 70, the driver 60 is an operating point E4 of a force to be applied to the staple 10L or staple 10S and the shaft 54*f* is a fulcrum of the rotating operation.

The handle unit 7 and the driver unit 6 implement the boosting mechanism that reduces the load F to be applied to the handle arm 70 by a ratio of distances of the force points, the operating points and the fulcrums of the handle arm 70 and the driver arm 61.

A reduction rate (%) of the load F that is applied to the handle arm 70 is obtained by a following equation (1).

$$D(\%) = 1 - \left(\frac{L_4}{L_3} \times \frac{L_2}{L_1}\right) \qquad \langle\text{Equation (1)}\rangle$$

Here, in the handle unit 7, a length from the force point E1 at which the force is applied to the handle arm 70 to the fulcrum O that is the rotating fulcrum of the handle arm 70 is L1 and a length from the shaft 70*c* that is the operating point E2 at which the force is applied to the driver arm 61 to the fulcrum O is L2.

Also, in the driver unit 6, a length from the shaft 70*c* that is the operating point E3 at which the force is applied to the driver arm 61 to the shaft 54*f* that is the rotating fulcrum of the driver arm 61 is L3 and a length from the driver 60 that is the operating point E4 to the shaft 54*f* is L4.

From the equation (1), when a ratio of the length L2 from the shaft 70*c* that is the operating point E2 to the fulcrum O to the length L1 from the force point E1 to the fulcrum O is reduced, the reduction rate of the load F that is applied to the handle arm 70 is increased.

Therefore, in the handle arm 70, the fulcrum O of the handle arm 70 is moved from the vicinity of the shaft 54*f* toward the shaft 70*c* by the shape of the shaft hole 70*b*, depending on the position of the handle arm 70 during the binding operation of the sheets P.

Thereby, in a desired process of the operation of binding the sheets P, the load F that is applied to the handle arm 70 is stepwise reduced so that the load F fits for the operation. Thus, the load F becomes light at a step in which the staple 10L or staple 10S penetrates the sheets P.

By providing the above boosting mechanism, a stroke of the handle arm 70 is prolonged and a gap is formed between the upper handle cover 71 attached to the handle arm 70 and the driver arm 61. Hence, as shown in FIG. 1, the front cover 71 that covers the gap between the upper handle cover 71 and the driver arm 61 is attached.

Figure 35:
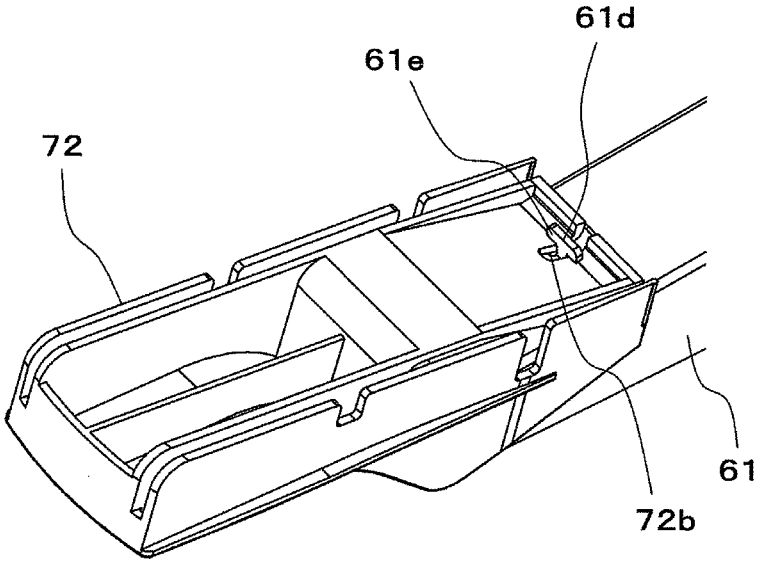
FIG. 35 is a perspective view showing an example of a front cover.

FIG. 35 is a perspective view showing an example of the front cover. The front cover 72 has a shape that covers the front and rear of the gap formed between the upper handle cover 71 and the driver arm 61. As shown in FIG. 1, the front cover 72 is attached to the handle arm 70 so that it can rotate about a shaft part 72*a* serving as a fulcrum, which is provided at one end portion of the front cover and is inserted into the shaft hole 70*d* provided to the handle arm 70.

Also, as shown in FIG. 35, the front cover 72 is attached to the driver arm 61 so that it can rotate and slide about a guide convex part 61*d* serving as a fulcrum, which is provided to the driver arm 61 and is inserted into a recess portion 72*b* formed at the other portion of the front cover. In this example, the guide convex part 61*d* has a T-shape, as a deviation preventing shape, so that it is provided with a deviation preventing portion 61*e*. The guide convex part is inserted into the recess portion 72*b* of the front cover 72 so that it can slide and rotate, and the separation of the recess portion 72*b* is prevented.

In the meantime, the attachment structure of the front cover 72 and the driver arm 61 may be configured so that the front cover 72 is provided with the guide convex part having a deviation preventing shape and the driver arm 61 is provided with the recess portion into which the guide convex part is inserted rotatably and slideably. Also, it may be possible that the front cover 72 and the driver arm 61 are rotatably connected by a shaft part and a shaft hole and the front cover 72 and the handle arm 70 are connected rotatably and slideably by a shaft hole having a long hole shape and a shaft part.

<Example of Operation of Stapler of the Exemplary Embodiment>

Figure 36A:
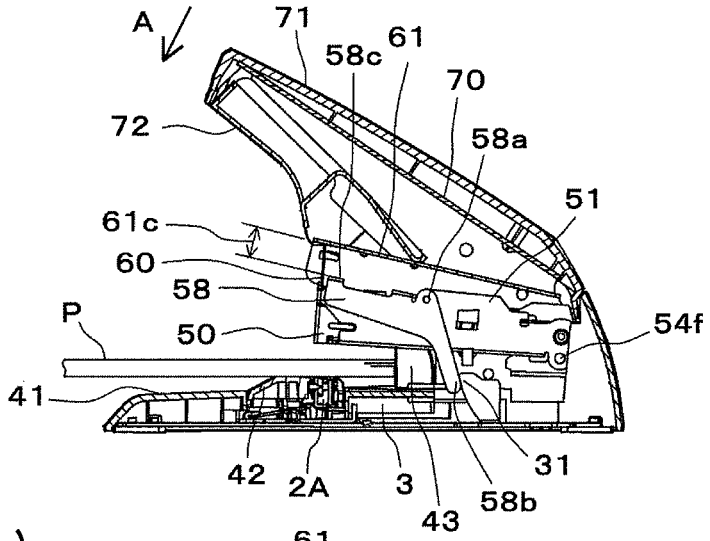
FIGS. 36(*a*) to 36(*c*) are side sectional views showing an operation of binding sheets by the stapler of the exemplary embodiment.
Figure 36B:
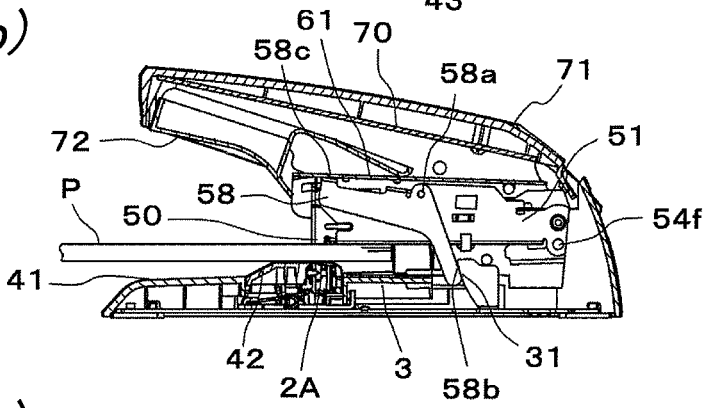
Figure 36C:
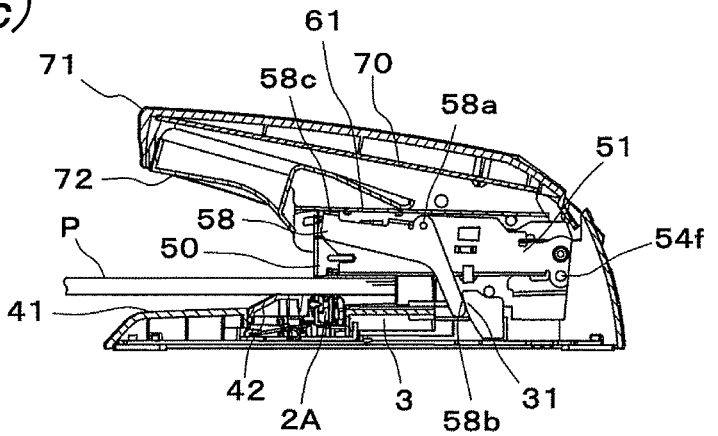
Figure 37A:
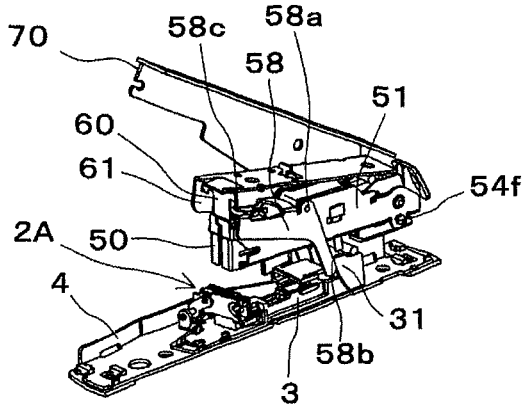
FIGS. 37(*a*) to 37(*c*) are perspective views showing an operation of binding sheets by the stapler of the exemplary embodiment.
Figure 37B:
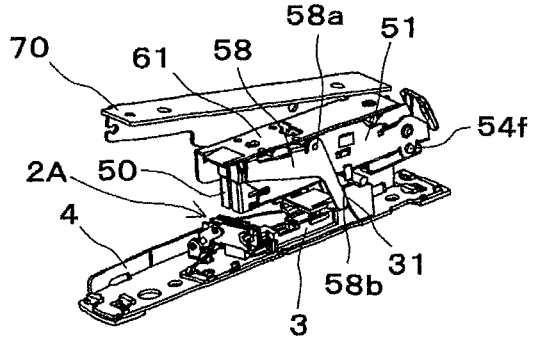
Figure 37C:
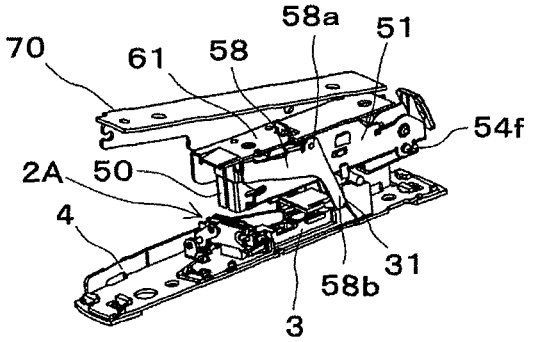

FIG. 36 is a side sectional view showing an operation of binding sheets by the stapler of the exemplary embodiment, FIG. 37 is a perspective view showing an operation of binding sheets by the stapler of the exemplary embodiment and FIGS. 38 to 41 are side views showing an example of an operation of the boosting mechanism that reduces the operation load in the handle unit. In the below, an operation of binding the sheets by the stapler 1A of the exemplary embodiment is described with reference to the respective drawings.

First, at the standby state of the stapler 1A, as shown in FIG. 35(*a*), the gap between the upper handle cover 71 and the driver arm 61 is covered by the front cover 72 attached to the upper handle cover 71 and the driver arm 61. Thereby, it is possible to prevent any object from being inserted into the gap between the upper handle cover 71 and the driver arm 61.

During the binding operation, the sheets P are put on the lower handle cover 41 and the clincher cover 42 of the lower handle unit 11*a*. In the stapler 1A, it is possible to adjust the binding positions of the staples 10L or staples 10S by adjusting the position of the sheet guide 43 and colliding the sheets P with the sheet guide 43.

When the sheets P are put on and the upper handle cover 71 is pressed in an arrow A direction from the standby state, the handle arm 70 covered by the upper handle cover 71 is rotated about the contact point of the shaft 70*a* and the shaft hole 70*b*, which is shown in FIG. 34 and the like and serves as a moving fulcrum.

Figure 38:
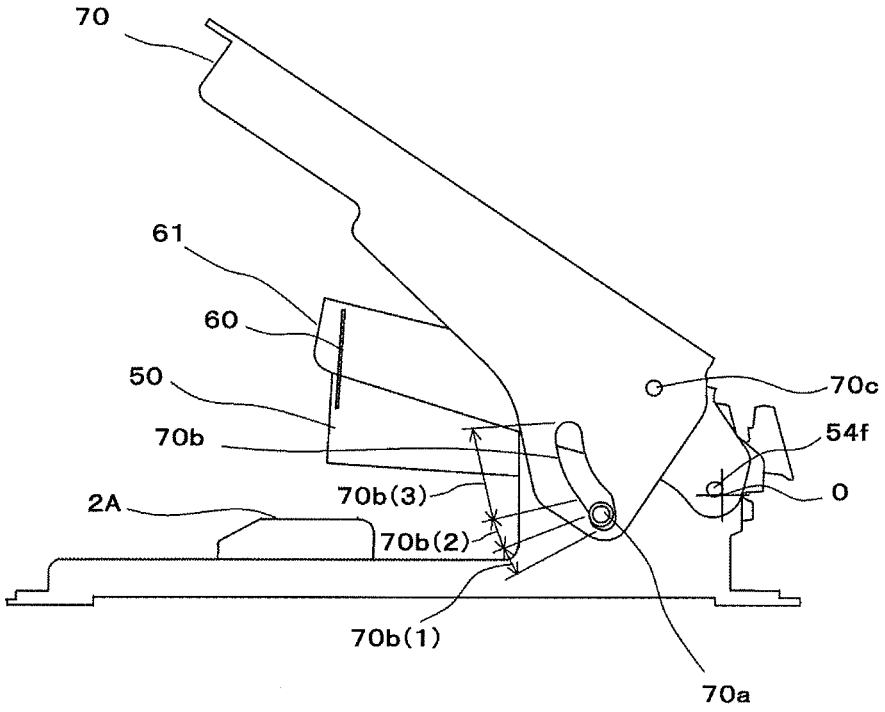
FIG. 38 is a side view showing an example of an operation of the boosting mechanism that reduces the operation load in the handle unit.

First, an operation of the boosting mechanism in the process of binding the sheets P is described. At the standby state of the stapler 1A, the shaft hole 70*b* of the handle arm 70 of the handle unit 7 contacts the shaft 70*a* in the first zone 70*b*(1), as shown in FIG. 38.

In the handle unit 7, at the state where the shaft hole 70*b* of the handle arm 70 contacts the shaft 70*a* in the first zone 70*b*(1), when the movement that is made when slightly moving the handle arm 70 is regarded as the rotating operation, the fulcrum O that is the virtual rotating fulcrum of the handle arm 70 is formed in the vicinity of the shaft 54*f* becoming the rotating fulcrum of the driver arm 61.

When the upper handle cover 71 is pressed from the standby state, the shaft hole 70*b* is guided by the shaft 70*a*, so that the handle arm 70 is displaced by the rotating operation about the fulcrum O, which is formed in the vicinity of the shaft 54*f* and servers as a fulcrum, and the contact part of the shaft hole 70*b* to the shaft 70*a* is moved.

In the driver unit 6, the driver arm 61 is pressed by the displacement of the shaft 70*c* due to the rotating operation of the handle arm 70 and the driver arm 61 is rotated about the shaft 54*f* serving as a fulcrum together with the magazine unit 5.

Figure 39:
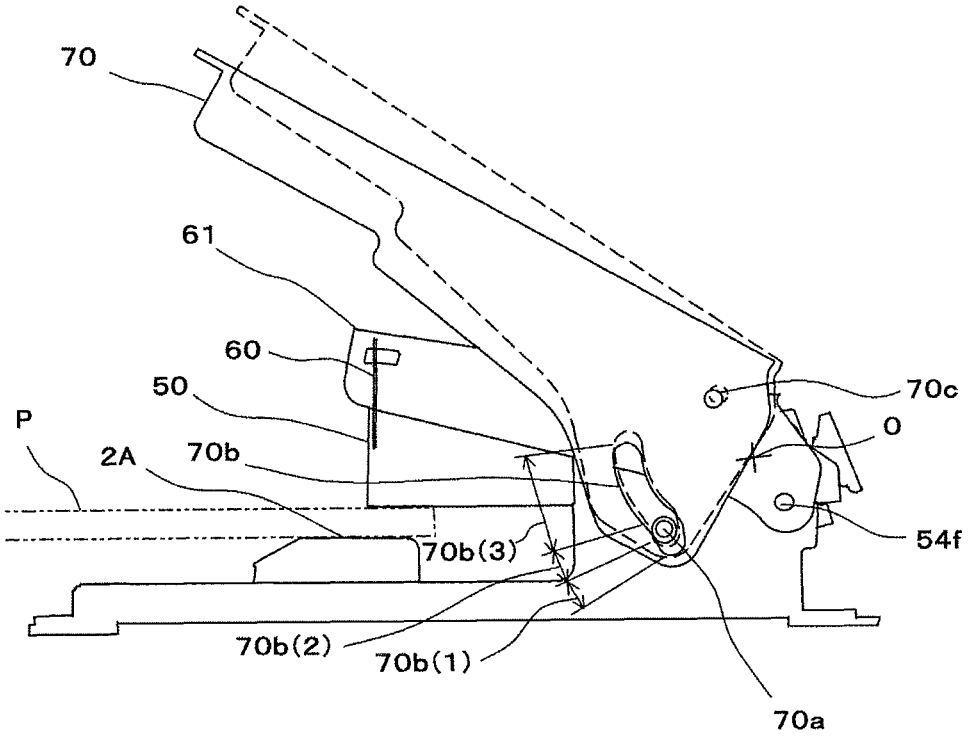
FIG. 39 is a side view showing an example of an operation of the boosting mechanism that reduces the operation load in the handle unit.

When the upper handle cover 71 is pressed from the standby state and the predetermined number of sheets P (80 sheets, in this example) is thus held between the clincher unit 2A and the magazine 50, the shaft hole 70*b* of the handle arm 70 is contacted to the shaft 70*a* in the second zone 70*b*(2), as shown in FIG. 39.

In the second zone 70*b*(2) of the shaft hole 70*b*, the contact angle with the shaft 70*a* is small inclined relative to the first zone 70*b*(1) and is reduced as the handle arm 70 is rotated. Therefore, the fulcrum O of the handle arm 70 is moved from the vicinity of the shaft 54*f* toward the shaft 70*c*.

When the fulcrum O of the handle arm 70 is moved from the vicinity of the shaft 54*f* toward the shaft 70*c*, the length L1 from the force point E1 shown in FIG. 34 to the fulcrum O and the length L2 from the shaft 70*c*, which is the operating point E2, to the fulcrum O are decreased. Thus, from the equation (1), the reduction rate of the load F that is applied to the handle arm 70 is increased and the load F is gradually reduced.

When the upper handle cover 71 is further pressed from the state where the sheets P are held between the clincher unit 2A and the magazine 50, the driver arm 61 is pressed by the displacement of the shaft 70*c* due to the rotating operation of the handle arm 70 and the driver arm 61 is rotated about the shaft 54*f* serving as a fulcrum at a state where the rotation of the magazine 50 is restrained.

Although the operation of driving the staple 10L (10S) is specifically described later, the driver arm 61 is rotated about the shaft 54*f* serving as a fulcrum at a state where the rotation of the magazine 50 is restrained, so that the staple 10L is pressed and separated one by one by the driver 60. The one separated staple 10L is driven to penetrate the sheets P.

Figure 40:
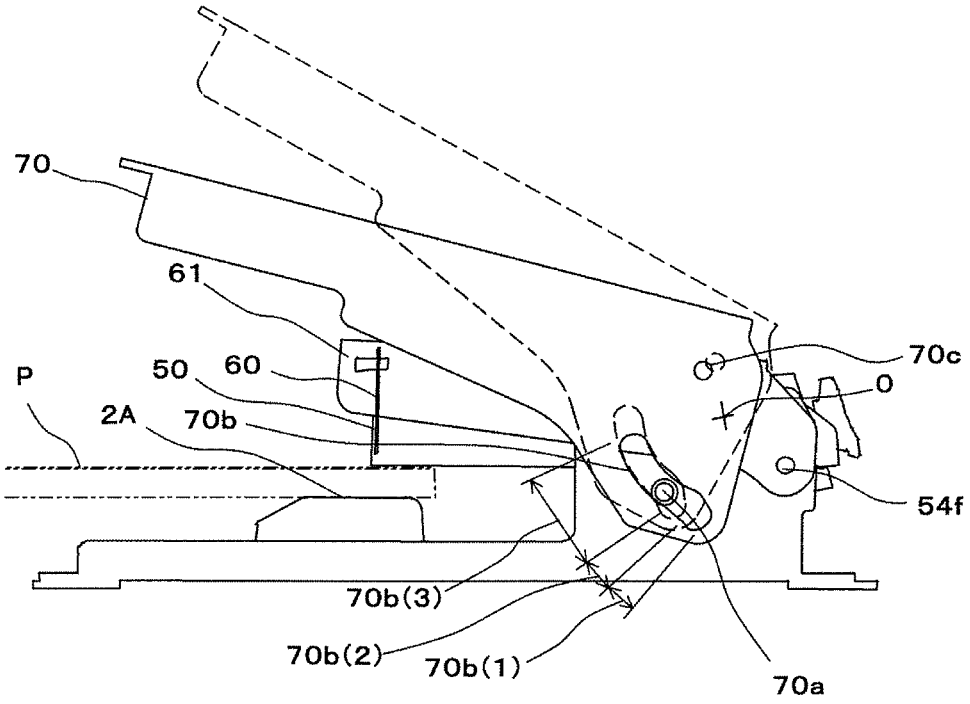
FIG. 40 is a side view showing an example of an operation of the boosting mechanism that reduces the operation load in the handle unit.

When the upper handle cover 71 is further pressed at the state where the sheets P are held between the clincher unit 2A and the magazine 50 and the handle arm 70 is rotated to the position at which the staple 10L penetrates the sheets P, the shaft hole 70*b* of the handle arm 70 is contacted to the shaft 70*a* in the third zone 70*b*(3), as shown in FIG. 40.

In the handle arm 70, when the second zone 70*b*(2) of the shaft hole 70*b* is guided by the shaft 70*a* and the contact part of the shaft hole 70*b* and the shaft 70*a* is thus moved from the second zone 70*b*(2) to the third zone 70*b*(3), the fulcrum O is moved toward the shaft 70*c* than a middle point of the shaft 54*f* and the shaft 70*c*.

When the fulcrum O of the handle arm 70 is moved toward the shaft 70*c* than the middle point of the shaft 54*f* and the shaft 70*c*, the length L1 from the force point E1 shown in FIG. 34 to the fulcrum O and the length L2 from the shaft 70*c*, which is the operating point E2, to the fulcrum O are further decreased. Thus, from the equation (1), the reduction rate of the load F that is applied to the handle arm 70 is further increased and the load F is decreased to a desired value.

When the upper handle cover 71 is further pressed from the state where the staple 10L has penetrated the sheets P, the driver arm 61 is pressed by the displacement of the shaft 70*c* due to the rotating operation of the handle arm 70 and the driver arm 61 is further rotated about the shaft 54*f* serving as a fulcrum at the state where the rotation of the magazine 50 is restrained.

Although the operation of bending the legs 10Lb (10Sb) of the staple 10L (10S) is specifically described later, the driver arm 61 is further rotated, so that a clutch off state is made by the operation of the slider 3 and the legs 10Lb (10Sb) start to be bent at predetermined timing at which the leading ends of the legs 10Lb (10Sb) protrude from a backside of the sheet P.

Figure 41:
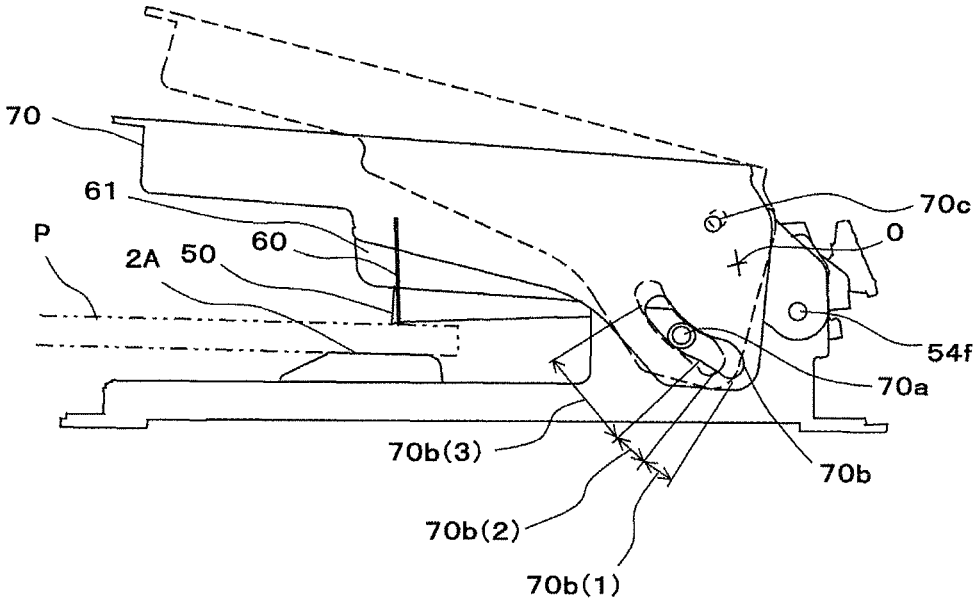
FIG. 41 is a side view showing an example of an operation of the boosting mechanism that reduces the operation load in the handle unit.

When the upper handle cover 71 is further pressed from the state where the staple 10L has penetrated the sheets P, the third zone 70*b*(3) of the shaft hole 70*b* is guided by the shaft 70*a*, so that the handle arm 70 is rotated about the fulcrum O that is formed at the shaft 70*c*-side other than the middle point of the shaft 54*f* and the shaft 70*c*, at the clutch off state, as shown in FIG. 41.

In the handle arm 70, when the center of the arc of the third zone 70*b*(3) of the shaft hole 70*b* is matched with the fulcrum O and the third zone 70*b*(3) is thus guided by the shaft 70*a*, the fulcrum O is not moved.

Thereby, the length L1 from the force point E1 shown in FIG. 34 to the fulcrum O and the length L2 from the shaft 70*c*, which is the operating point E2, to the fulcrum O are not changed. Thus, from the equation (1), the reduction rate of the load F that is applied to the handle arm 70 is constant and the load F reduced to the desired value is kept.

Figure 42:
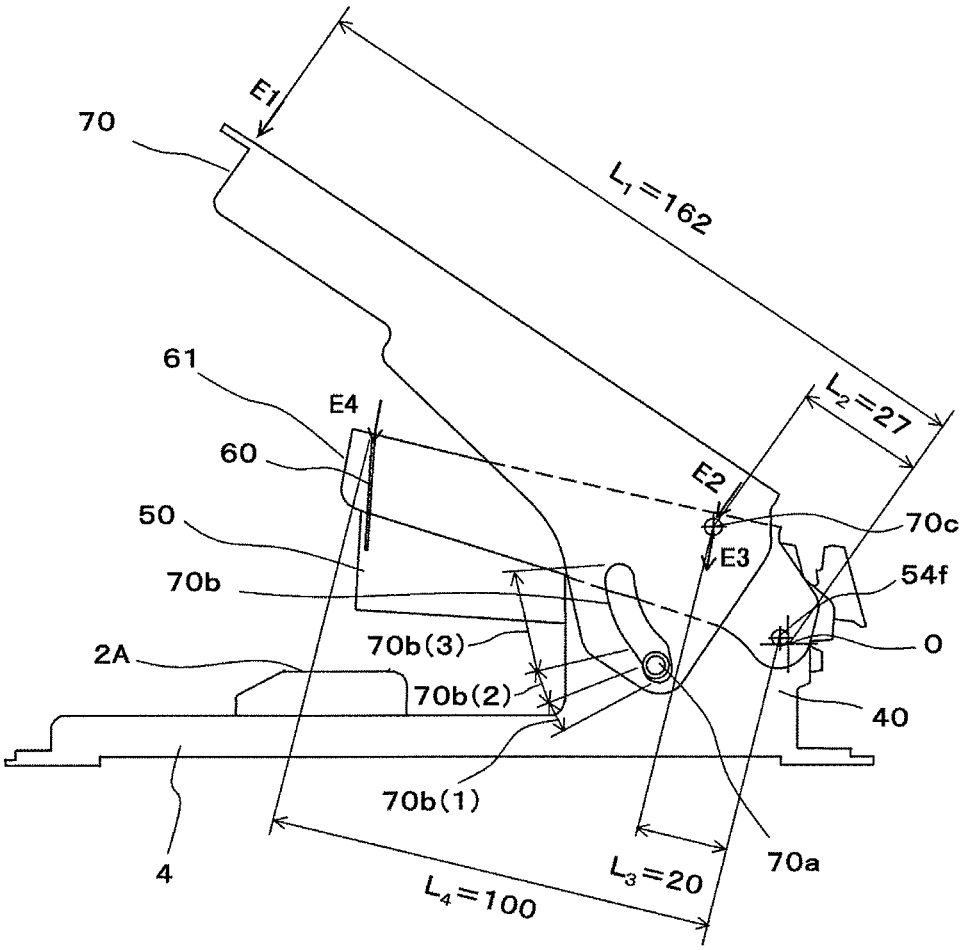
FIG. 42 illustrates an example of a reduction rate of a load.
Figure 43:
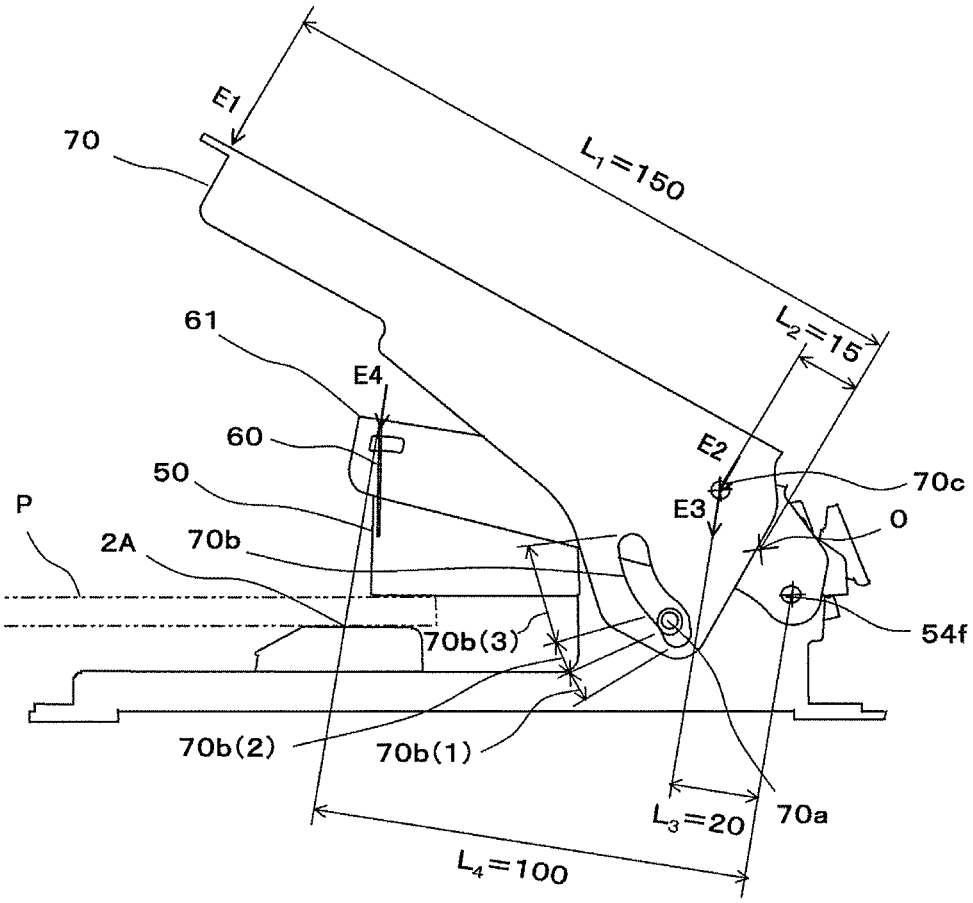
FIG. 43 illustrates an example of the reduction rate of the load.
Figure 44:
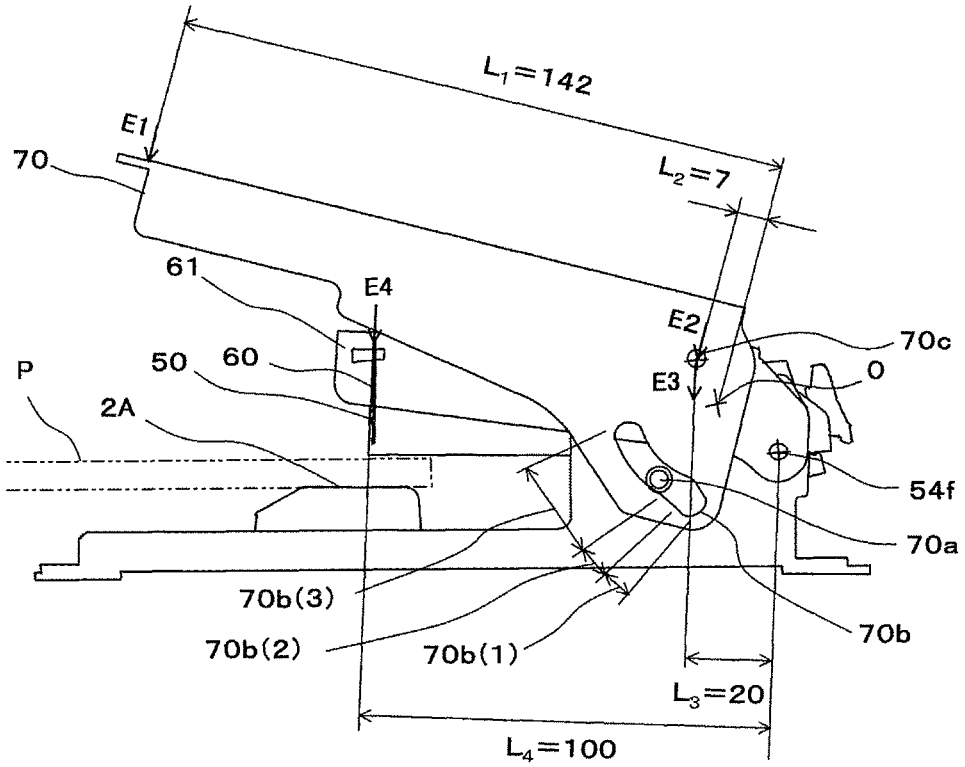
FIG. 44 illustrates an example of the reduction rate of the load.
Figure 45:
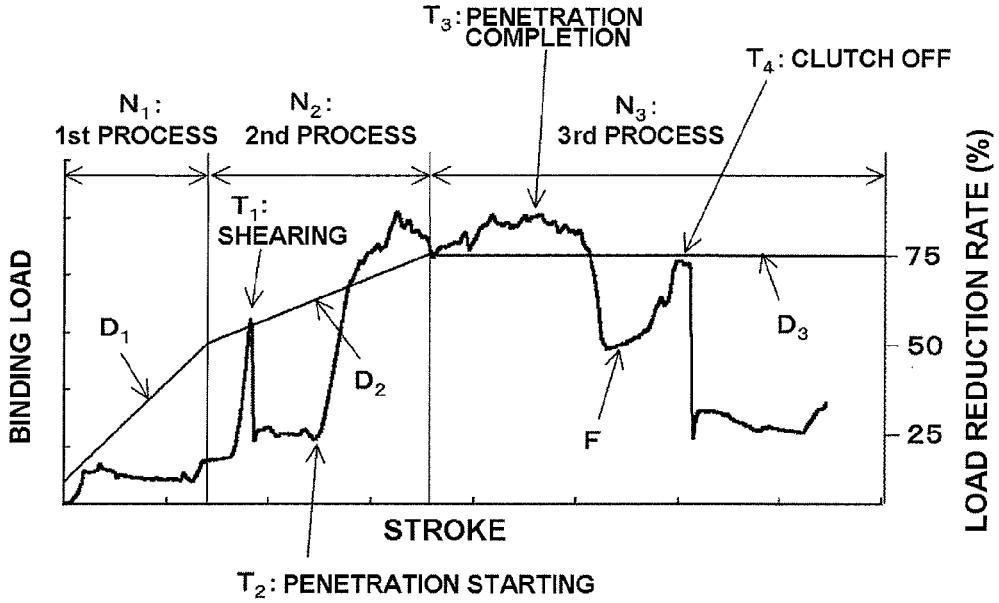
FIG. 45 is a graph showing an example of a change in the reduction rate of the load.

FIGS. 42 to 44 illustrate an example of the reduction rate of the load and FIG. 45 is a graph showing an example of the change in the reduction rate of the load.

The stapler 1A is provided with the boosting mechanism so as to reduce the load that is applied to the upper handle cover 71 through the handle arm 70 during the process of binding the sheets P by the staple 10L (10S). In the stapler 1A, the load F that is applied to the handle arm 70 is most heavy during the process of binding the sheets P by the staple 10L (10S). Meanwhile, the load F is also increased during a process of shearing the staples 10L (10S).

For example, when the reduction rate of the load F is set in conformity to the process of enabling the staple 10L (10S) to penetrate the sheets P, if the reduction rate of the load F in the process of shearing the staple 10L (10S) is also set with the same value, an operating amount of the handle arm 70 is increased and it is necessary to enlarge the stapler 1A.

Compared to this, when the reduction rate of the load F is gradually increased in a constant ratio from the standby state in conformity to the process of enabling the staple 10L (10S) to penetrate the sheets P, the load F becomes heavy in the process of shearing the staple 10L (10S), so that an operational feeling may be deteriorated.

Therefore, by the shape of the shaft hole 70*b*, the reduction rate of the load F is changed as the handle arm 11 is rotated and the reduction rate of the load F is set in conformity to each of a process before the process of shearing the staple 10L (10S) from the standby state, the process of shearing the staple 10L (10S) and the process of enabling the staple 10L (10S) to penetrate the sheets P.

In this example, a first reduction rate D1 of the load F is set in conformity to a maximum load Fmax1 in a first process N1 before the process of shearing the staple 10L (10S) from the standby state. Also, a second reduction rate D2 of the load F is set in conformity to a maximum load Fmax2 in a second process N2 of shearing the staple 10L (10S). Also, a third reduction rate D3 of the load F is set in conformity to a maximum load Fmax3 in a third process N3 of enabling the staple 10L (10S) to penetrate the sheets P.

In the below, an embodiment of the reduction rate of the load F is described. As described above, the length L3 from the shaft 70*c* that is the operating point E3 at which the force is applied to the driver arm 61 to the shaft 54*f* that is the rotating fulcrum of the driver arm 61 and the length L4 from the driver 60 that is the operating point E4 to the shaft 54*f* are constant and values shown in FIGS. 42 to 44 are set in this example.

Compared to this, the length L1 from the force point E1 at which the force is applied to the handle arm 70 to the fulcrum O that is the rotating fulcrum of the handle arm 70 and the length L2 from the shaft 70*c* that is the operating point E2 at which the force is applied to the driver arm 61 to the fulcrum O are changed by the operation of binding the sheets P with the staple 10L (10S).

At the standby state before starting the operation of binding the sheets P, the shaft hole 70*b* of the handle arm 70 is contacted to the shaft 70*a* in the first zone 70*b*(1), as described above, and the fulcrum O that is the support point of the rotating operation of the handle arm 70 is formed in the vicinity of the shaft 54*f* that is the rotating fulcrum of the driver arm 61, as shown in FIG. 42.

In the first process N1 before the process of shearing the staple 10L (10S) from the standby state, the shaft hole 70*b* of the handle arm 70 is contacted to the shaft 70*a* in the first zone 70*b*(1) and the fulcrum O is formed at the position shown in FIG. 42.

In the first process N1, when the length L1 from the force point E1 to the fulcrum O and the length L2 from the operating point E2 (shaft 70*c*) to the fulcrum O are set with the values shown in FIG. 42, the first reduction rate (boosting rate) D1 of the load F is about 16% from the equation (1).

After starting the operation of binding the sheets P until the sheets P are held between the clincher unit 2A and the magazine 50, regarding the force F that is applied to the handle arm 70, a reactive force of a return spring (not shown) is a main force and the maximum load Fmax1 in the first process is small. Thus, the reduction rate of the load is set to be small.

After starting the operation of binding the sheets P, the second reduction rate D2 of the load F is set in conformity to the second process N2 of shearing the staple 10L (10S). In the second process N2 of shearing the staple 10L (10S), the shaft hole 70*b* of the handle arm 70 is contacted to the shaft 70*a* in the second zone 70*b*(2).

At the state where the shaft hole 70*b* of the handle arm 70 is contacted to the shaft 70*a* in the second zone 70*b*(2), the fulcrum O that is the fulcrum of the rotating operation of the handle arm 70 is formed at the middle point between the shaft 54*f* that is the rotating fulcrum of the driver arm 61 and the shaft 70*c* that is the connection part of the handle arm 70 and the driver arm 61, as shown in FIG. 43.

In the second process N2 of shearing the staple 10L (10S), the shaft hole 70*b* of the handle arm 70 is contacted to the shaft 70*a* in the second zone 70*b*(2) and the fulcrum O is formed at the position shown in FIG. 43.

In the second process N2, when the length L1 from the force point E1 to the fulcrum O and the length L2 from the operating point E2 (shaft 70*c*) to the fulcrum O are set with the values shown in FIG. 43, the second reduction rate (boosting rate) D2 of the load F is about 50% from the equation (1).

In the second process N2, the maximum load Fmax2 is generated at timing T1 at which the staple 10L (10S) is sheared. Hence, the second reduction rate D2 of the load F is set to be about 50% in conformity to the maximum load Fmax2.

Thereby, it is possible to prevent the operational feeling from being deteriorated by reducing the load F in the process of shearing the staple 10L (10S) while suppressing an increase in the operation amount of the handle arm 70. Also, in the second process N2, the load F2 starts to increase at timing T2 at which the staple 10L (10S) starts to penetrate the sheets P. Thus, the second reduction rate D2 of the load F is made to gradually increase by the shape of the second zone 70*b*(2) of the shaft hole 70*b*, so that the load F is prevented from rapidly increasing.

After shearing the staple 10L (10S), the third reduction rate D3 of the load F is set in conformity to the third process N3 of enabling the staple 10L (10S) to penetrate the sheets P. In the third process N3 of enabling the staple 10L (10S) to penetrate the sheets P, the shaft hole 70*b* of the handle arm 70 is contacted to the shaft 70*a* in the third zone 70*b*(3).

At the state where the shaft hole 70*b* of the handle arm 70 is contacted to the shaft 70*a* in the third zone 70*b*(3), the fulcrum O that is the fulcrum of the rotating operation of the handle arm 70 is formed as the center of the arc of the third zone 70*b*(3) at the shaft 70*c*-side other than the middle point between the shaft 54*f* that is the rotating fulcrum of the driver arm 61 and the shaft 70*c* that is the connection part of the handle arm 70 and the driver arm 61, as shown in FIG. 44.

In the third process N3 of enabling the staple 10L (10S) to penetrate the sheets P, the shaft hole 70*b* of the handle arm 70 is contacted to the shaft 70*a* in the third zone 70*b*(3) and the fulcrum O is formed at the position shown in FIG. 44.

In the third process N3, when the length L1 from the force point E1 to the fulcrum O and the length L2 from the operating point E2 (shaft 70*c*) to the fulcrum O are set with the values shown in FIG. 44, the third reduction rate (boosting rate) D3 of the load F is about 75% from the equation (1). Thereafter, the reduction rate of the load is constant.

In the third process N3, the load F is increased at timing T3 at which the staple 10L (10S) penetrates the sheets P and at timing T4 at which the clutch is off by the operation of the slider 3 (which will be described later) and the maximum load Fmax3 is generated at timing T3 at which the staple 10L (10S) penetrates the sheets P. Hence, the third reduction rate D3 of the load F is set to be about 75% in conformity to the maximum load Fmax3.

Like this, since the load necessary for the operation is small at timing at which the sheets P are clamped, the reduction rate D of the load F is made to be small. At timing at which the staple 10L (10S) is sheared, the reduction rate D of the load F is made to be large so that the operational feeling is not deteriorated. At timing at which the staple 10L (10S) penetrates the sheets P, the reduction rate D of the load F is made to be larger because the load necessary for the operation is large. Thereby, it is possible to change the reduction rate of the load depending on the load necessary for the operation.

Therefore, it is possible to sufficiently reduce the load F in the process of enabling the staple 10L (10S) to penetrate the sheets P without increasing the operation amount of the handle arm 70 beyond necessity and to make the stapler 1A small. By implementing the boosting mechanism while suppressing the increase in the operation amount of the handle arm 70, the usability of a stapler that is used with being gripped by a hand is improved because even a woman having a small hand can fit the stapler into the hand. Also, a user can actually perform the driving operation with a desktop type stapler at a sitting natural posture.

Meanwhile, in the exemplary embodiment, the fulcrum of the rotating operation is moved at the handle arm 70-side. However, the driver arm 61 may be supported by a guide part having a predetermined shape and the driver 60 may be enabled to pass through a predetermined trajectory, so that the fulcrum of the rotating operation may be moved at the driver arm 61-side.

Subsequently, an operation of the front cover 72 is described. When the upper handle cover 71 is pressed, the gap between the upper handle cover 71 and the driver arm 61 is gradually narrowed. The front cover 72 is rotated relative to the handle arm 70 about the shaft part 72*a* serving as a fulcrum, as the upper handle cover 71, the handle arm 70 and the driver arm 61 are displaced.

In the meantime, as shown in FIG. 1, the driver arm 61 is rotated and slid about the guide convex part 61*d* serving as a fulcrum by the engaging of the recess portion 72*b* and the guide convex part 61*d*. When the displacement is made in the direction of narrowing the gap between the upper handle cover 71 and the driver arm 61, a distance between the shaft part 72*a* of the handle arm 70 and the guide convex part 61*d* of the driver arm 61 is shortened. Thereby, it is possible to enable the front cover 72 to follow the displacement of the gap between the upper handle cover 71 and the driver arm 61.

Also, the front cover 72 is engaged to the handle arm 70 by the shaft part 72*a*, so that it is not easily separated. Also, regarding the driver arm 61, the front cover is freely moved by the engaging of the recess portion 72*b* and the guide convex part 61*d* with respect to the displacement of the gap between the upper handle cover 71 and the driver arm 61 but is not easily separated. Thereby, it is prevented that only the front cover 72 is moved and any object is thus inserted into the gap between the upper handle cover 71 and the driver arm 61.

Figure 46:
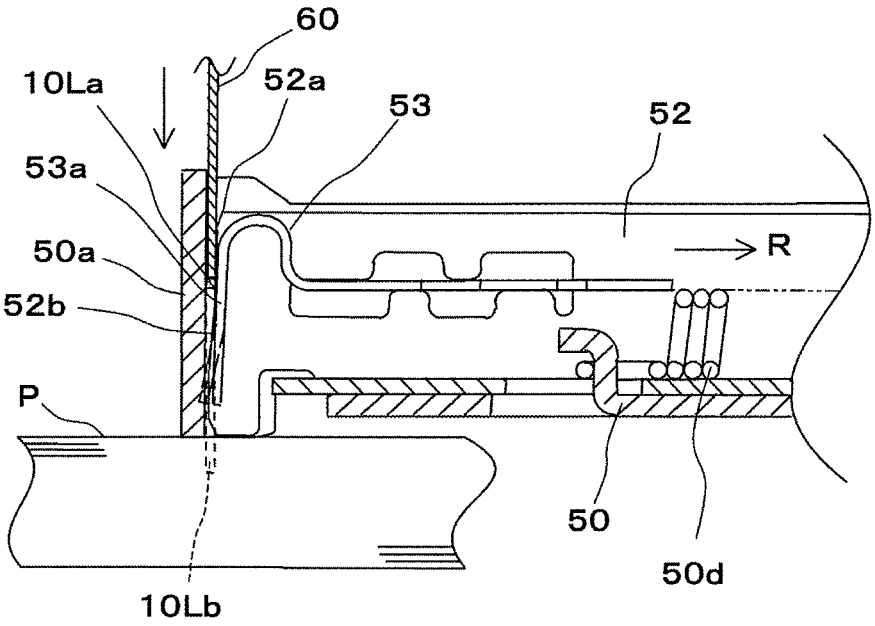
FIG. 46 illustrates an example of an operation of driving the staple in the stapler of the exemplary embodiment.
Figure 47A:
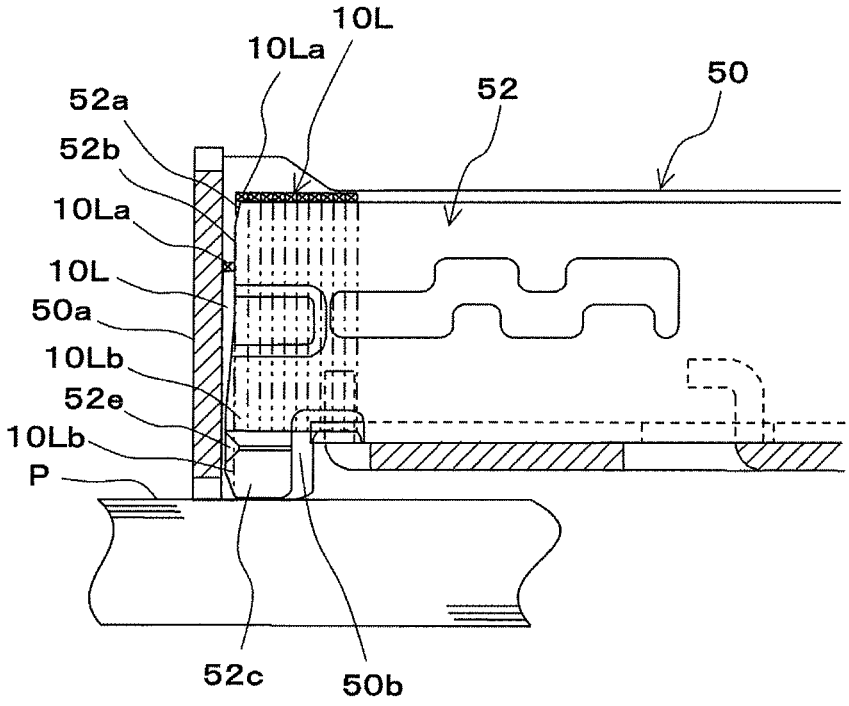
FIGS. 47(*a*) and 47(*b*) illustrate an example of an operation of driving the staple in the stapler of the exemplary embodiment.
Figure 47B:
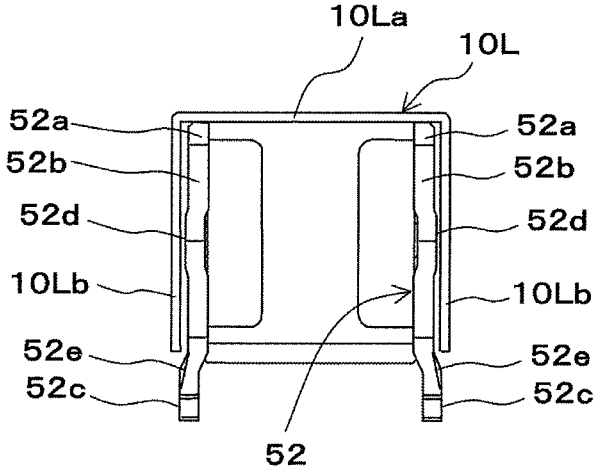
Figure 48A:
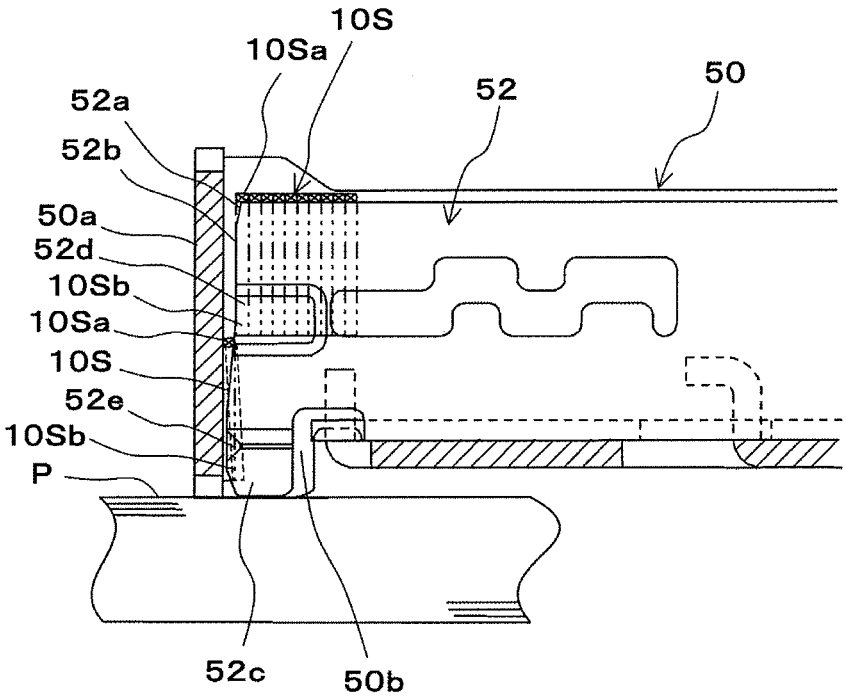
FIGS. 48(*a*) and 48(*b*) illustrate an example of an operation of driving the staple in the stapler of the exemplary embodiment.
Figure 48B:
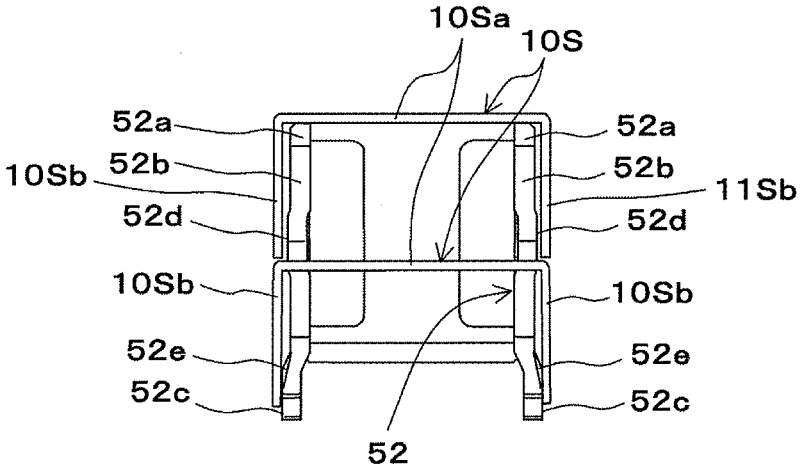

FIGS. 46 to 48 illustrate an example of an operation of driving the staple in the stapler of the exemplary embodiment. In the below, the operations of the magazine unit 5 and the driver unit 6, which are performed when driving the staple 10L or staple 10S, are described with reference to the respective drawings. FIGS. 46 and 47 illustrate an operation of driving the staple 10L having long legs and FIG. 48 illustrates an operation of driving the staple 10S having short legs.

At the early stage of pressing the handle arm 70 from the standby state, the magazine 50 does not contact the sheet P and the driver arm 61 and the magazine guide 51 are integrally rotated about the shaft 54*f* serving as a fulcrum.

When the sheets P are held between the clincher unit 2A and the magazine 50, the rotation of the magazine guide 51 is restrained and the handle arm 70 is further pressed, so that the driver arm 61 is rotated relative to the magazine guide 51.

When the driver arm 61 is rotated relative to the magazine guide 51, the driver 60 is pressed by the driver arm 61. In the configuration where the staple 10 having the long legs 10*b* as shown in FIG. 11(*a*) can be used, it is necessary to extend the stroke of the driver. Thus, in the configuration where the driver is fixed to the driver arm, as the driver arm 61 is rotated, the change in the angle of the driver relative to the magazine front wall 50*a* of the magazine 50 is increased.

To the contrary, the driver 60 is kept at a predetermined angle so that as the driver arm 61 is rotated, a position at which the pressing surface 61*a* of the driver arm 61 and the driver pressing part 60*c* of the driver 60 abut each other is changed and an angle of the driver 60 pressing the staple 10L or staple 10S conforms to the magazine front wall 50*a* of the magazine 50.

First, the operation of driving the staple 10L having long legs 10Lb, which is shown in FIGS. 46 and 47, is described. When the staples 10L loaded in the magazine 50 are pressed by the driver 60, the one head staple of the staples 10L is positioned on the gap formed by the shear guide parts 52*a* shown in FIG. 25 and the second staple and thereafter of the staples are supported on the upper surface of the staple guide 52. Thus, the first staple 10L is applied with the shear force and is thus separated.

The one separated staple 10L that is pressed by the driver 60 is introduced from the gap between the magazine front wall 50*a* and the shear guide parts 52*a* to the gap between the magazine front wall 50*a* and the pressing guide parts 52*b*.

As described above, in the magazine 50, the staple guide 52 is pressed forward by the coil spring 50*d* and the magazine lock spring 54*c*, and the first width guide part 52*c* of the staple guide 52 abuts on the magazine front wall 50*a* except for the process of driving the staple 10.

The pressing guide parts 52*b* are configured so that the gap t2 between the magazine front wall 50*a* and the pressing guide part is slightly narrower than the line width of the one staple 10 at the state where the first width guide parts 52*c* abut on the magazine front wall 50*a*.

Thereby, the one separated staple 10L pressed by the driver 60 presses the pressing guide parts 52*b* at both ends of the staple crown 10La and thus elastically deforms the coil spring 50*d* in an extending direction and elastically deforms the magazine coil spring 54*c* in a compressing direction, thereby retreating the staple guide 52 in an arrow R direction.

By retreating the staple guide 52, the staple 10L between the pressing guide parts 52*b* and the magazine front wall 50*a* is pressed toward the magazine front wall 50*a* as both ends of the staple crown 10La is pressed with the pressing guide parts 52*b*.

In order to separate and drive one staple by the pressing of the driver, it is necessary to form a gap wider than the line width of one staple between the leading end of the staple guide and the magazine front wall. In a zone in which a gap between the leading end of the staple guide and the magazine front wall is wider than the line width of one staple, the staple crown of the staple may move forward and rearward.

Hence, a posture of the staple may be changed before the leading ends of the legs of the staple land on and penetrate the sheets. Also, for a staple having long legs, even after the leading ends of the legs of the staple land on and penetrate the sheets, there is a possibility that there is a staple crown in a zone in which a gap between the leading end of the staple guide and the magazine front wall is wider than the line width of one staple and a posture of the staple will be thus changed.

In the exemplary embodiment, the leading end of the staple guide 52 is provided with the shear guide parts 52*a* and the pressing guide parts 52*b*. Hence, it is possible to separate one staple 10L by the shear guide parts 52*a* and to guide the staple crown 10La of the one separated staple 10L by the pressing guide parts 52*b*.

Regarding the staple 10L passing between the pressing guide parts 52*b* and the magazine front wall 50*a*, since both ends of the staple crown 10La are pressed to the magazine front wall 50*a* by the pressing guide parts 52*b*, a gap is not caused in which the staple crown 10La of the staple 10L can move forward and rearward.

Also, as described above, the shape of the shear guide parts 52*a* is set so that when the staple 10L having long legs 10Lb is used, the staple crown 10La is guided by the pressing guide parts 52*b* before the leading ends of the legs 10Lb reach the sheet.

Thereby, it is possible to prevent a posture of the staple 10L from being changed before the leading ends of the legs 10Lb of the staple 10L land on and penetrate the sheets. Also, even for the staple 10L having long legs 10Lb, before the leading ends of the legs 10Lb of the staple 10L land on and penetrate the sheets P, the staple crown 10La gets out of the shear guide parts 52*a* and is guided by the pressing guide parts 52*b*. Hence, it is possible to prevent a posture of the staple 10L from being changed during the penetration of the legs 10Lb.

Regarding the staple 10L in the zone in which the staple crown 10La is guided by the pressing guide parts 52*b*, since the interval of two legs 10Lb is guided by the first width guide parts 52*c*, it is possible to set the left and right guides as the first width guide parts 52*c*.

When the staple crown 10*a* passes through the pressing guide parts 52*b*, the staple guide 52 is further retreated, so that the staple 10L pressed by the driver 60 enters the gap formed between the first width guide parts 52*c* and the magazine front wall 50*a*. Regarding the staple 10L in a zone where the staple crown 10La is guided between the first width guide parts 52*c* and the magazine front wall 50*a*, since the legs 10Lb penetrate the sheets P, it is possible to prevent a posture of the staple from being changed even without the guide in the width direction by the first width guide parts 52*c*.

Although the detailed operation of the staple holder 53 is described later, the staple 10L in the zone where the staple crown 10La is guided by the pressing guide parts 52*b* and the staple 10L in the zone where the staple crown 10La is guided between the width guide parts 52*c* and the magazine front wall 50*a* are applied with the force by the staple crown guide part 53*a* of the staple holder 53 in the direction of pushing up the staple crown 10La by the protrusion 53*d*. Thereby, it is possible to prevent the central portion of the staple crown 10La from being bent downward due to the pressing of the driver 60.

Subsequently, the operation of driving the staple 10S having short legs 10Sb shown in FIG. 48 is described. When the staples 10S having short legs 10Sb are loaded in the magazine 50, the inner sides of the leading ends of the legs 10Sb abut on the second width guide parts 52*d* and the legs 10Sb of the staple 10S are guided in the width direction.

When the staples 10S loaded in the magazine 50 are pressed by the driver 60, the one head of the staples 10S is positioned on the gap formed by the shear guide parts 52*a*, which is shown in FIG. 25, and the second staple and thereafter of the staples are supported on the upper surface of the staple guide 52, like the staples 10L having long legs. Thus, the first staple 10 is applied with the shear force and is thus separated.

The one separated staple 10S that is pressed by the driver 60 presses the pressing guide part 52*b* at both left and right end sides of the staple crown 10Sa, elastically deforms the coil spring 50*d* in an extending direction and elastically deforms the magazine coil spring 54*c* in a compressing direction, thereby retreating the staple guide 52 in an arrow R direction.

Thereby, the one separated staple 10S that is pressed by the driver 60 retreats the staple guide 52 to thus enter the gap between the magazine front wall 50*a* and the pressing guide part 52*b* from the gap between the magazine front wall 50*a* and the shear guide part 52*a*.

By retreating the staple guide 52, the staple 10S entering between the pressing guide parts 52*b* and the magazine front wall 50*a* is pressed at both ends of the staple crown 10Sa toward the magazine front wall 50*a* by the coil spring 50*d* and the magazine lock spring 54*c*, which are the urging means.

Thereby, even for the staple 10S having short legs 10Sb, the staple crown 10Sa passes between the pressing guide part 52*b* and the magazine front wall 50*a*. The staple crown 10Sa of the one separated staple 10S in the zone in which it is guided by the pressing guide part 52*b* is prevented from moving in the front-rear direction.

As shown in FIGS. 47 and 48, in the magazine unit 5, when the staples 10L or staples 10S are loaded in the magazine 50, the staple crown 10La of the staple 10L or staple crown 10Sa of the staple 10S are put on the staple guide 52.

As shown in FIG. 47, the magazine 50 has a size in the height direction, which is set so that the staple 10L having long legs 10Lb can be loaded. As shown in FIG. 48, when the staples 10S having short legs 10Sb are loaded, a distance between the lower ends of the legs 10Sb and the opening 50*b* of the magazine 50 is lengthened.

Therefore, when the staples 10S having short legs 10Sb loaded in the magazine 50 are separated one by one and driven, the staple crown 10Sa of the preceding staple 10S gets out of the leading ends of the legs 10Sb of the subsequent staple 10S before the leading ends of the legs 10Sb of the one separated preceding staple 10S land on the sheet P.

The staples 10L or staples 10S loaded in the magazine 50 are pressed toward the magazine front wall 50*a* by the pusher 55. As shown in FIG. 47(*a*), for the staple 10L having long legs 10Lb, at a stage where the leading ends of the legs 10Lb of the one separated preceding staple 10L land on the sheet P and start to penetrate the sheets P, the staple crown 10La of the preceding staple 10L does not get out of the leading ends of the legs 10Lb of the subsequent staple 10L.

Thereby, for the staple 10L having long legs 10Lb, at the stage where the leading ends of the legs 10Lb of the one separated preceding staple 10L start to penetrate the sheets P, the one separated preceding staple 10L is pressed toward the magazine front wall 50*a* by the subsequent staple 10L pressed by the pusher 55 or by the pusher 55. Hence, for the staple 10L having long legs 10Lb, it is possible to prevent the posture of the staple 10L from being changed before the legs 10Lb start to penetrate the sheets.

In the meantime, as shown in FIG. 48, for the staple 10S having short legs 10Sb, before the leading ends of the legs 10Sb of the one separated preceding staple 10S land on the sheet P, the staple crown 10Sa of the one separated preceding staple 10S gets out of the leading ends of the legs 10Sb of the subsequent staple 10S.

When the staple crown 10Sa of the one separated preceding staple 10S gets out of the leading ends of the legs 10Sb of the subsequent staple 10S, the subsequent staple 10S is advanced up to the magazine front wall 50*a* and the preceding staple 10S is not applied with the pressing force of the pusher 55.

Therefore, for the staple 10S having short legs 10Sb, before the leading ends of the legs 10Sb of the one separated preceding staple 10S land on the sheet P, the preceding staple 10S is not applied with the pressing force of the pusher 55.

Thereby, when the staples 10S having short legs 10Sb are loaded in the magazine 50, the leading ends of the legs 10Sb may flow rearward before the leading ends land on the sheet, as the one separated staple 10S is driven.

For the staple 10S having short legs 10Sb, the leading ends of the legs 10Sb of the preceding staple 10S reach the position at which they abut on the first width guide parts 52*c*, at the stage where the staple crown 10Sa of the one separated preceding staple 10S gets out of the leading ends of the legs 10Sb of the subsequent staple 10S.

As described above, the outer size of the pair of first width guide parts 52*c* is the substantially same as or slightly wider than the outer size of the staple crown 10Sa of the staple 10S. Hence, when the leading ends of the legs 10Sb of the one separated staple 10S flow rearward before they land on the sheet, the legs 10Sb collide with the leg guide parts 52*e*.

The staple crown 10Sa of the one separated staple 10S enters between the pressing guide part 52*b* and the magazine front wall 50*a*, so that the staple guide 52 is retreated. However, the shape of the leg guide parts 52*e* is set so that the legs 10Sb of the one separated staple 10S abut on the leg guide parts 52*e*.

The leg guide parts 52*e* are inclined in the direction along which the outer sizes of the pair of left and right first width guide parts 52*c* are gradually narrowed toward the front end side. As the staple 10S is driven, the legs 10Sb abutting on the leg guide parts 52*e* are applied with the force of moving the same toward the front end sides of the first width guide parts 52*c* and are thus guided toward the magazine front wall 50*a*.

Thereby, for the staple 10S having short legs 10Sb, before the leading ends of the legs 10Sb of the one separated preceding staple 10S land on the sheet P, even though the preceding staple 10S is not applied with the pressing force of the pusher 55, it is possible to prevent the posture of the staple 10S from being changed before the legs 10Sb start to penetrate the sheet. Hence, it is possible to prevent the legs 10Sb of the staple 10S having penetrated the sheets P from deviating from the clinchers 20L, 20R of the clincher unit 2A and to thus suppress the binding defect from occurring.

Figure 49A:
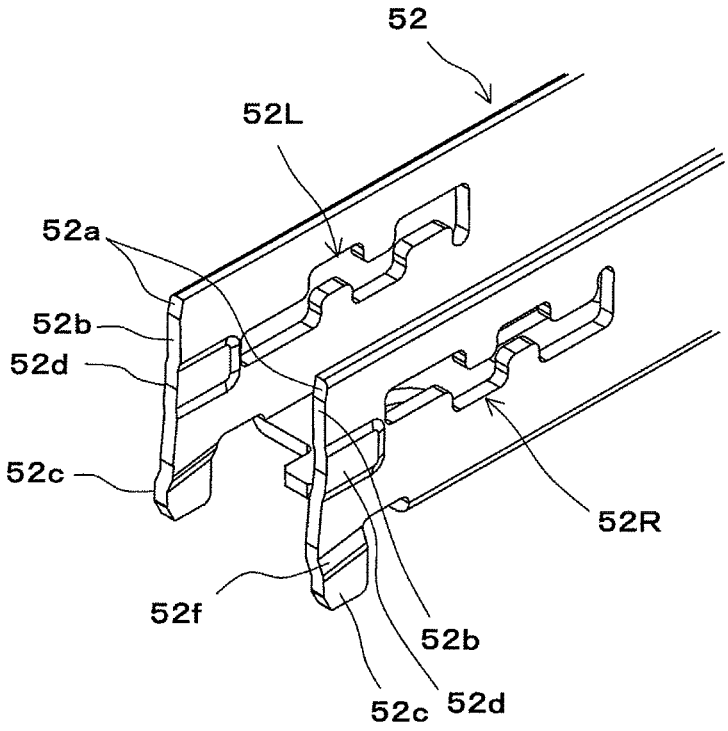
FIGS. 49(*a*) and 49(*b*) are perspective views showing a modified embodiment of a leg guide part of the exemplary embodiment.
Figure 49B:
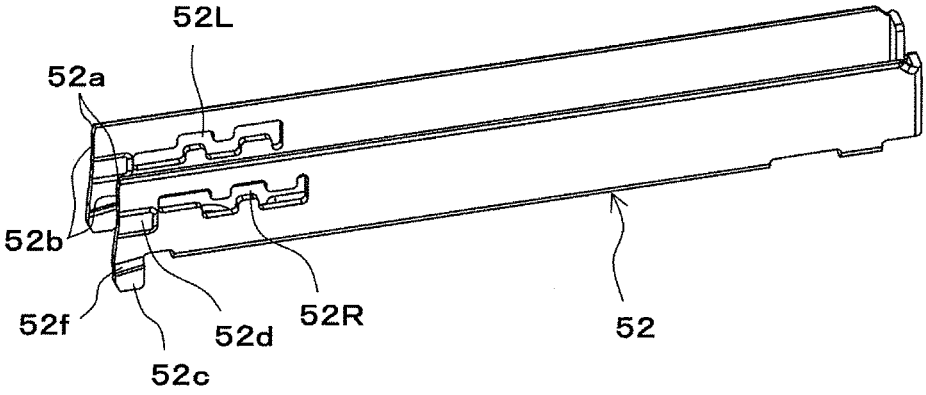

FIG. 49 is a perspective view of the staple guide showing a modified embodiment of the leg guide part of the exemplary embodiment. In the below, the modified embodiment of the leg guide part is described. Here, the configuration of the staple guide 52 except for the leg guide part may be the same as that of the exemplary embodiment shown in FIG. 24 and is described with being denoted by the same reference numerals.

In the modified embodiment, leg guide parts 52*f* are an example of the leg guide means and guide the legs 10Sb of the one separated staple 10S having short legs toward the magazine front wall 50*a* shown in FIG. 25 and the like, as the staple 10S is driven by the driver unit 6.

In this example, the leg guide parts 52*f* are provided to the first width guide parts 52*c* of the staple guide 52. The leg guide parts 52*f* are formed by configuring the inclined surfaces between the first width guide parts 52*c* of the staple guide 52 protruding in the left-right direction and the staple guide 52 as inclined surfaces that are inclined downward towards the front end side.

When the legs 10Sb of the staple 10S abut on the leg guide parts 52*f*, the legs 10Sb are applied with the force of moving the same toward the front end sides of the first width guide parts 52*c* by the inclinations of the leg guide parts 52*f*, as the staple 10S is driven, so that the legs 10Sb are guided toward the magazine front wall 50*a*.

Thereby, when the staples 10S having short legs are loaded in the magazine 50, even though the leading ends of the legs 10Sb flow rearward before they land on the sheet, the legs 10Sb are guided toward the magazine front wall 50*a* by the inclinations of the leg guide parts 52*f*, as the staple 10S is driven. Therefore, it is possible to prevent the posture of the staple 10S from being changed before the legs 10Sb start to penetrate the sheets.

Figure 50A:
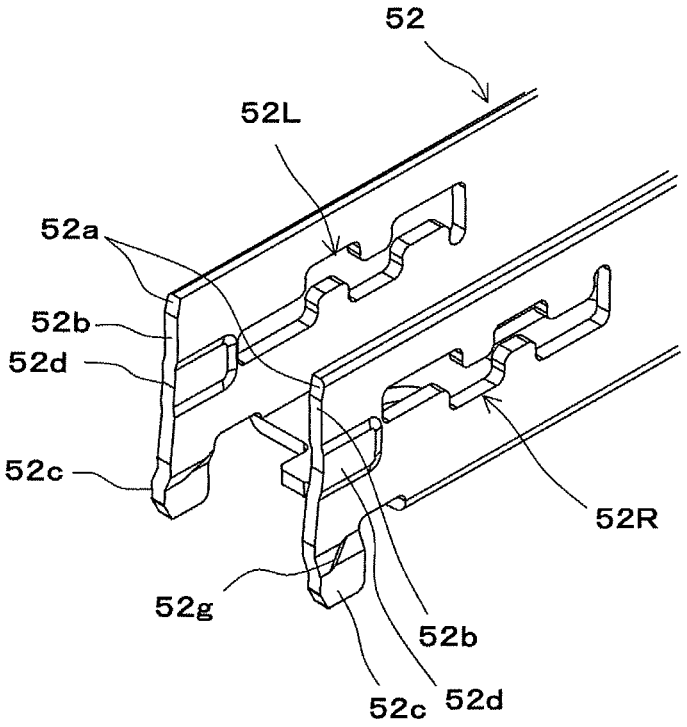
FIGS. 50(*a*) and 50(*b*) are perspective views showing a modified embodiment of the leg guide part of the exemplary embodiment.
Figure 50B:
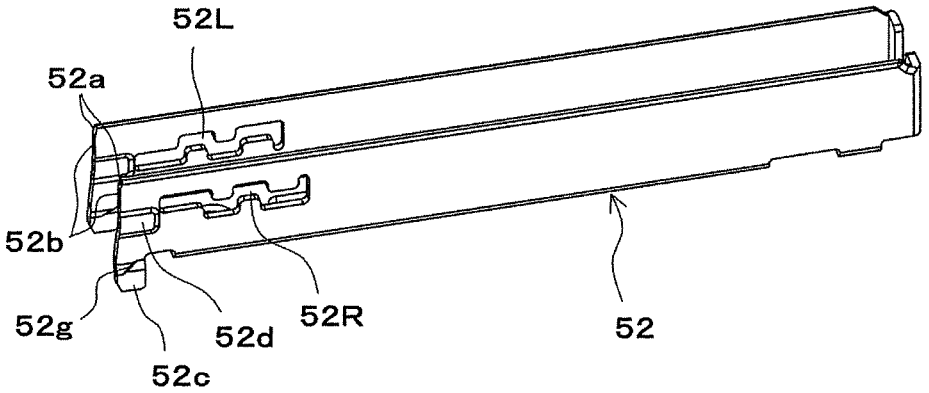

FIG. 50 is a perspective view of the staple guide showing another modified embodiment of the leg guide part of the exemplary embodiment.

In another modified embodiment, leg guide parts 52*g* are an example of the leg guide means and guide the legs 10Sb of the one separated staple 10S having short legs toward the magazine front wall 50*a* shown in FIG. 25 and the like, accompanied by the driving of the staple 10S by the driver unit 6.

In this example, the leg guide parts 52*g* are provided to the first width guide parts 52*c* of the staple guide 52. The leg guide parts 52*g* are configured by providing the inclined surfaces formed between the first width guide parts 52*c* of the staple guide 52 protruding in the left-right direction and the staple guide 52 with steps in which a front end side is more lowered than a rear end side and providing the steps with inclined surfaces that are inclined downward towards the front end side.

When the legs 10Sb of the staple 10S abut on the leg guide parts 52*g*, the legs 10Sb are applied with the force of moving the same toward the front end sides of the first width guide parts 52*c* by the inclinations of the leg guide parts 52*g*, accompanied by the driving of the staple 10S, so that the legs 10Sb are guided toward the magazine front wall 50*a*.

Thereby, when the staples 10S having short legs are loaded in the magazine 50, even though the leading ends of the legs 10Sb flow rearward before they land on the sheet, the legs 10Sb are guided toward the magazine front wall 50*a* by the inclined surfaces of the leg guide parts 52*g*, accompanied by the driving of the staple 10S. Therefore, it is possible to prevent the posture of the staple 10S from being changed before the legs 10Sb start to penetrate the sheets.

Figure 51:
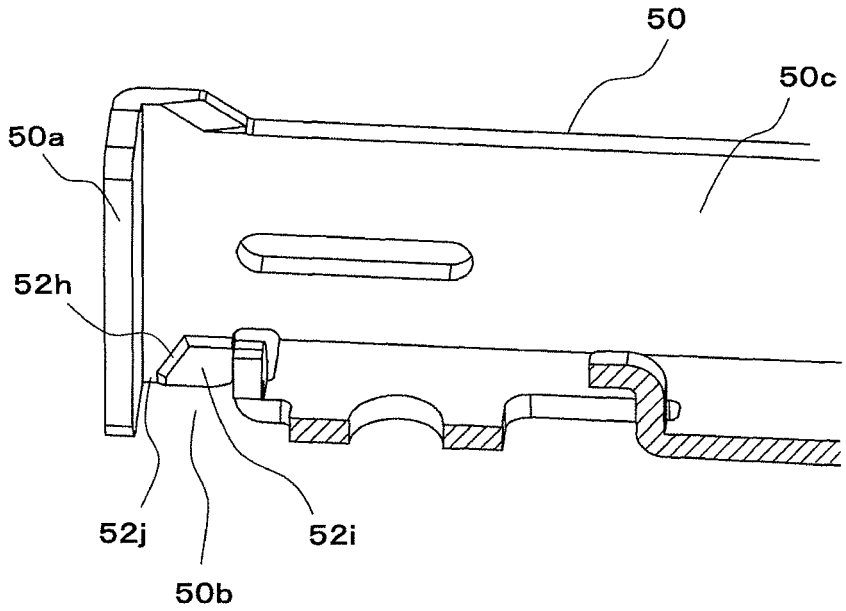
FIG. 51 is a perspective view showing a modified embodiment of the leg guide part of the exemplary embodiment.

FIG. 51 is a broken perspective view of the magazine showing another modified embodiment of the leg guide part of the exemplary embodiment.

In another modified embodiment, leg guide parts 52*h* are an example of the leg guide means and guide the legs 10Sb of the one separated staple 10S having short legs toward the magazine front wall 50*a* shown in FIG. 25 and the like, accompanied by the driving of the staple 10S by the driver unit 6.

In this example, the leg guide parts 52*h* are provided to the magazine 50. The magazine 50 is provided with convex parts 52*i* having a protruding height abutting on the outer sides of the legs 10Sb of the staple 10S or legs 10Lb of the staple 10L on the inner surfaces of the left and right magazine sidewalls 50*c* facing the opening 50*b*.

The magazine 50 is formed with the leg guide parts 52*h* by providing inclined surfaces, which are inclined downward towards the magazine front wall 50*a*, between the convex parts 52*i* protruding inward from the magazine sidewalls 50*a* and the magazine sidewalls 50*c*. Also, the magazine 50 is formed with guide recess portions 52*j* by the magazine sidewalls 50*c* between lower ends of the leg guide parts 52*h* and the magazine front wall 50*a*. The guide recess portion 52*j* is configured to be substantially equivalent to the line width of the leg 10Sb of the staple 10S or the leg 10Lb of the staple 10L.

When the legs 10Sb of the staple 10 abut on the leg guide parts 52*h*, the legs 10Sb are applied with the force of moving the same toward the magazine front wall 50*a* by the inclinations of the leg guide parts 52*h*, accompanied by the driving of the staple 10S, so that the legs 10Sb are guided toward the magazine front wall 50*a* and enter the guide recess portions 52*j*.

Thereby, when the staples 10S having short legs are loaded in the magazine 50, even though the leading ends of the legs 10Sb flow rearward before they land on the sheet, the legs 10Sb are guided toward the magazine front wall 50*a* by the inclined surfaces of the leg guide parts 52*h*, accompanied by the driving of the staple 10S. Therefore, it is possible to prevent the posture of the staple 10S from being changed before the legs 10Sb start to penetrate the sheets.

Figure 54:
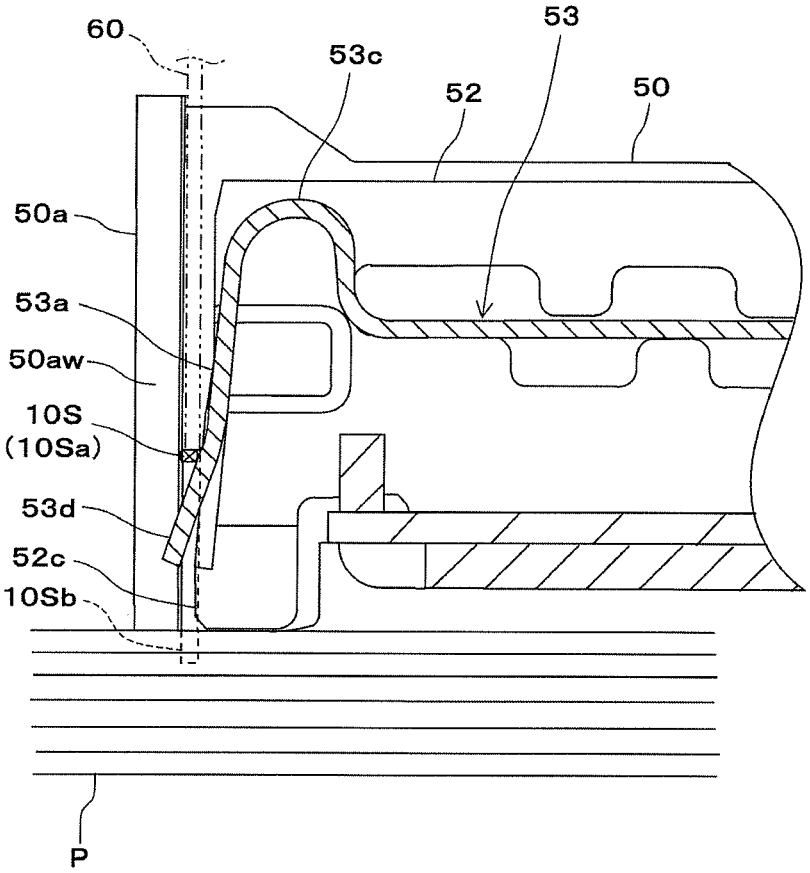
FIG. 54 illustrates an example of an operation of the staple holder in the stapler of the exemplary embodiment.
Figure 55:
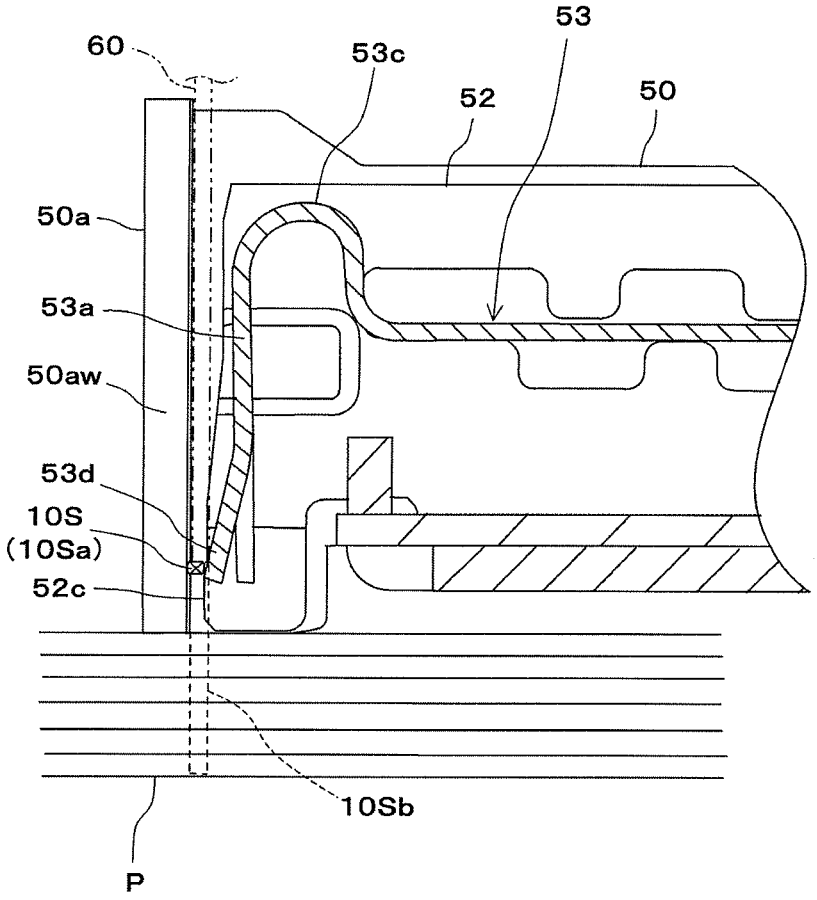
FIG. 55 illustrates an example of an operation of the staple holder in the stapler of the exemplary embodiment.
Figure 56:
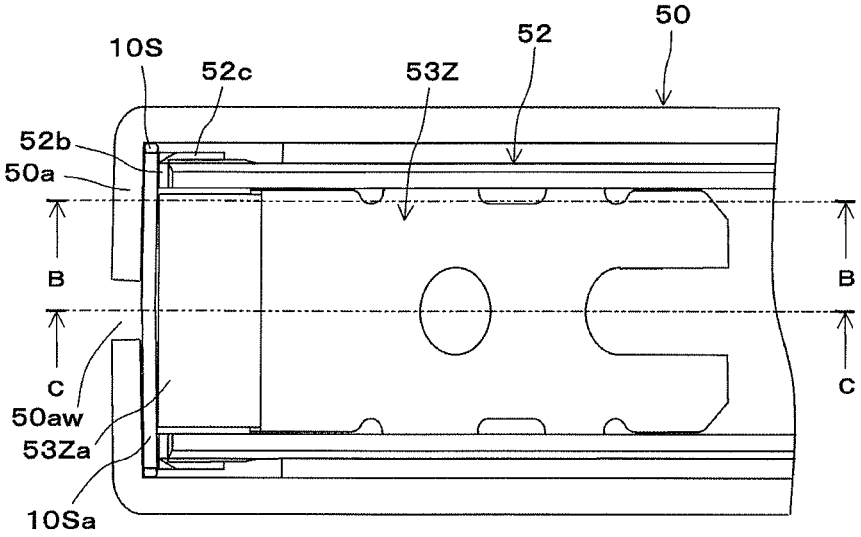
FIG. 56 illustrates an example of an operation of a staple holder in a stapler of the related art.
Figure 57:
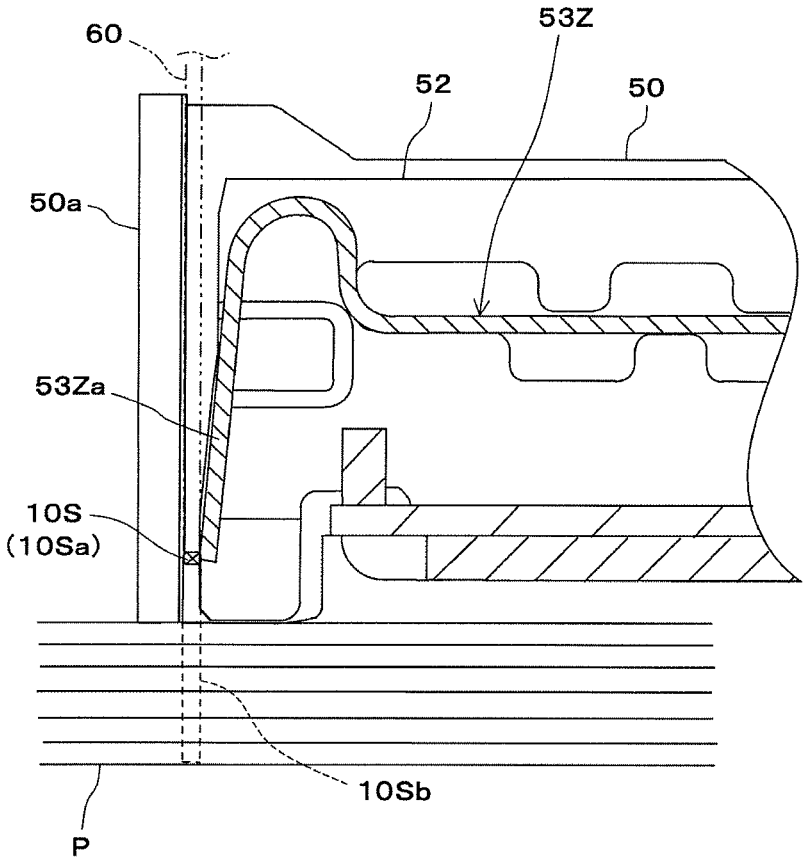
FIG. 57 illustrates an example of an operation of the staple holder in the stapler of the related art.
Figure 58:
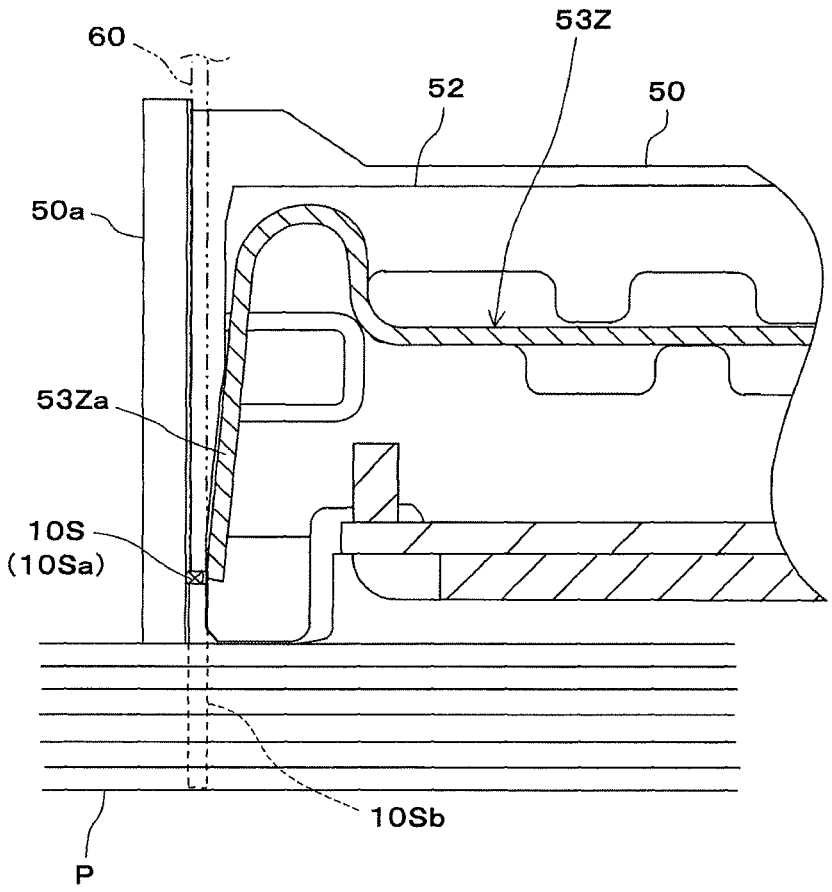
FIG. 58 illustrates an example of an operation of the staple holder in the stapler of the related art.

FIGS. 52 to 55 illustrate an example of an operation of the staple holder in the stapler of the exemplary embodiment and FIGS. 56 to 58 illustrate an example of an operation of a staple holder in a stapler of the related art. In the below, operations of the staple holder 53 having the protrusion 53*d* of the exemplary embodiment and a staple holder 53Z having no protrusion are described with reference to the respective drawings.

Figure 52:
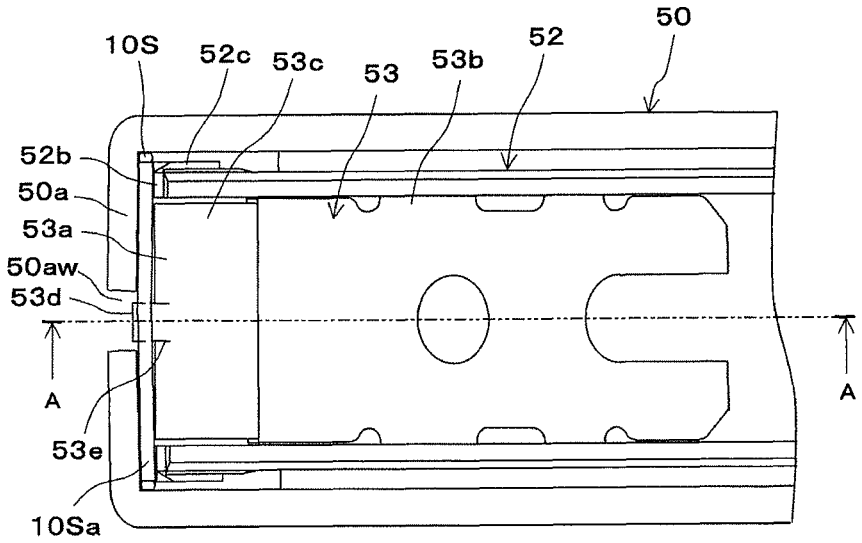
FIG. 52 illustrates an example of an operation of the staple holder in the stapler of the exemplary embodiment.
Figure 53:
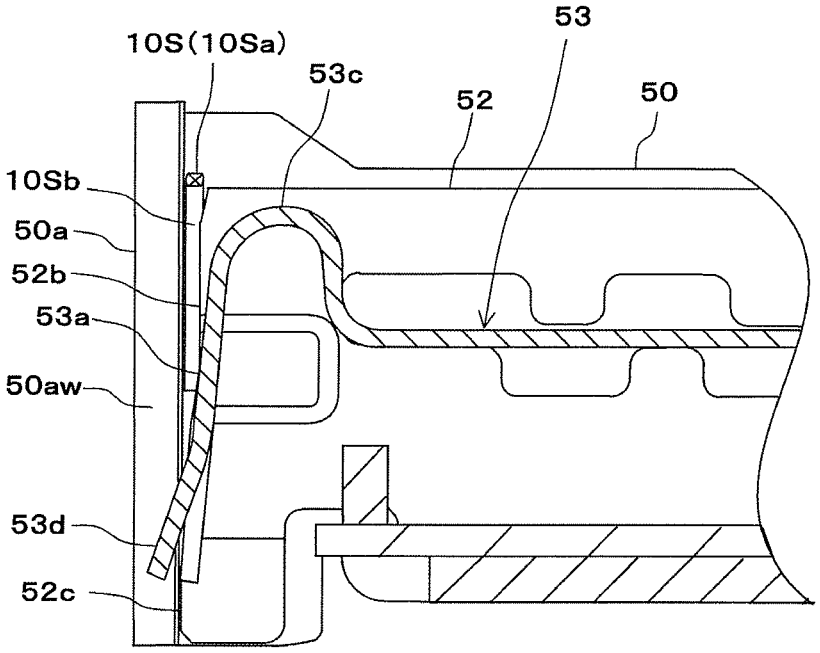
FIG. 53 illustrates an example of an operation of the staple holder in the stapler of the exemplary embodiment.

Here, FIG. 52 is a plan view during the driving of the staple, FIG. 53 is a side sectional view at the standby state, FIG. 54 is a side sectional view at a state where the staple is penetrating the sheets and FIG. 55 is a side sectional view at a state just before the staple has penetrated the sheets.

Also, FIG. 56 is a plan view during the driving of the staple, FIG. 57 is a sectional view taken along a line B-B of FIG. 56 showing states of the staple crown and the staple holder at an end portion of the staple crown and FIG. 58 is a sectional view taken along a line C-C of FIG. 56 showing states of the staple crown and the staple holder at the central portion of the staple crown.

As described above, the magazine front walls 50*a* of the magazine 50 are configured by bending inward the leading end sides of the side plates configuring the magazine sidewalls 50*c*, so that a recess portion 50*a* w of the pair of left and right magazine front walls 50*a* may have an open shape as if it protrudes forward, as shown in FIGS. 52 and 56.

As shown in FIG. 33, for the staple 10S (10L), the just above parts of the pair of legs 10Sb (10Lb) are pressed by the pressing part 60*d* of the driver 60. In this example, the parts at which the staple 10S (10L) and the driver 60 abut each other are configured with the inclined surfaces and the pair of legs 10Sb (10Lb) is applied with the force in the direction of penetrating the sheets P. In the meantime, the staple crown 10Sa (10La) is also applied with the force in the direction of pressing inward the same from both end sides in the longitudinal direction.

Thereby, when the recess portion 50*a* w of the magazine front walls 50*a* has the open shape, while the staple crown 10Sa is pressed inward from both end sides in the longitudinal direction and the staple 10S is thus driven, the staple crown 10Sa may be curved in a direction along which the central portion thereof in the longitudinal direction protrudes forward, as shown in FIGS. 52 and 56. Although not shown in FIGS. 52 and 56, the staple 10L having long legs is also the same.

First, an operation of the conventional configuration where the staple holder 53Z is not provided with a protrusion is described. When the staple crown 10Sa is curved in the direction along which the central portion thereof in the longitudinal direction protrudes forward, the staple crown 10Sa abuts on a staple crown guide part 53Za of the staple holder 53Z at end portion sides of the staple crown 10Sa, while the one separated staple 10S is pressed to enable the legs 10Sb to penetrate the sheets P, as shown in FIG. 57.

However, as shown in FIG. 58, the staple crown 10Sa does not abut on the staple crown guide part 53Za of the staple holder 53Z in the vicinity of the central portion of the staple crown 10Sa. Thereby, while the staple 10S is driven, it is not possible to support the vicinity of the central portion of the staple crown 10Sa in the longitudinal direction and it is not possible to suppress the deformation of the staple crown 10Sa, so that a buckling may occur.

Subsequently, an operation of the configuration of the exemplary embodiment where the staple holder 53 is provided with the protrusion 53*d* is described. At the standby state shown in FIG. 53, the one head staple of the staples 10S is not separated and the staple crown 10Sa of the staple 10S does not reach the protrusion 53*d* of the staple holder 53.

As described above, when the staples 10S are pressed by the pressing part 60*d* of the driver 60 and are thus separated one by one and driven, the legs 10Sb of the staple 10S start to penetrate the sheets P and the staple crown 10Sa reaches the protrusion 53*d* of the staple holder 53, as shown in FIG. 54.

When the staple 10S is further pressed by the driver 60, the protrusion 53*d* is pressed by the staple crown 10Sa of the staple 10S, accompanied by the driving of the one separated staple 10S. In the staple holder 53, when the protrusion 53*d* is pressed, the staple crown guide part 53*a* is displaced in the retreating direction mainly by the elastic deformation of the spring part 53*c* and the protrusion 53*d* is retreated by the displacement of the staple crown guide part 53*a*.

Accompanied by the driving of the one separated staple 10S, the central portion of the staple crown 10Sa of the staple 10S in the longitudinal direction abuts on the protrusion 53*d* of the staple holder 53.

Thereby, while the one separated staple 10S is pressed by the driver 60 and the legs 10Sb are thus enabled to penetrate the sheets P, the vicinity of the central portion of the staple crown 10Sa of the staple 10S in the longitudinal direction is supported from the lower side thereof by the protrusion 53*d* that intends to deform in the pushing-up direction by the restoring force of the spring part 53*c*.

As described above, while the staple 10S is driven, the staple crown 10Sa is applied with the force in the direction of pressing inward the same from both end sides in the longitudinal direction, so that the staple crown 10Sa is applied with the force of bending downward the central portion thereof in the longitudinal direction. On the other hand, the vicinity of the central portion of the staple crown 10Sa of the staple 10S in the longitudinal direction is supported from the lower side thereof by the protrusion 53*d*, so that it is possible to suppress the deformation of the staple crown 10Sa. Therefore, it is possible to suppress a so-called M-shaped buckling in which the vicinity of the central portion of the staple crown 10Sa is bent downward.

Accompanied by the driving of the one separated staple 10S, the gap through which the staple crown 10Sa of the one separated staple 10S passes is formed between the protrusion 53*d* and the magazine front wall 50*a*. For the staple 10S having short legs, as shown in FIG. 55, the staple crown 10Sa gets out of the leading end of the protrusion 53*d* at timing at which the leading ends of the legs 10Sb of the staple 10S penetrate the sheets P. In the meantime, the staple 10S having short legs has been exemplified in the above descriptions. However, it is also possible to obtain the same effects for the staple 10L having long legs.

Figure 59:
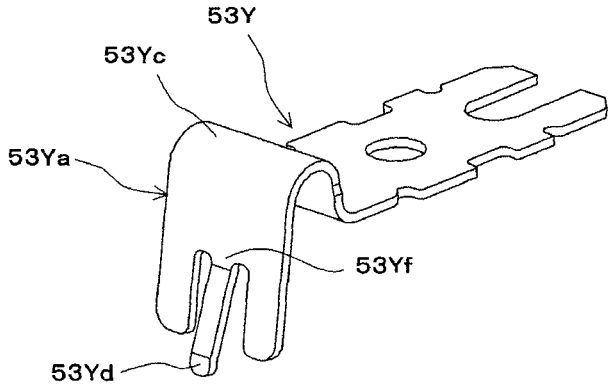
FIG. 59 is a perspective view showing an example of a staple holder having a conventional elastic claw.

FIG. 59 is a perspective view showing an example of the staple holder having a conventional elastic claw. In the below, operations of the staple holder 53 of the exemplary embodiment where the protrusion 53*d* is provided with the connection parts 53*e* and a staple holder 53Y having a conventional elastic claw 53Yd where the connection part is not provided are described.

The conventional staple holder 53Y shown in FIG. 59 is provided with an elastic claw 53Yd that protrudes forward from a staple crown guide part 53Ya. However, gaps are formed between side surfaces of the elastic claw 53Yd and the staple crown guide part 53Ya and a configuration corresponding to the connection part is not provided.

Figure 60:
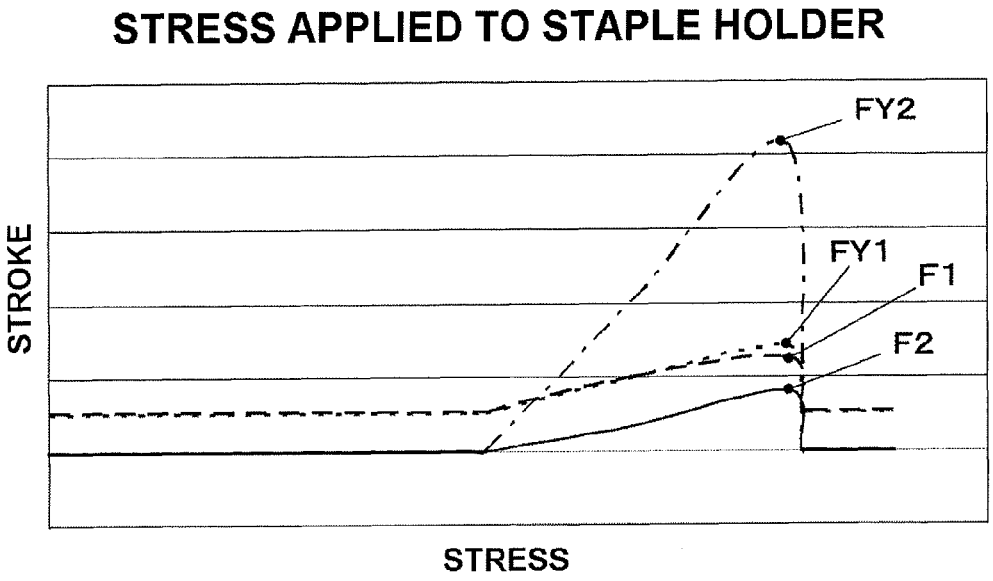
FIG. 60 is a graph showing stress that is applied to the staple holder of the exemplary embodiment and to the staple holder of the related art.

FIG. 60 is a graph showing stress that is applied to the staple holder of the exemplary embodiment and the staple holder of the related art. In the conventional staple holder 53Y as shown in FIG. 59, when the elastic claw 53Yd is pressed as the staple 10L, 10S is driven, stress FY2 that is applied to a base end portion 53Yf of the elastic claw 53Yd is higher than stress FY1 that is applied to a spring part 53Yc and displaces the entire staple crown guide part 53Ya.

In the stapler, the staple is driven, so that stress is repeatedly applied to the staple holder. In the conventional staple holder 53Y, the elastic claw 53Yd is more repeatedly displaced than the staple crown guide part 53Ya, so that the durability of the elastic claw 53Yd is lowered.

Compared to this, in the staple holder 53 of the exemplary embodiment, the load that is applied to the protrusion 53*d* is transmitted to the staple crown guide part 53*a* by the connection parts 53*e* and the protrusion 53*d* is retreated by the displacement of the staple crown guide part 53*a* due to the elastic deformation of the spring part 53*c*.

Thereby, in the staple holder 53 of the exemplary embodiment, as shown in FIG. 60, stress F2 that is applied to the base end portion 53*f* of the protrusion 53*d* is lower than stress F1 that is applied to the spring part 53*c* and displaces the entire staple crown guide part 53*a*.

Therefore, in the staple holder 53 of the exemplary embodiment where the connection parts 53*e* are provided, the staple crown guide part 53*a* is more repeatedly displaced than the protrusion 53*d* and the displacement due to the elastic deformation of the protrusion 53*d* is suppressed, so that the load to be applied to the protrusion 53*d* is reduced. Hence, the durability is improved.

Figure 61:
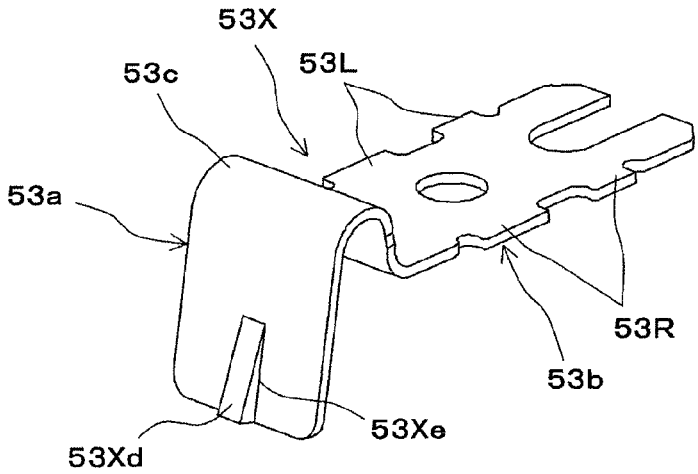
FIG. 61 is a perspective view showing a modified embodiment of the staple holder of the exemplary embodiment.
Figure 62A:
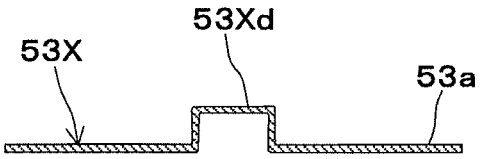
FIGS. 62(*a*) and 62(*b*) are sectional views showing a modified embodiment of the staple holder of the exemplary embodiment.
Figure 62B:
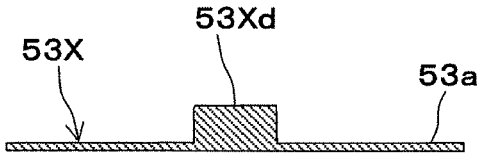

FIG. 61 is a perspective view showing a modified embodiment of the staple holder of the exemplary embodiment and FIG. 62 is a sectional view showing a modified embodiment of the staple holder of the exemplary embodiment. In a staple holder 53X of the modified embodiment, the same configurations as those of the staple holder 53 described in FIG. 26 and the like are described with being denoted by the same reference numerals.

The staple holder 53X of the modified embodiment is made of an elastic material, in this example, a metal plate material having elasticity and has a protrusion 53Xd that supports the vicinity of the central portion of the staple crown 10La of the staple 10L in the longitudinal direction thereof or the vicinity of the central portion of the staple crown 10Sa of the staple 10S in the longitudinal direction thereof, from a lower side thereof, as the staple 10L or staple 10S described in FIG. 11 and the like is driven.

The protrusion 53Xd protrudes forward from the vicinity of the central portion of the staple crown guide part 53*a* along the driving direction of the staple 10L or staple 10S toward the lower end side of the staple crown guide part 53*a*.

The protrusion 53Xd of the modified embodiment is configured by providing a convex part having a rectangular section to the vicinity of the central portion of the staple crown guide part 53*a* in the width direction. As shown in FIG. 62(*a*), the protrusion 53Xd may have a configuration where the front and back have an unevenness shape by press processing and the like. Alternatively, as shown in FIG. 62(*b*), the protrusion 53Xd may be configured by a solid convex part.

The staple holder 53X has connection parts 53Xe that transmit the load to be applied to the protrusion 53Xd to the staple crown guide part 53*a*. The connection parts 53Xe are configured by integrating side surfaces of the protrusion 53Xd with the staple crown guide part 53*a*.

Thereby, in the staple holder 53X, the load that is applied to the protrusion 53Xd is transmitted to the staple crown guide part 53*a* by the connection parts 53Xe and the protrusion 53Xd is retreated by the displacement of the staple crown guide part 53*a* mainly due to the elastic deformation of the spring part 53*c*.

Accordingly, also in the staple holder 53X of the modified embodiment, the staple crown guide part 53*a* is repeatedly displaced by the elastic deformation of the spring part 53*c* accompanied by the driving of the staple, and the durability is thus improved.

Figure 63:
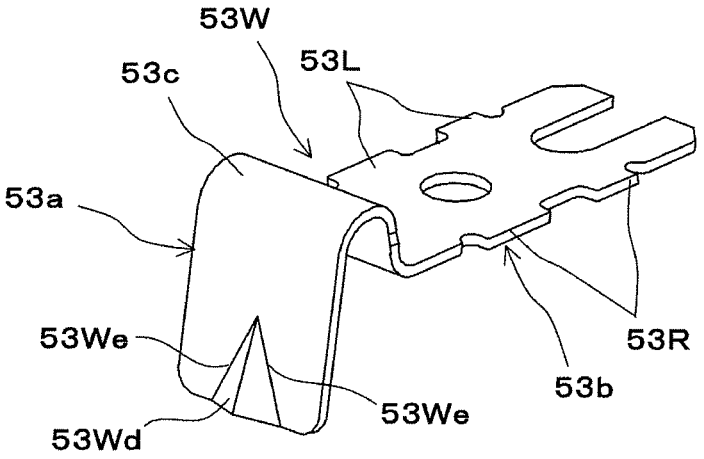
FIG. 63 is a perspective view showing another modified embodiment of the staple holder of the exemplary embodiment.

FIG. 63 is a perspective view showing another modified embodiment of the staple holder of the exemplary embodiment. In a staple holder 53W of the modified embodiment, the same configurations as those of the staple holder 53 described in FIG. 26 and the like are described with being denoted by the same reference numerals.

The staple holder 53W of the modified embodiment is made of an elastic material, in this example, a metal plate material having elasticity and has a protrusion 53Wd that supports the vicinity of the central portion of the staple crown 10La of the staple 10L in the longitudinal direction thereof or the vicinity of the central portion of the staple crown 10Sa of the staple 10S in the longitudinal direction thereof, from a lower side thereof, as the staple 10L or staple 10S described in FIG. 11 and the like is driven.

The protrusion 53Wd protrudes forward from the vicinity of the central portion of the staple crown guide part 53*a* along the driving direction of the staple 10L or staple 10S toward the lower end side of the staple crown guide part 53*a*.

The protrusion 53Wd of the modified embodiment is configured by providing a convex part having a triangular section in the vicinity of the central portion of the staple crown guide part 53*a* in the width direction. The protrusion 53Wd may have a configuration where the front and back have an unevenness shape by press processing and the like or may be configured by a solid convex part.

The staple holder 53W has connection parts 53We that transmit the load to be applied to the protrusion 53Wd to the staple crown guide part 53*a*. The connection parts 53We are configured by integrating sides of the protrusion 53Wd with the staple crown guide part 53*a*.

Thereby, in the staple holder 53W, the load that is applied to the protrusion 53Wd is transmitted to the staple crown guide part 53*a* by the connection parts 53We and the protrusion 53Wd is retreated by the displacement of the staple crown guide part 53*a* mainly due to the elastic deformation of the spring part 53*c*.

Accordingly, also in the staple holder 53W of the modified embodiment, the staple crown guide part 53*a* is repeatedly displaced by the elastic deformation of the spring part 53*c* accompanied by the driving of the staple, and the durability is thus improved.

Figure 64:
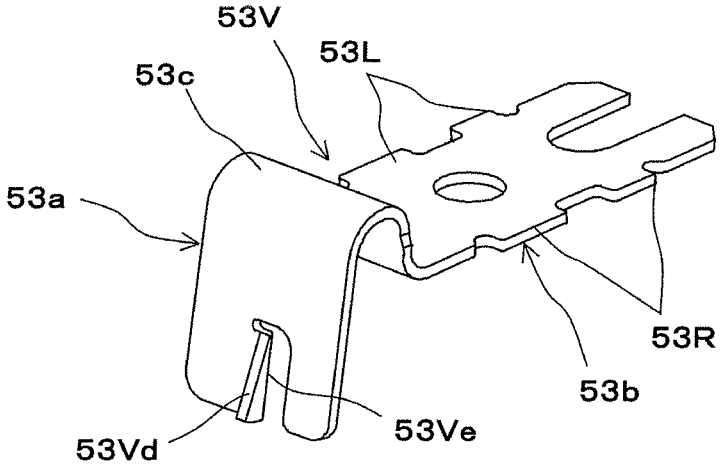
FIG. 64 is a perspective view showing another modified embodiment of the staple holder of the exemplary embodiment.

FIG. 64 is a perspective view showing another modified embodiment of the staple holder of the exemplary embodiment. In a staple holder 53V of the modified embodiment, the same configurations as those of the staple holder 53 described in FIG. 26 and the like are described with being denoted by the same reference numerals.

The staple holder 53V of the modified embodiment is made of an elastic material, in this example, a metal plate material having elasticity and has a protrusion 53Vd that supports the vicinity of the central portion of the staple crown 10La of the staple 10L in the longitudinal direction thereof or the vicinity of the central portion of the staple crown 10Sa of the staple 10S in the longitudinal direction thereof, from a lower side thereof, as the staple 10L or staple 10S described in FIG. 11 and the like is driven.

The protrusion 53Vd protrudes forward from the vicinity of the central portion of the staple crown guide part 53*a* along the driving direction of the staple 10L or staple 10S toward the lower end side of the staple crown guide part 53*a*.

The protrusion 53Vd of the modified embodiment is configured by providing a triangular bent piece having a bent portion, which extends in the upper-lower direction along the driving direction of the staple 10L or staple 10S, in the vicinity of the central portion of the staple crown guide part 53*a* in the width direction.

The staple holder 53V has a connection part 53Ve that transmits the load to be applied to the protrusion 53Vd to the staple crown guide part 53*a*. The connection part 53Ve is configured by the bent portion of the protrusion 53Vd that is bent relative to the staple crown guide part 53*a*.

Thereby, in the staple holder 53V, the load that is applied to the protrusion 53Vd is transmitted to the staple crown guide part 53*a* by the connection part 53Ve and the protrusion 53Vd is retreated by the displacement of the staple crown guide part 53*a* mainly due to the elastic deformation of the spring part 53*c*.

Accordingly, also in the staple holder 53V of the modified embodiment, the staple crown guide part 53*a* is repeatedly displaced by the elastic deformation of the spring part 53*c* accompanied by the driving of the staple, and the durability is improved.

Figure 65A:
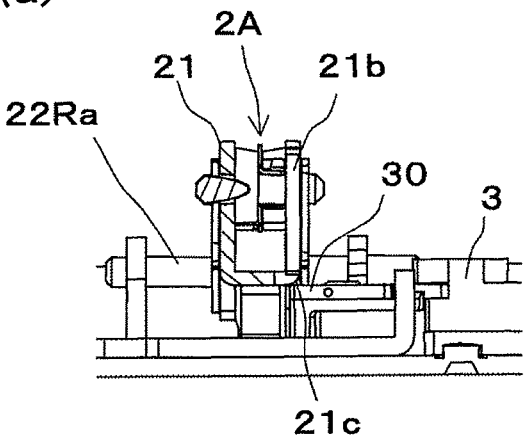
FIGS. 65(*a*) to 65(*c*) are side views of main parts showing an example of an operation of a slider.
Figure 65B:
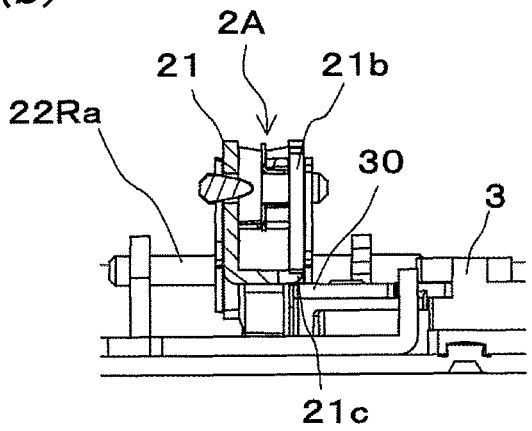
Figure 65C:
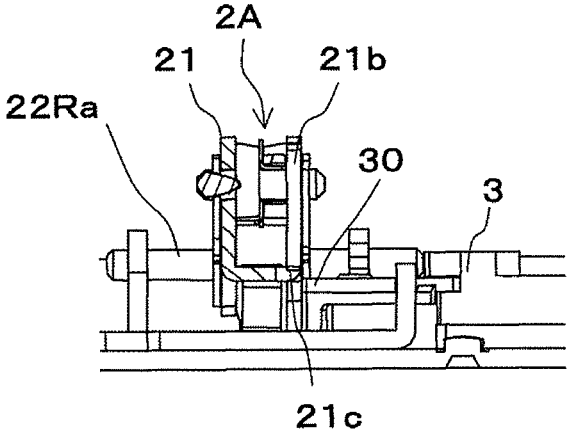

FIG. 65 is a side view of main parts showing an example of an operation of the slider. In the below, an operation of transmitting the movement of the link 58 to the slider 3 in the upper handle unit 11*b* is described with reference to the respective drawings.

At the standby state, as shown in FIG. 65(*a*), the slider 3 is advanced to the clincher lock position and the rear holder 21*b* of the clincher holder 21 configuring the clincher unit 2A is put on the engaging part 30. Thereby, the descent of the clincher holder 21 is restrained.

As shown in FIGS. 36(*a*) and 37(*a*), at the standby state, the empty space 61*c* is formed between the driver arm 61 and the driver pressing part 58*c* of the link 58, so that the driver arm 61 does not contact the link 58.

While the magazine 50 does not contact the sheet P and the driver arm 61 and the magazine guide 51 are integrally rotated about the shaft 54*f*, the empty space 61*c* between the driver arm 61 and the driver pressing part 58*c* of the link 58 is kept. In the meantime, the driver arm 61 and the magazine guide 51 are integrally rotated about the shaft 54*f* serving as a fulcrum, so that the link 58 is displaced relative to the link bearing part 31 of the slider 3.

The slider 3 and the link 58 are configured so that the link bearing part 31 and the slider pressing part 58*b* abut from the standby state. Thus, the slider 3 and the link 58 are set so that the shapes of the link bearing part 31 and the slider pressing part 58*b* do not permit the movement of the slider 3 by the displacement of the link 58 accompanied by the rotation of the magazine guide 51 about the shaft 54*f* serving as a fulcrum.

When the sheets P are held between the clincher unit 2A and the magazine 50 and the driver arm 61 is rotated relative to the magazine guide 51, the one separated staple 10L or staple 10S is driven by the driver 60 and the legs 10Lb of the staple 10 or legs 10Sb of the staple 10S penetrate the sheets P, as described above.

When the driver arm 61 is rotated relative to the magazine guide 51, the empty space 61*c* between the driver arm 61 and the link 58 is gradually narrowed. After the leading ends of the legs 10Lb of the staple 10 or legs 10Sb of the staple 10S get out of the backside of the sheet P, the driver arm 61 and the driver pressing part 58*c* of the link 58 abut, as shown in FIGS. 36(*b*) and 37(*b*).

At a stage where the driver arm 61 and the driver pressing part 58*c* of the link 58 start to contact each other, as shown in FIG. 65(*b*), the slider 3 is not moved yet and the rear holder 21*b* of the clincher holder 21 is put on the engaging part 30, so that the descent of the clincher holder 21 is restrained.

When the handle arm 70 is further pressed and thus the driver arm 61 is further rotated relative to the magazine guide 51, the link 58 is pressed by the rotation operation of the driver arm 61, so that the link 58 is rotated about the shaft 58*a* serving as a fulcrum, as shown in FIGS. 36(*c*) and 37(*c*).

When the link 58 is rotated, the link bearing part 31 of the slider 3 is pressed by the slider pressing part 58*b*. Thereby, as shown in FIG. 65(*c*), the slider 3 is retreated and the engaging part 30 is separated from the rear holder 21*b* of the clincher holder 21, so that the clincher holder 21 can descend.

In the conventional stapler having a flat clinch mechanism and a boosting mechanism, the leading end of the link is shaft-supported to the driver arm, the sheets are held between the clincher and the magazine and the link also starts to rotate at timing at which the driver arm starts to rotate relative to the magazine.

In the meantime, in order that the penetrating load applied when the staple penetrates the sheets and the load of pulling the slider do not overlap each other, it is necessary for the slider to operate after the leading ends of the legs of the staple penetrate the sheets. Hence, according to the conventional stapler, the empty space is provided between the slider pressing part of the link and the slider. However, in the configuration where the staples having long legs are used, since it is necessary to extend the stroke of the driver arm and to increase an operation amount of the link, the empty space between the link and the slider is extended.

In order to increase the operation amount of the link, it is necessary to provide the slider pressing part at the front. As a result, it is not possible to increase an insertion amount in a depth direction at the binding position of the sheets. Also, since the operation amount of the link is increased, the apparatus is enlarged.

However, in the exemplary embodiment, the link 58 is shaft-supported to the magazine guide 51 and the empty space 61*c* is formed between the driver pressing part 58*c* of the link 58 and the driver arm 61. Also, the link 58 is configured in a weight distribution manner that the slider pressing part 58*b* is rotated by its own weight in a direction of abutting on the link bearing part 31 of the slider 3 and thus the slider pressing part 58*b* of the link 58 is enabled to contact the link bearing part 31 of the slider 3 from the standby position.

The empty space 61*c* is formed between the link 58 and the driver arm 61, so that the sheets P are held between the clincher unit 2A and the magazine 50 and the link 58 does not rotate at the timing at which the driver arm 61 starts to rotate relative to the magazine guide 51. Then, the link 58 starts to rotate after the leading ends of the legs 10Lb of the staple 10L or legs 10Sb of the staple 10S penetrate the sheets P.

Thereby, even for the configuration where the staples 10 having long legs 10*b* can be used, it is possible to decrease the operation amount of the link 58. Even at the standby state shown in FIGS. 4, 36(*a*), 37(*a*) and the like, it is possible to keep the state where the slider pressing part 58*b* and the link bearing part 31 always contact each other. Also, it is possible to position the slider pressing part 58*b* at the rear of the front end of the upper handle attachment part 40 of the lower handle frame 4.

At the standby state, the slider pressing part 58*b* of the link 58 is positioned at the rear of the front end of the upper handle attachment part 40 of the lower handle frame 4. Thereby, it is possible to locate the movement position of the sheet guide 43 up to the front end of the upper handle attachment part 40.

Accordingly, as shown in FIG. 36(*a*), when the sheet guide 43 is positioned at the front end of the upper handle attachment part 40, it is possible to prolong a distance from the end portion of the sheet P to the binding position of the staple 10L or staple 10S. Also, when the sheet guide 43 is positioned close to the clincher unit 2A, it is possible to shorten a distance from the end portion of the sheet P to the binding position of the staple 10L or staple 10S.

Figure 66A:
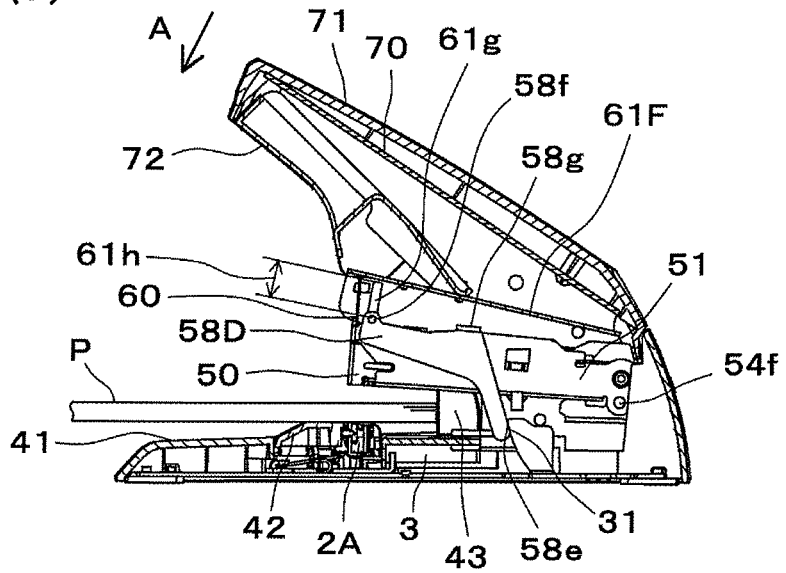
FIGS. 66(*a*) to 66(*c*) are side sectional views showing an operation of binding sheets by a stapler of a modified embodiment.
Figure 66B:
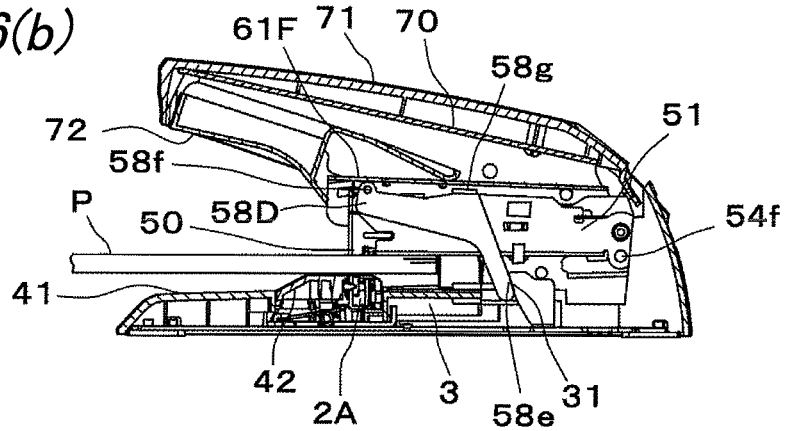
Figure 66C:
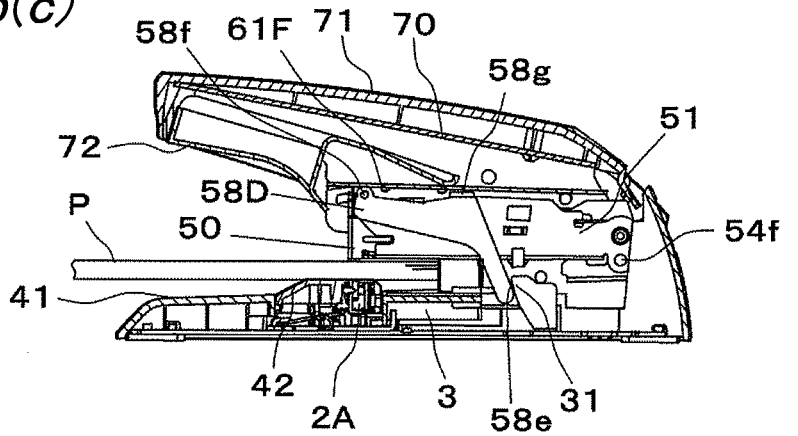

FIG. 66 is a side sectional view showing an operation of binding the sheets by a stapler of a modified embodiment. In this modified embodiment, a link 58D is configured so that a slider pressing part 58*e* formed at one end portion of a substantial L shape abuts on the link bearing part 31 of the slider 3. Also, the link 58D is configured so that a leading end, which is the other end portion, is shaft-supported to a driver arm 61F. The driver arm 61F is formed with a long hole 61*g* into which a shaft 58*f* of the link 58D is slideably inserted, so that an empty space 61*h* is formed.

Also, the link 58D has a sliding support part 58*g* to be put on the magazine guide 51 at an apex part of a substantial L shape between the slider pressing part 58*e* and the shaft 58*f*, and is slideably supported on the upper surface of the magazine guide 51.

The link 58D is configured in a weight distribution manner that the slider pressing part 58*e* is rotated by its own weight in a direction of abutting on the link bearing part 31 of the slider 3, and thus the slider pressing part 58*e* and the link bearing part 31 always contact each other. Also, the shaft 58*f* is positioned at the lower end side of the long hole 61*g*, so that the empty space 61*h* is formed.

Describing the operations of the modified embodiment, as shown in FIG. 66(*a*), the link 58D and the driver arm 61F are configured so that the shaft 58*f* of the link 58D is positioned at the lower end side of the long hole 61*g* of the driver arm 61F and the empty space 61*h* is thus formed.

While the magazine 50 does not contact the sheet and the driver arm 61F and the magazine guide 51 are integrally rotated about the shaft 54*f* serving as a fulcrum, the empty space 6*h* between the long hole 61*g* of the driver arm 61F and the shaft 58*f* of the link 58D is kept. In the meantime, the driver arm 61F and the magazine guide 51 are integrally rotated about the shaft 54*f* serving as a fulcrum, so that the link 58D is displaced relative to the link bearing part 31 of the slider 3.

The slider 3 and the link 58D are configured so that the link bearing part 31 and the slider pressing part 58*e* abut from the standby state. Thus, the slider 3 and the link 58D are set so that the shapes of the link bearing part 31 and the slider pressing part 58*e* do not permit the movement of the slider 3 by the displacement of the link 58D accompanied by the rotation of the magazine guide 51 about the shaft 54*f* serving as a fulcrum.

When the sheets P are held between the clincher unit 2A and the magazine 50 and the driver arm 61F is rotated relative to the magazine guide 51, the one separated staple 10L or staple 10S is driven by the driver 60 and the legs 10Lb of the staple 10L or legs 10Sb of the staple 10S penetrate the sheets P, as described above.

When the driver arm 61F is rotated relative to the magazine guide 51, the long hole 61*g* of the driver arm 61F is displaced relative to the shaft 58*f* of the link 58D, so that the empty space 61*c* is gradually narrowed. After the leading ends of the legs 10Lb of the staple 10L or legs 10Sb of the staple 10S get out of the backside of the sheet P, the shaft 58*f* of the link 58D abuts on the upper end of the long hole 61*g* of the driver arm 61*f*, as shown in FIG. 66(*b*).

At a stage where the shaft 58*f* of the link 58D starts to contact the upper end of the long hole 61*g* of the driver arm 61*f*, the slider 3 is not moved yet and the rear holder 21*b* of the clincher holder 21 is put on the engaging part 30, so that the descent of the clincher holder 21 is restrained.

When the handle arm 70 is further pressed and thus the driver arm 61F is further rotated relative to the magazine guide 51, the long hole 61*g* presses the shaft 58*f* by the rotation operation of the driver arm 61, so that the link 58D is pressed. Thus, as shown in FIG. 66(*c*), the link 58D is rotated about the contact point of the sliding support part 58*g* and the magazine guide 51 serving as a movement fulcrum.

When the link 58D is rotated, the link bearing part 31 of the slider 3 is pressed by the slider pressing part 58*e*. Thereby, the slider 3 is retreated and the engaging part 30 is separated from the rear holder 21*b* of the clincher holder 21, so that the clincher holder 21 can descend.

Also in the modified embodiment, the empty space 61*h* is formed by the shaft 58*f* of the link 58D and the long hole 61*g* of the driver arm 61F, so that it is possible to decrease the operation amount of the link 58D.

Meanwhile, in an alternative modified embodiment, the link is shaft-supported to the driver arm and the driver arm is formed with the long hole into which the shaft of the link is slideably inserted, so that the link is movably guided along a moving direction of the driver arm. Also, the link is configured so that the slider pressing part formed at one end portion of a substantial L shape abuts on the slider and the driver pressing part formed at the other end portion is pressed by the driver arm. The empty space may be formed between the driver pressing part and the driver arm. Also, the shape of the link is not limited to the L shape. That is, any shape is possible insomuch as a contact part with the slider can be formed at one end side and a contact part with the driver arm can be formed at the other end side.

Figure 67A:
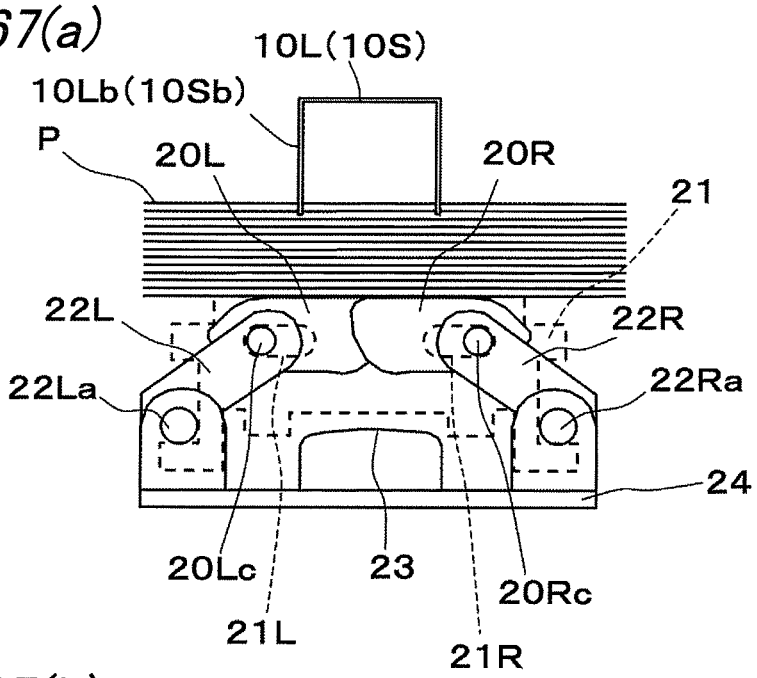
FIGS. 67(*a*) and 67(*b*) illustrate an example of an operation of the clincher unit.
Figure 67B:
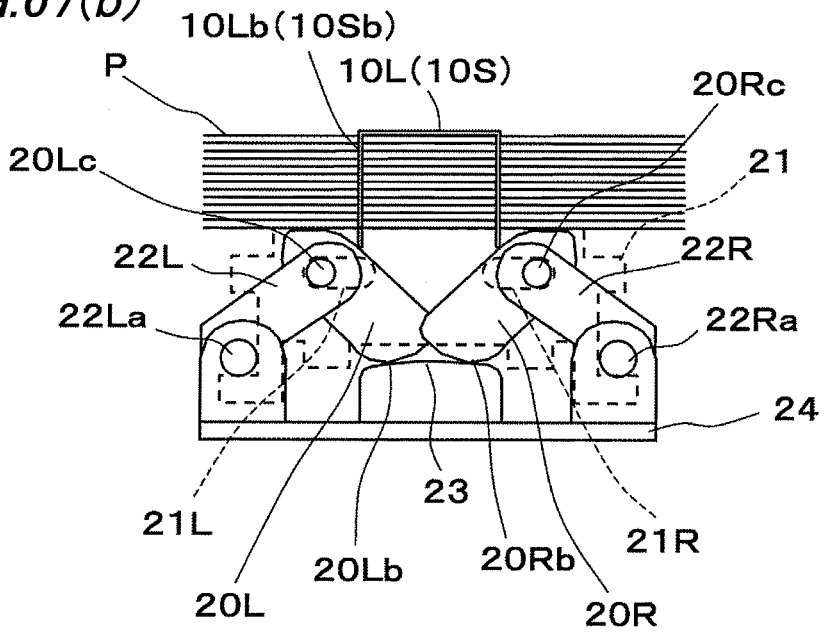
Figure 68A:
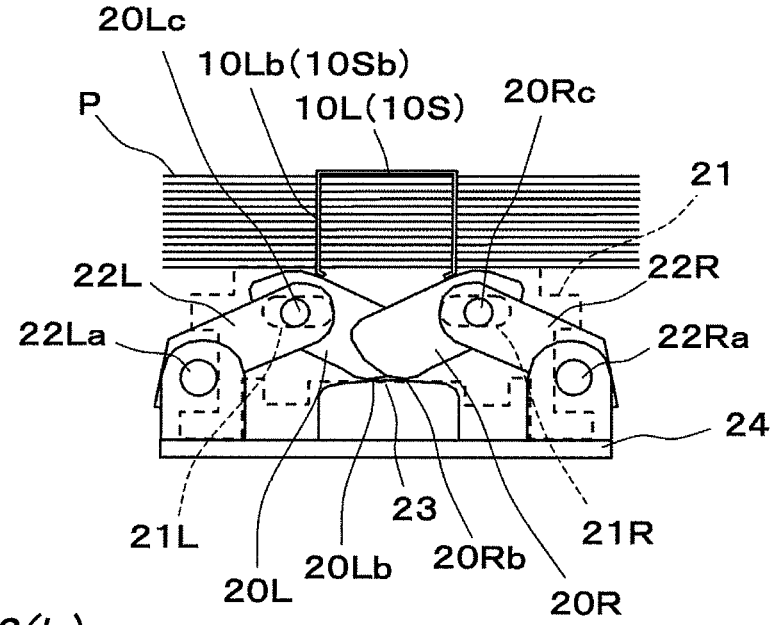
FIGS. 68(*a*) and 68(*b*) illustrate an example of an operation of the clincher unit.
Figure 68B:
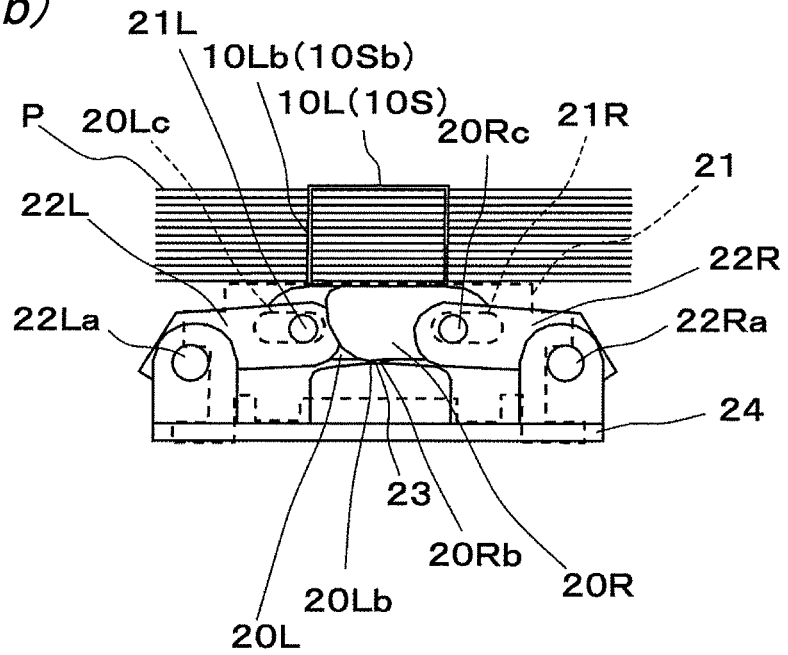
Figure 69A:
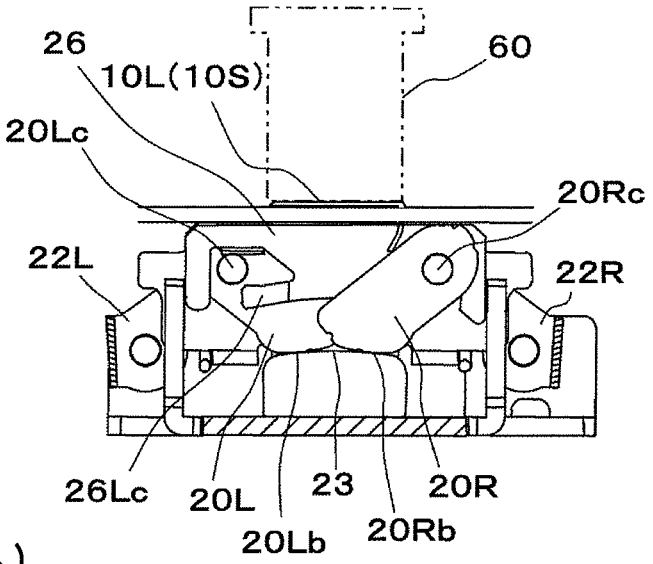
FIGS. 69(*a*) to 69(*c*) illustrate an example of an operation of the clincher unit.
Figure 69B:
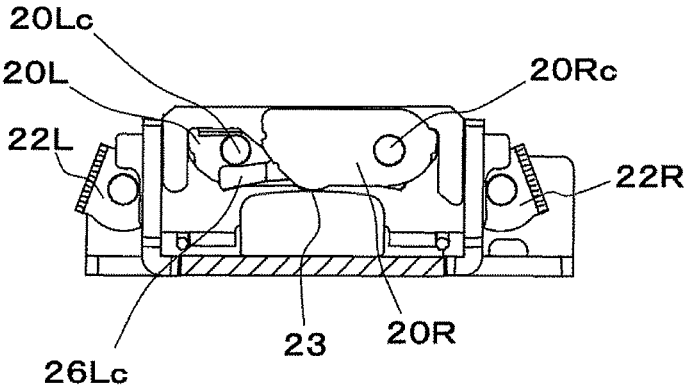
Figure 69C:
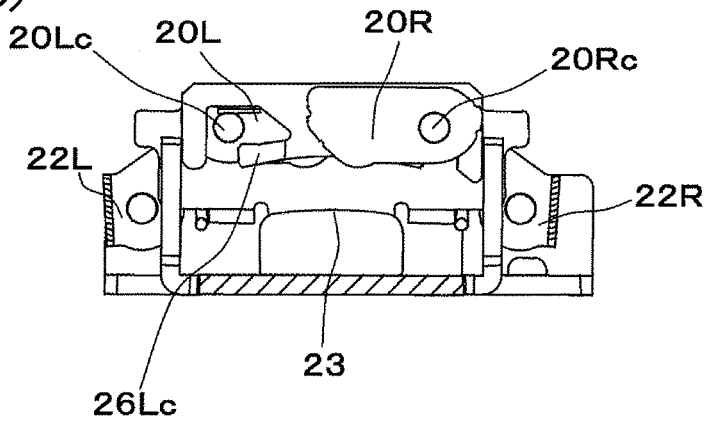

FIGS. 67 to 69 illustrate examples of the operation of the clincher unit. In the below, operations of a flat clinch mechanism are described with reference to the respective drawings.

When the sheets P are put on a predetermined position and the upper handle cover 71 is pressed, the one separated staple 10L or staple 10S is driven by the driver 60, as described above, and the legs 10Lb of the staple 10L or legs 10Sb of the staple 10S are inserted into and start to penetrate the sheets P, as shown in FIG. 67(*a*). At a stage where the legs 10Lb of the staple 10L or legs 10Sb of the staple 10S start to penetrate the sheets P, the slider 3 is not moved yet and the rear holder 21*b* of the clincher holder 21 is put on the engaging part 30, so that the descent of the clincher holder 21 is restrained, as described in FIG. 65(*a*).

When the staple 10L or staple 10S is further driven by the driver 60 and the leading ends of the legs 10Lb or legs 10Sb penetrate the sheets P and protrude from the backside of the sheet P, one leg 10Lb or leg 10Sb presses the clincher 20L and the other leg 10Lb or leg 10Sb presses the clincher 20R. At a stage where the leading ends of the legs 10Lb or legs 10Sb start to protrude from the backside of the sheet P, as shown in FIG. 65(*b*), the slider 3 is not moved yet and the rear holder 21*b* of the clincher holder 21 is put on the engaging part 30, so that the descent of the clincher holder 21 is restrained.

The side surface of the clincher 20L is pressed by the spring part 26Lc of the partition plate 26 and the side face of the clincher 20R is pressed by the spring part 26Rc of the partition plate 26, so that the directions are kept. At this time, the pressing force of the staple 10L or staple 10S by the pressing of the driver 60 is higher than the pressing force by the spring part of the partition plate 26.

Thereby, as shown in FIGS. 67(*b*) and 69(*a*), the clincher surface 20La is pressed by the one leg 10Lb of the staple 10L or one leg 10Sb of the staple 10S, so that the clincher 20L is rotated downward about the shaft 20Lc serving as a fulcrum. Also, the clincher surface 20Ra is pressed by the other leg 10Lb of the staple 10L or the other leg 10Sb of the staple 10S, so that the clincher 20R is rotated downward about the shaft 20Rc serving as a fulcrum.

When the staple 10L or staple 10S is further driven by the driver 60 and the leading ends of the legs 10Lb or legs 10Sb penetrate the sheets P, the slider 3 is retreated by the above-described operation of the link 58, as shown in FIG. 65(*c*), and the engaging part 30 is separated from the rear holder 21*b* of the clincher holder 21, so that the clincher holder 21 can descend.

Thereby, as shown in FIG. 68(*a*), the clincher holder 21 descends by the force that is generated as the upper handle cover 71 is pressed and thus the magazine 50 presses the clincher holder 21 via the sheets P. By the descent operation of the clincher holder 21, the clincher link 22L is rotated about the shaft 22La serving as a fulcrum in a direction along which the upper end of the clincher link comes close to the clincher link 22R. Also, by the descent operation of the clincher holder 21, the clincher link 22R is rotated about the shaft 22Ra serving as a fulcrum in a direction along which the upper end of the clincher link comes close to the clincher link 22L.

Like this, by the descent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is narrowed. Therefore, by the descent operation of the clincher holder 21, the clincher 20L and the clincher 20R are horizontally moved in the approaching direction.

Also, by the descent operation of the clincher holder 21, the pressing surface 20Lb of the clincher 20L is pressed by the clincher support part 23 and the pressing surface 20Rb of the clincher 20R is pressed by the clincher support part 23.

Thereby, the pressing surface 20Lb is pushed up by the clincher support part 23, so that the clincher 20L is rotated upward about the shaft 20Lc serving as a fulcrum. Also, the pressing surface 20Rb is pushed up by the clincher support part 23, so that the clincher 20R is rotated upward about the shaft 20Rc serving as a fulcrum.

Therefore, the one leg 10Lb of the staple 10L or one leg 10Sb of the staple 10S abutting on the clincher surface 20La of the clincher 20L and the other leg 10Lb of the staple 10L or the other leg 10Sb of the staple 10S abutting on the clincher surface 20Ra of the clincher 20R are respectively applied with the bending force that is generated as the clincher 20L and the clincher 20R are moved in the approaching direction each other. The clincher 20L and the clincher 20R are rotated upward, so that they are bent inward.

When the clincher holder 21 descends to the lowest end position by the force that is generated as the upper handle cover 71 is pressed and thus the magazine 50 presses the clincher holder 21 via the sheets P, the clincher 20L and the clincher 20R pushed up by the clincher support part 23 are returned to the substantially horizontal positions, as shown in FIG. 68(*b*). Thereby, the legs 10Lb of the staple 10L or legs 10Sb of the staple 10S having penetrated the sheets P are bent along the surface of the sheet P, so that the clinch operation is completed.

In the configuration of bending the legs of the staple by the rotation operation of the pair of left and right clinchers, when there are many sheets to be bound and the protrusion amount of the legs from the backside of the sheet is small, the legs collide with the clincher surfaces at the upper sides of the rotation fulcrum of the clinchers. At this state, when the clinchers rotate, as a movement of starting to bend the legs, the force of pushing up the legs outward is applied.

However, in the exemplary embodiment, the clincher 20L and the clincher 20R are moved in the approaching direction each other, as a movement of starting to bend the legs 10Lb or legs 10Sb, so that it is possible to apply the force of bending the legs 10Lb or legs 10Sb inward. Thereby, even when the legs collide with the clincher surfaces 20La, 20Lb at the upper sides of the rotation fulcrum of the clinchers 20L, 20R, it is possible to securely perform the clinch operation by applying the force of bending the legs 10Lb or legs 10Sb inward.

After completing the clinch operation, when the force of pressing the upper handle cover 71 is released, the upper handle unit 11*b* is pushed up by a return spring (not shown). When the force of pressing the clincher holder 21 is released, the clincher holder 21 is pushed up by the return spring 25.

By the ascent operation of the clincher holder 21, the clincher link 22L is rotated about the shaft 22La serving as a fulcrum so that the upper end side thereof becomes more distant from the clincher link 22R. Also, by the ascent operation of the clincher holder 21, the clincher link 22R is rotated about the shaft 22Ra serving as a fulcrum so that the upper end side thereof becomes more distant from the clincher link 22L.

Like this, by the ascent operation of the clincher holder 21, in the clincher link 22L, the shaft 20Lc is moved along the guide hole 21L, and in the clincher link 22R, the shaft 20Rc is moved along the guide hole 21R, so that the interval between the shaft 20Lc and the shaft 20Rc is widened.

The clincher 20L, which is pushed up by the clincher support part 23 and is thus returned to the substantial horizontal position, is pressed at the side face thereof by the spring part 26Lc of the partition plate 26, and the clincher 20R is pressed at the side face thereof by the spring part 26Rc of the partition plate 26.

Thereby, while the clincher 20L and the clincher 20R returned to the substantial horizontal positions keep the substantial horizontal positions without rotating downward by the own weights, the clincher 20L and the clincher 20R are moved in the getting away direction each other by the ascent operation of the clincher holder 21, as shown in FIGS. 69(*b*) and 69(*c*). Then, the clincher unit 2A is returned to the standby position.

In the configuration of bending the legs of the staple by the rotation operation of the pair of left and right clinchers, the clinchers are not applied with the urging force in the rotating direction, are rotated downward by the pressing of the legs and are returned by the pushing-up of the clincher support part. Therefore, at the state where the clincher unit is at the standby position, the clinchers may be rotated downward.

At this state, a space is formed at the inside of the clincher holder, so that the foreign matters are introduced therein. Also, the outward appearance may be deteriorated.

However, in the exemplary embodiment, it is possible to maintain the directions of the clinchers 20L, 20R by the spring parts 26Lc, 26Rc provided to the partition plate 26. Hence, it is possible to keep the directions of the clinchers 20L, 20R at the substantially horizontal positions until the clinchers are pressed by the legs 10Lb of the staple 10L or legs 10Sb of the staple 10S.

Thereby, as shown in FIG. 18, for example, at the standby state, the opening of the clincher cover 42 is blocked by the clinchers 20L, 20R, so that it is possible to remove the cause of the introduction of the foreign matters. Also, it is possible to improve the outward appearance.

Figure 70:
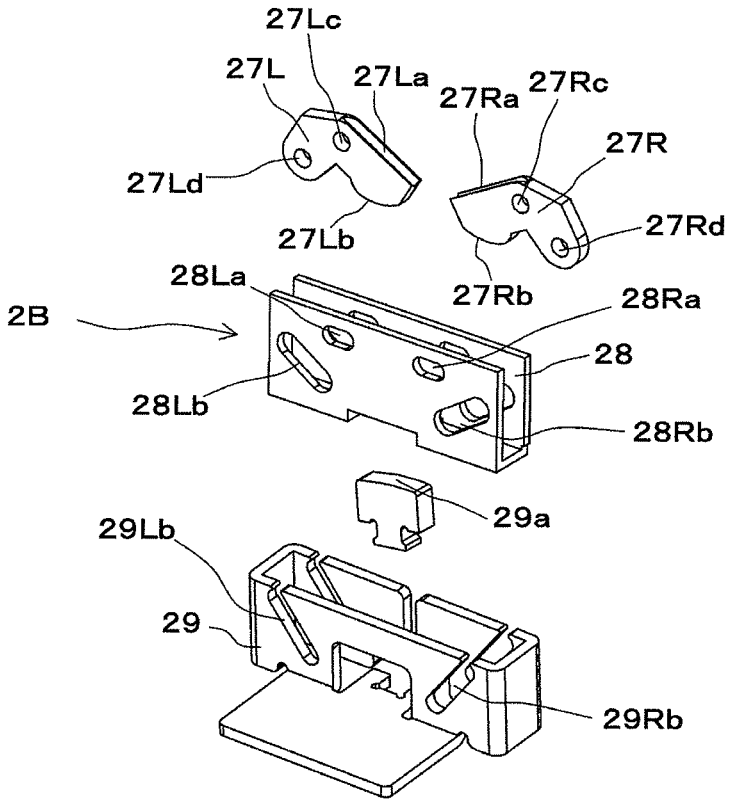
FIG. 70 is an exploded perspective view showing a modified embodiment of the clincher unit.
Figure 71A:
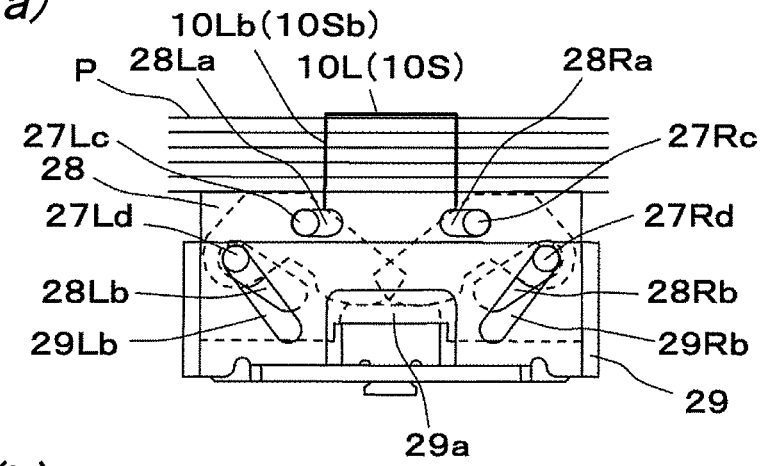
FIGS. 71(*a*) to 71(*c*) illustrate an example of an operation of the clincher unit of the modified embodiment.
Figure 71B:
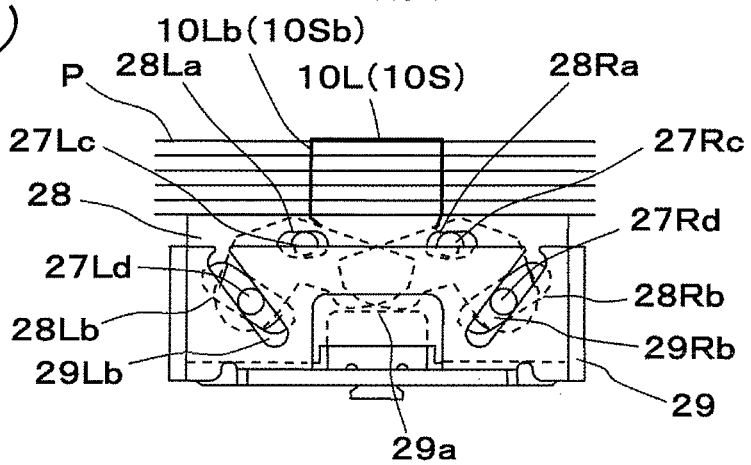
Figure 71C:
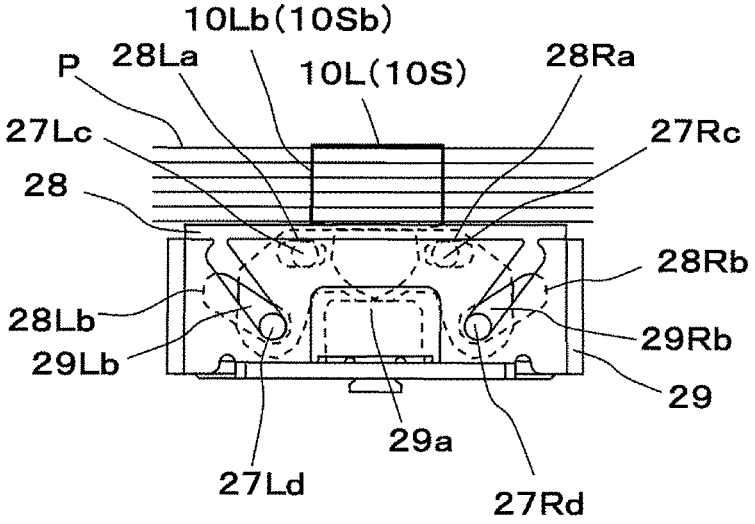

FIG. 70 is an exploded perspective view showing a modified embodiment of the clincher unit and FIG. 71 illustrates an example of an operation of the clincher unit of the modified embodiment. A clincher unit 2B of the modified embodiment is a clincher driving mechanism and rotates and moves the clinchers in the separating/contacting directions by guide through recesses.

The clincher unit 2B has a pair of clinchers 27L, 27R that bends the legs 10Lb of the staple 10L or legs 10Sb of the staple 10S having penetrated the sheets and a clincher holder 28 that supports the clincher 27L and the clincher 27R.

Also, the clincher unit 2B has a holder guide 29 that guides the movement of the clincher holder 29 in the ascent and descent direction and guides the rotation of the clinchers 27L, 27R and the movement thereof in the separating/contacting directions. Further, the clincher unit 2B has a clincher support part 29*a* that pushes up the clinchers 27L, 27R by the ascent and descent operation of the clincher holder 28.

The clincher unit 2B is arranged so that positions of the clincher 27L and the clincher 27R are deviated in the left-right direction along the staple crown 10La of the staple 10L or staple crown 10Sa of the staple 10S and in the front-rear direction orthogonal to the staple crown 10La and the staple crown 10Sa.

The clincher 27L is disposed to face one leg 10Lb of the staple 10L or one leg 10Sb of the staple 10S and is formed on an upper surface facing the leg 10Lb or leg 10Sb with a clincher surface 27La that is inclined in a downward direction toward the clincher 27R arranged to be offset in the front-rear direction. Also, the clincher 27L is formed with a pressing surface 27Lb, which is pressed by the clincher support part 29*a*, on a lower surface of one end portion facing the clincher support part 29*a*.

The clincher 27L is supported in a guide hole 28La of the clincher holder 28 by a shaft 27Lc so that it can be rotated and horizontally moved. Also, the clincher 27L is configured so that the other end portion is movably supported along a guide hole 28Lb of the clincher holder 28 and a guide hole 29Lb of the holder guide 29 by a shaft 27Ld.

The clincher 27R is disposed to face the other leg 10Lb of the staple 10L or other leg 10Sb of the staple 10S and is formed on an upper surface facing the leg 10Lb or leg 10Sb with a clincher surface 27Ra that is inclined in a downward direction toward the clincher 27L arranged to be offset in the front-rear direction. Also, the clincher 27R is formed with a pressing surface 27Rb, which is pressed by the clincher support part 29*a*, on a lower surface of one end portion facing the clincher support part 29*a*.

The clincher 27R is supported in a guide hole 28Ra of the clincher holder 28 by a shaft 27Rc so that it can be rotated and horizontally moved. Also, the clincher 27R is configured so that the other end portion is movably supported along a guide hole 28Rb of the clincher holder 28 and a guide hole 29Rb of the holder guide 29 by a shaft 27Rd.

In the clincher holder 28, the guide hole 28La and the guide hole 28Ra are long holes that extend in the horizontal direction. Also, in the clincher holder 28, the guide hole 28Lb and the guide hole 28Rb are long holes that are inclined in a direction that an interval at the lower side is narrower than that at the upper side.

In the holder guide 29, the guide hole 29Lb and the guide hole 29Rb are long holes that are inclined in a direction that an interval at the lower side is narrower than that at the upper side. The clincher unit 2B rotates and moves the clincher 27L and the clincher 27R in the separating/contacting directions by trajectories of the shafts 27Ld, 27Rd of the clinchers 27L, 27R passing through the guide hole 29Lb and the guide hole 29Rb of the holder guide 29 and by an operation of pushing up the clinchers 27L, 27R by the clincher support part 29*a*.

The operations of the clincher unit of the modified embodiment are described. As shown in FIG. 71(*a*), when the leading ends of the legs 10Lb of the staple 10L or legs 10Sb of the staple 10S penetrate the sheets P and protrude from the backside of the sheet P, one leg 10Lb or one leg 10Sb contacts the clincher 27L and the other leg 10Lb or other leg 10Sb contacts the clincher 27R. At a state where the leading ends of the legs 10Lb or legs 10Sb start to protrude from the backside of the sheet P, the descent of the clincher 28 is restrained.

When the staple 10L or staple 10S is further driven and thus the leading ends of the legs 10Lb or legs 10Sb penetrate the sheets P, the clincher 28 can descend. Thereby, as shown in FIG. 71(*b*), the clincher holder 28 descends by the force of pressing the clincher holder 28 via the sheets P.

By the descent operation of the clincher holder 28, in the clincher 27L, the shaft 27Lc that is guided in the guide hole 28La of the clincher holder 28 is moved so that it comes close to the clincher 27R, and the shaft 27Ld that is guided in the guide hole 29Lb of the holder guide 29 is moved so that it comes close to the clincher 27R. Also, by the descent operation of the clincher holder 28, in the clincher 27R, the shaft 27Rc that is guided in the guide hole 28Ra of the clincher holder 28 is moved so that it comes close to the clincher 27L, and the shaft 27Rd that is guided in the guide hole 29Rb of the holder guide 29 is moved so that it comes close to the clincher 27L.

Thereby, the clinchers 27L, 27R are moved by the descent operation of the clincher holder 28 so that the interval between the shaft 27Lc and the shaft 27Rc is narrowed and the clincher 27L and the clincher 27R come close to each other.

Also, by the descent operation of the clincher holder 28, the pressing surface 27Lb of the clincher 27L is pressed by the clincher support part 29*a* and the pressing surface 27Rb of the clincher 27R is pressed by the clincher support part 29*a*.

Thereby, the clincher 27L is rotated upward about the shaft 27Lc serving as a fulcrum that is guided in the guide hole 28La of the clincher holder 28, and the clincher 27R is rotated upward about the shaft 27Rc serving as a fulcrum that is guided in the guide hole 28Ra of the clincher holder 28.

Accordingly, the one leg 10Lb of the staple 10L or one leg 10Sb of the staple 10S abutting on the clincher surface 27La of the clincher 27L and the other leg 10Lb of the staple 10L or other leg 10Sb of the leg 10S abutting on the clincher surface 27Ra of the clincher 27R are respectively applied with the inward bending force that is generated as the clincher 27L and the clincher 27R are moved in the approaching direction each other. The clincher 27L and the clincher 27R are rotated upward, so that they are bent inward.

When the clincher holder 28 descends to the lowest end position, the clincher 27L and the clincher 27R pushed up by the clincher support part 29*a* become substantially horizontal, as shown in FIG. 71(*c*). Thereby, the legs 10Lb or legs 10Sb having penetrated the sheets P are bent along the surface of the sheet P, so that the clinch operation is completed.

In the below, an operation of bending the legs 10Lb or legs 10Sb having penetrated the sheets P so that they are offset in the front-rear direction is described with reference to the respective drawings. The one leg 10Lb of the staple 10L or one leg 10Sb of the staple 10S abutting on the clincher surface 20La of the clincher 20L and the other leg 10Lb of the staple 10L or other leg 10Sb of the staple 10S abutting on the clincher surface 20Ra of the clincher 20R are respectively bent inward by the operation of movement the clincher 20L and the clincher 20R so that they come close to each other and by the operation of rotating the clinchers upward.

The clincher unit 2A is arranged to be inclined to the staple crown 10La of the staple 10L or staple crown 10Sa of the staple 10S, and the clincher 20L and the clincher 20R are inclined relative to the staple crown 10La of the staple 10L or staple crown 10Sa of the staple 10S and arranged to be offset in the front-rear direction, as shown in FIG. 16.

Thereby, by the horizontal movement and rotation operation of the clinchers 20L, 20R, the one leg 10Lb of the staple 10L or one leg 10Sb of the staple 10S is obliquely bent while being guided in an arrow NL direction of coming close to the clincher 20R by the inclination of the clincher surface 20La shown in FIG. 17. Also, the other leg 10Lb or leg 10Sb is obliquely bent while being guided in an arrow NR direction of coming close to the clincher 20L by the inclination of the clincher surface 20Ra.

The one leg 10Lb and the other leg 10Lb of the staple 10L or one leg 10Sb and the other leg 10Sb of the staple 10S are bent while being moved in the approaching direction each other, and then abut on the partition part 26*b* of the partition plate 26, respectively.

Thereby, even for the staple 10L having long legs, when the number of sheets P to be bound is small, the two legs 10Lb are bent with an interval of the plate thickness of the partition plate 26 so that they do not overlap each other, as shown in FIG. 11(*d*).

In the configuration of guiding the legs in the recesses that are formed in the clinchers, it is necessary to secure a thickness of a convex part between the recess and the recess, so that it is not possible to narrow the interval between the legs. Also, when there is no partition between the clinchers, the legs may overlap each other.

In the exemplary embodiment, the clincher 20L and the clincher 20R are partitioned by the partition plate 26, so that it is possible to bend the two legs 10Lb with a narrow interval without the overlapping. Since the partition plate 26 also functions as a spring keeping the directions of the clinchers 20L, 20R, it may be possible to configure the staple 10L with a high strength thin steel plate.

Thereby, it is possible to set the interval between the two legs 10Lb by the lowest interval defined by the partition plate 26.

In the below, an operation of keeping the direction of the clincher unit 2A in the same direction at the standby state and at the pressing state is described with reference to the respective drawings. As described in FIGS. 19 and 20, in the clincher holder 21, the rear holder 21*b* positioned at the rear of the clinchers 20L, 20R is pushed up by the return spring 25 and the front holder 21*a* positioned at the front of the clinchers 20L, 20R is restrained from moving upward by the shafts 22La, 22Ra.

Thereby, the clincher holder 21 having the clinchers 20L, 20R attached thereto keeps the forward inclined posture shown with an arrow F1 at the standby state where it is pushed up by the return spring 25.

When the clincher holder 21 is pressed downward via the sheets P by the force with which the legs 10Lb of the staple 10L or legs 10Sb of the staple 10S penetrate the sheets P, penetrating load F2 is applied to the clincher holder 21. When the clincher holder 21 is applied with the penetrating load F2 with the rear holder 21*b* being put on the engaging part 30 of the slider 3, the clincher holder keeps the forward inclined posture shown with the arrow F1.

The ascent and descent of the clincher holder 21 is guided by the clincher guide 24*a*. However, when a height of the clincher guide 24*a* is reduced so as to reduce a size in the height direction, an inclination is apt to occur in the front-rear direction.

When the directions of the clinchers are changed before and after the penetrating load is applied, the position of the sheets is deviated, so that the legs are deviated in the front-rear direction in the sheets during the penetration. As a result, the legs may not penetrate the sheets, so that the sheets may not be bound. In the exemplary embodiment, before and after the penetrating load is applied, the direction of the clincher holder 21 is not changed. Hence, it is possible to suppress the deviation of the sheets P and to thus enable the legs of the staple 10L or staple 10S to securely penetrate the sheets.

Meanwhile, in the exemplary embodiment, since the slider 3 is positioned at the rear of the clincher unit 2A, the pushing-up force is applied to the rear holder 21*b*. However, for a configuration where the slider 3 is disposed at the front of the clincher unit, when the pushing-up force is applied to the front holder, it is possible to keep the direction of the clincher holder same before and after the penetrating load is applied.

In the below, an operation of the lock mechanism 54 of the magazine 50 is described with reference to the respective drawings. As shown in FIG. 31(*a*), at the state where the magazine 50 is accommodated in the magazine guide 51, the magazine lock spring 54*c* is compressed between the rear end of the staple guide 52 attached to the magazine 50 and the spring pressing part 54*e* of the magazine stopper 54*a*.

As the spring pressing part 54*e* is pressed, the magazine stopper 54*a* is rotated about the shaft 54*f* serving as a fulcrum in a direction along which the lock claw 54*d* is fitted in the lock opening 50*e* of the magazine 50, so that the lock claw 54*d* is fitted in the lock opening 50*e*. Thereby, the magazine 50 is kept with being accommodated in the magazine guide 51.

As shown in FIG. 31(*b*), when the switch part 54*g* is pressed, the pusher switch 54*b* rotates the magazine stopper 54*a*, which is connected via the shaft 54*h*, about the shaft 54*f* serving as a fulcrum, thereby separating the lock claw 54*d* of the magazine stopper 54*a* from the lock opening 50*e* of the magazine 50.

When the lock claw 54*d* of the magazine stopper 54*a* is separated from the lock opening 50*e* of the magazine 50, the magazine 50 is pressed forward by the restoring force of the compressed magazine lock spring 54*c*, so that the magazine 50 is withdrawn from the magazine guide 51.

When accommodating the magazine 50, the magazine 50 is pushed into the magazine guide 51, so that the staple guide 52 of the magazine 50 presses the spring pressing part 54*e* of the magazine stopper 54*a* via the magazine lock spring 54*c*. Thereby, the magazine stopper 54*a* is rotated about the shaft 54*f* serving as a fulcrum in a direction along which the lock claw 54*d* is fitted in the lock opening 50*e* of the magazine 50, so that the lock claw 54*d* is fitted in the lock opening 50*e*.

In the configuration of sliding the magazine, the force of the pusher spring pushing the staple is used to protrude the magazine. Therefore, when the number of the accommodated staples is large, the protruding amount of the magazine is increased, and when the number of the accommodated staples is small or when the staple is not accommodated, the protruding amount of the magazine is decreased.

However, in the exemplary embodiment, as the lock mechanism 54 is locked, the magazine lock spring 54*c* is applied with the constant pressing force, irrespective of the remaining number of the staples 10L or staples 10S in the magazine. Hence, it is possible to make the protruding amount of the magazine 50 constant.

In the exemplary embodiment, the stapler has been exemplified as the sheet processing apparatus having the boosting mechanism. However, the invention can be also applied to an apparatus referred to as a boring punching that makes a hole on a sheet. That is, a configuration is also possible in which an arm having one end portion to which a blade part serving as the motion member is provided and the other end portion that is rotatably supported about a shaft serving as a fulcrum is provided as the motion member, and a handle that is connected to the arm by a shaft serving as a connection part and is supported by a long hole-shaped guide part having a shape moving a fulcrum shaft is provided as the operation member.

The invention may be applied to an apparatus that processes a sheet by a user operation, such as stapler and boring punching having a boosting mechanism.

In accordance with embodiments, a sheet processing apparatus may include: an operation member 70 that is rotated with a force applied from an operator; and an motion member 61 connected to the operation member 70 via a connection part 70*c* to which the operation member 70 applies a force, the motion member 61 being rotated with the force of the operation member 70 applied through the connection part 70*c*, and the motion member 61 applying force to an acting member 60 that processes a sheet. A fulcrum O of a rotating operation of the operation member 70 may move depending on an operation of the operation member 70, thereby a first length L1 between the fulcrum O and a part E1 at which the operation member 70 is applied with the force and a second length L2 between the fulcrum O and a part E2 at which the force is applied from the operation member 70 to the motion member 61 may change. A reduction rate D of a load F applied to the operation member 70 may be thus changed.

The motion member 61 may be supported to be rotatable about a shaft 54*f* and also be connected to the operation member 70 so as to be relatively rotatable about the connection part 70*c*. The operation member 70 may be supported to be movable along a shape of a guide part 70*b*. The guide part 70*b* may have a shape that moves the fulcrum O in a direction in which the first length L1 and the second length L2 are reduced as the operation member is operated.

The acting member 60 may be a driver 60 that drives a staple to the sheet. The reduction rate D of the load F applied to the operation member 70 may be set for each of a plurality of processes that is included in an operation where the operation member 70 is operated and thus the driver 60 drives the staple so as to bind the sheets.

The reduction rate D of the load F applied to the operation member 70 may be set for each of a first process before a process of separating one staple from a plurality of connected staples by a shearing, a second process of separating the staple by the shearing, and a third process of enabling the staple to penetrate the sheets.

The reduction rate of the load that is applied to the operation member in the second process may be larger than the reduction rate of the load that is applied to the operation member in the first process. The reduction rate of the load that is applied to the operation member in the third process may be larger than the reduction rate of the load that is applied to the operation member in the second process.

What is claimed is:

1. A sheet processing apparatus comprising:

a frame;

a motion member provided above the frame, wherein the motion member includes a tip portion and a base portion, the tip portion is provided with an acting member that processes a sheet, and the base portion is supported by the frame to be rotatable about a first shaft which is fixed with respect to the frame; and an operation member that is provided above the motion member and supported by the motion member to be rotatable about a second shaft which is fixed with respect to the motion member between the tip portion of the motion member and the first shaft, wherein the frame includes a contact part to be contacted to the operation member, and a location of a contact position at which the contact part contacts the operation member is displaceable, wherein the operation member is rotated with a force applied from an operator, and the motion member is rotated with a force of the operation member applied through the second shaft, and applies force to the acting member, wherein, as the operation member is operated to be rotated, the contact position between the contact part of the frame and the operation member is changed such that a fulcrum of a rotating operation of the operation member moves so that a first length between the fulcrum and a part at which the operation member is applied with the force is changed, and a second length between the fulcrum and a part at which the force is applied from the operation member to the motion member is changed, and a reduction rate of a load applied to the operation member is thus changed, wherein the operation member is supported to be movable along a shape of a guide part provided in the frame, and wherein the guide part has a shape that moves the fulcrum in a direction in which the first length and the second length are reduced as the operation member is operated.

2. The sheet processing apparatus according to claim 1, wherein the acting member is a driver that drives a staple to the sheet, and wherein the reduction rate of the load applied to the operation member is set for each of a plurality of processes that is included in an operation where the operation member is operated and thus the driver drives the staple so as to bind the sheets.

3. The sheet processing apparatus according to claim 2, wherein the reduction rate of the load applied to the operation member is set for each of a first process before a process of separating one staple from a plurality of connected staples by a shearing, a second process of separating the staple by the shearing, and a third process of enabling the staple to penetrate the sheets.

4. The sheet processing apparatus according to claim 3, wherein the reduction rate of the load that is applied to the operation member in the second process is larger than the reduction rate of the load that is applied to the operation member in the first process, and wherein the reduction rate of the load that is applied to the operation member in the third process is larger than the reduction rate of the load that is applied to the operation member in the second process.

5. The sheet processing apparatus according to claim 1, wherein the operation member is formed with a shaft hole, wherein the contact part of the frame includes a shaft, and wherein, as the operation member is operated to be rotated, a contact position and a contact angle between the third shaft of the frame and the shaft hole of the operation member is changed such that the fulcrum of the rotating operation of the operation member moves.

6. The sheet processing apparatus according to claim 5, wherein the shaft hole includes a plurality of zones in which the contact angle with the third shaft is different from each other according to the contact position with the shaft, which is changed by the rotating operation of the operation member.

7. The sheet processing apparatus according to claim 1, wherein, as the operation member is operated to be rotated, the second shaft is moved with respect to the frame and the contact position between the contact part of the frame and the operation member is changed such that the fulcrum of the rotating operation of the operation member moves.

* * * * *